US011846004B2

(12) United States Patent
Bogh et al.

(10) Patent No.: US 11,846,004 B2
(45) Date of Patent: Dec. 19, 2023

(54) ULTRA-HIGH STRENGTH WEATHERING STEEL PILES AND STRUCTURAL FOUNDATIONS WITH BENDING RESISTANCE

(71) Applicant: NUCOR CORPORATION, Charlotte, NC (US)

(72) Inventors: Brian Hansen Bogh, Calimesa, CA (US); Kishlay Mishra, Memphis, TN (US); Tao Wang, Germantown, TN (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 16/984,475

(22) Filed: Aug. 4, 2020

(65) Prior Publication Data

US 2021/0087649 A1 Mar. 25, 2021

Related U.S. Application Data

(60) Provisional application No. 62/902,825, filed on Sep. 19, 2019.

(51) Int. Cl.

| | |
|---|---|
| ***C22C 38/04*** | (2006.01) |
| ***C21D 9/52*** | (2006.01) |
| ***C22C 38/46*** | (2006.01) |
| ***C22C 38/42*** | (2006.01) |
| ***C22C 38/06*** | (2006.01) |
| ***C22C 38/02*** | (2006.01) |
| ***C22C 38/00*** | (2006.01) |
| ***C21D 9/46*** | (2006.01) |
| ***C21D 8/02*** | (2006.01) |
| ***C21D 6/00*** | (2006.01) |
| ***C22C 38/48*** | (2006.01) |
| ***B21D 22/02*** | (2006.01) |
| ***C21D 9/48*** | (2006.01) |
| ***C21D 9/56*** | (2006.01) |

(52) U.S. Cl.

CPC ..... *C21D 9/52* (2013.01); *B21D 22/022* (2013.01); *C21D 6/004* (2013.01); *C21D 6/005* (2013.01); *C21D 6/008* (2013.01); *C21D 8/0205* (2013.01); *C21D 8/0215* (2013.01); *C21D 8/0226* (2013.01); *C21D 8/0263* (2013.01); *C21D 9/46* (2013.01); *C21D 9/48* (2013.01); *C21D 9/563* (2013.01); *C22C 38/002* (2013.01); *C22C 38/02* (2013.01); *C22C 38/04* (2013.01); *C22C 38/06* (2013.01); *C22C 38/42* (2013.01); *C22C 38/46* (2013.01); *C22C 38/48* (2013.01); *C21D 2211/002* (2013.01); *C21D 2211/008* (2013.01)

(58) Field of Classification Search

CPC ..... C22C 38/04

See application file for complete search history.

(56) References Cited

U.S. PATENT DOCUMENTS

| | | | |
|---|---|---|---|
| 4,087,898 | A | 5/1978 | Linne |
| 4,437,902 | A | 3/1984 | Pickens et al. |
| 4,676,844 | A | 6/1987 | Satoh et al. |
| 5,105,638 | A | 4/1992 | Mito et al. |
| 5,129,966 | A | 7/1992 | Rao |
| 5,454,883 | A | 10/1995 | Yoshie et al. |
| 5,508,119 | A | 4/1996 | Sheu et al. |
| 5,636,543 | A | 6/1997 | Kajiwara et al. |
| 5,666,837 | A | 9/1997 | Kajiwara et al. |
| 6,187,117 | B1 | 2/2001 | Shen et al. |
| 6,258,181 | B1 | 7/2001 | Yamamoto et al. |
| 6,348,108 | B1 | 2/2002 | Yusa et al. |
| 7,601,226 | B2 | 10/2009 | Voges et al. |
| 8,062,095 | B2 | 11/2011 | Voges et al. |
| 8,066,549 | B2 | 11/2011 | Voges et al. |
| 8,074,331 | B2 | 12/2011 | Voges |
| 8,128,460 | B2 | 3/2012 | Voges et al. |
| 8,707,529 | B2 | 4/2014 | Voges |
| 9,149,868 | B2 | 10/2015 | Williams et al. |
| 9,333,625 | B1 | 5/2016 | Voges et al. |
| 10,174,398 | B2 | 1/2019 | Watson et al. |
| 10,815,544 | B2 * | 10/2020 | Wang ..... B21B 27/106 |
| 2004/0016530 | A1 | 1/2004 | Schoen et al. |
| 2008/0110592 | A1 | 5/2008 | Mao et al. |
| 2008/0219879 | A1 | 9/2008 | Williams et al. |
| 2008/0264525 | A1 | 10/2008 | Alwin |
| 2010/0092331 | A1 | 4/2010 | Jeong et al. |
| 2010/0186856 | A1 | 7/2010 | Williams et al. |
| 2010/0258217 | A1 | 10/2010 | Kuehmann et al. |
| 2010/0319814 | A1 | 12/2010 | Perez et al. |
| 2011/0303386 | A1 | 12/2011 | Blejde et al. |
| 2012/0216925 | A1 | 8/2012 | Kobayashi et al. |
| 2013/0126120 | A1 | 5/2013 | Nooning et al. |
| 2014/0014238 | A1 | 1/2014 | Carpenter et al. |
| 2014/0366602 | A1 | 12/2014 | Fang et al. |
| 2014/0373981 | A1 | 12/2014 | Wang et al. |

(Continued)

FOREIGN PATENT DOCUMENTS

| | | | |
|---|---|---|---|
| CN | 101818303 | A | 9/2010 |
| CN | 10330225 | A | 9/2013 |

(Continued)

OTHER PUBLICATIONS

English machine translation of JP 2013227614 A of Sekido et al published Nov. 2013 (Year: 2013).*

(Continued)

*Primary Examiner* — Jophy S. Koshy

(74) *Attorney, Agent, or Firm* — Hahn Loeser & Parks LLP

(57) ABSTRACT

Disclosed herein is a light-gauge, ultra-high strength weathering steel pile for use as a steel foundation in structures such as, for example, solar arrangements. The light-gauge, ultra-high strength weathering steel pile comprises a thickness of 2.5 mm or less that has been cold roll formed into a steel pile having a web and a pair of opposing flanges, each having discontinuities formed therein. The steel pile further comprises a yield strength of between 700 and 1600 MPa, a tensile strength of between 1000 and 2100 MPa, and an elongation of between 1% and 10%.

28 Claims, 31 Drawing Sheets

(56) References Cited

U.S. PATENT DOCUMENTS

| | | | | |
|---|---|---|---|---|
| 2015/0007913 | A1 | 1/2015 | Wang et al. | |
| 2015/0321232 | A1 | 11/2015 | Stewart et al. | |
| 2016/0177411 | A1 | 6/2016 | Watson et al. | |
| 2017/0204487 | A1 | 7/2017 | Belchior | |
| 2017/0240992 | A1 | 8/2017 | Watson et al. | |
| 2018/0058067 | A1 | 3/2018 | Lake | |
| 2019/0161817 | A1 | 5/2019 | Takenaka et al. | |
| 2019/0309383 | A1 | 10/2019 | Wang et al. | |
| 2020/0255927 | A1* | 8/2020 | Wang | C21D 8/0278 |
| 2020/0256029 | A1* | 8/2020 | Wang | C21D 8/0226 |
| 2020/0347470 | A1* | 11/2020 | Wang | B22D 11/0682 |
| 2020/0406321 | A1 | 12/2020 | Shiraishi et al. | |

FOREIGN PATENT DOCUMENTS

| | | | |
|---|---|---|---|
| CN | 103305759 | A | 9/2013 |
| CN | 103305770 | A | 9/2013 |
| CN | 103643135 | A | 3/2014 |
| CN | 108252320 | A | 7/2018 |
| DE | 2809356 | A1 | 9/1979 |
| DE | 112013000747 | T5 | 12/2014 |
| DE | 112013001434 | T5 | 12/2014 |
| GB | 289812 | A | 10/1928 |
| JP | S53114762 | A | 10/1978 |
| JP | S56071502 | A | 6/1981 |
| JP | S57149010 | A | 9/1982 |
| JP | H02182302 | A | 7/1990 |
| JP | H05228516 | A | 9/1993 |
| JP | H09118950 | A | 5/1997 |
| JP | 10156413 | A | 6/1998 |
| JP | H10166011 | A | 6/1998 |
| JP | 2007085043 | A | 4/2007 |
| JP | 2010144209 | A | 7/2010 |
| JP | 2013208639 | A | 10/2013 |
| JP | 2013227614 | A | 11/2013 |
| JP | 2013227614 | A * | 11/2013 |
| KR | 100602477 | B1 | 7/2006 |
| KR | 1020140009674 | A | 1/2014 |
| SU | 136612 | A1 | 11/1960 |
| SU | 1047557 | A1 | 10/1983 |
| SU | 1676694 | A1 | 9/1991 |
| WO | 9942669 | A1 | 8/1999 |
| WO | 2010094077 | A1 | 8/2010 |
| WO | 2013135095 | A1 | 9/2013 |
| WO | 2018157136 | A1 | 8/2018 |
| WO | 2020162983 | A1 | 8/2020 |
| WO | 2020163664 | A1 | 8/2020 |

OTHER PUBLICATIONS

Demand Chapter II filed in International Patent Application PCT/US2020/017123 on Dec. 4, 2020, 78 pages.

International Preliminary Report on Patentability for International Patent Application PCT/2020/017123 dated Feb. 5, 2021, 70 pages.

Non-Final Office Action for U.S. Appl. No. 16/784,826 dated Dec. 23, 2020, 48 pages.

Final Office Action for U.S. Appl. No. 16/784,826 dated Apr. 22, 2021, 35 pages.

Response to Non-Final Office Action filed in U.S. Appl. No. 16/784,826 dated Mar. 22, 2021, 152 pages.

PCT/US2020/044401 International Search Report and Written Opinion dated Nov. 20, 2020, 23 pages.

Extended European Search Report for EP 19780857.9 dated Dec. 18, 2020, 7 pages.

Feb. 19, 2021 International Search Report and Written Opinion mailed in PCT/US2020/044822, 18 pages.

Feb. 5, 2021 International Preliminary Report on Patentability mailed in PCT/US2020/017123, 6 pages.

Orowan, E., "The Calculation of Roll Pressure in hot and Cold Flat Rolling", Proc. Institute of Mechanical Engineers, (1943) vol. 150. pp. 140-167.

Sun, W., et al., "Friction in the roll bite under various hot rolling conditions", In D. Hua, et al. (Eds), Symposium on Advanced Structural Steels and New Rolling Technologies, (2005) pp. 110-120. China: Northeastern University.

Azushima, A., et al., "Prediction of effect of rolling speed on coefficient of friction in hot sheet rolling of steel using sliding rolling tribo-simulator", J. Mater. Process. Tech. (2009) doi: 10.1016/j.jmatprotec.2009.08.005, 6 pages.

Abdelraouf-Allam, TM. Direct Hot Rolled Dual Phase Weathering Steel. Dissertation for the Degree of Masters of Science, iEHK Steel Institute, Rwthaachen University, Nov. 26, 2015, 99 pages.

ASTM A606, Standard for Steel, Sheet and Strip, High-Strength, Low-Alloy, Hot-Rolled and Cold-Rolled, with Improved Atmospheric Corrosion Resistance, as downloaded from astm.org on Sep. 22, 2016, 4 pages.

ASTM G101, Standard Guide for Estimating the Atmospheric Corrosion Resistance of Low-Alloy Steels, as downloaded from astm.org on Sep. 22, 2016, 9 pages.

PCT/US2016/020205 International Search Report and Written Opinion dated May 6, 2016, 16 pages.

PCT/US2019/026036 International Search Report and Written Opinion dated Jul. 9, 2019, 7 pages.

PCT/US2019/052050 International Search Report and Written Opinion dated Jan. 7, 2020, 12 pages.

PCT/US2020/017123 International Search Report and Written Opinion dated Jul. 20, 2020, 13 pages.

PCT/US2020/044822 International Preliminary Report on Patentability dated Sep. 16, 2021, 134 pages.

Extended European Search Report for European Patent Application No. 20865033.3 dated Oct. 13, 2022, 20 pages.

* cited by examiner

ULTRA-HIGH STRENGTH WEATHERING STEEL PILES AND STRUCTURAL FOUNDATIONS WITH BENDING RESISTANCE

This patent application claims priority to and benefit of U.S. Provisional Application No. 62/902,825, filed Sep. 19, 2019, which is incorporated herein by reference.

BACKGROUND AND SUMMARY

This invention relates to thin cast steel strips, methods for high friction rolling a thin cast steel strips, and steel products made therefrom and thereby.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

To obtain a desired thickness the thin steel strip may pass through a mill to hot roll the thin steel strip. While performing hot rolling, the thin steel strip is generally lubricated to reduce the roll bite friction, which in turn reduces the rolling load and roll wear, as well as providing a smoother surface finish. The lubrication is used to provide a low friction condition. A low friction condition is defined as one where the coefficient of friction ($\mu$) for the roll bite is less than 0.20. After hot rolling, the thin steel strip undergoes a cooling process. In a low friction condition, after undergoing a pickling or acid etching process to remove oxidation scale, large prior austenite grain boundary depressions have been observed on the hot rolled exterior surfaces of cooled thin steel strips. In particular, while the thin steel strips tested using dye penetrant techniques appeared defect free, after acid pickling of the same thin steel strips, the prior austenite grain boundaries are etched by the acid to form prior austenite grain boundary depressions. This etching may further cause a defect phenomenon to occur along the etched prior austenite grain boundaries and the resulting depressions. The resulting defects and separations, which are more generally referred to as separations, can extend at least 5 microns in depth, and in certain instances 5 to 10 microns in depth.

Also applicable to the present disclosure, weathering steels are typically high strength low alloy steels resistant to atmospheric corrosion. In the presence of moisture and air, low alloy steels oxidize at a rate that depends on the level of exposure to oxygen, moisture and atmospheric contaminants to the metal surface. When the steel oxidizes it can form an oxide layer commonly referred to as rust. As the oxidation process progresses, the oxide layer forms a barrier to the ingress of oxygen, moisture and contaminants, and the rate of rusting slows down. With weathering steel, the oxidation process is initiated in the same way, but the specific alloying elements in the steel produce a stable protective oxide layer that adheres to the base metal, and is much less porous than the oxide layer typically formed in a non-weathering steel. The result is a much lower corrosion rate than would be found on ordinary, non-weathering structural steel.

Weathering steels are defined in ASTM A606, *Standard Specification for Steel, Sheet and Strip, High Strength, Low-Alloy, Hot Rolled and Cold Rolled with Improved Atmospheric Corrosion Resistance*. Weathering steels are supplied in two types: Type 2, which contains at least 0.20% copper based on cast or heat analysis (0.18% minimum Cu for product check); and Type 4, which contains additional alloying elements to provide a corrosion index of at least 6.0 as calculated by ASTM G101, *Standard Guide for Estimating the Atmospheric Corrosion Resistance of Low-Alloy Steels*, and provides a level of corrosion resistance substantially better than that of carbon steels with or without copper addition.

Prior to the present invention, weathering steels were typically limited to yield strengths of less than 700 MPa and tensile strengths of less than 1000 MPa. Also, prior to the present invention, the strength properties of weathering steels typically were achieved by age hardening. U.S. Pat. No. 10,174,398, incorporated herein by reference, is an example of a weathering steel achieved by age hardening.

Due to the strength limitations and corrosion limitations, steels, such as G100 or Gr70 steels, have not been well suited for many products such as, for example, piles or steel foundations driven into the ground for use in solar arrangements and/or the highway industry such as, for example, support guardrails, signage, or the like. As used herein, a solar arrangement is a structure for supporting solar cells, such as on a solar farm of photovoltaic power stations designed for the supply of solar power for use in an electric grid or the like. The corrosive nature of ground water and the soil compositions required material thicknesses well in excess of 2.5 mm to maintain the integrity required for these structural members. Accordingly, hot-dipped galvanized steels were turned to for such uses. The hot-dipped galvanized steels are zinc coated to improve corrosion resistance of the underlying material properties. Accordingly, it has been the solar industry's convention to rely on piles designed from zinc-plated 50 ksi W6 or W8 I-beams for structural piles. The zinc coating, however, negatively reacts with ground water and soil compositions creating the potential for contaminating the same. The zinc coating also provides only a limited degree of protection. Once zinc oxidation deteriorates the zinc coating metal oxidation still sets in deteriorating the structural integrity of the underlying material and/or requiring increased material thicknesses to maintain the integrity required for these structural members.

Accordingly, the present disclosure sets out to provide a pile or steel foundation design produced from a light-gauge, ultra-high strength weathering steel that replaces the current material relied on for piles or steel foundations. Specifically, the present disclosure sets out to provide a light weight pile or steel foundation having shapes produced from a thin cast metal strip. The shapes of the present disclosure set out to increase the strength and durability of the pile or steel foundation to withstand deformation resulting from the force required to drive the structural members into the ground and/or to serve as structural members for above-ground exterior structures such as, for example, solar arrangements, guardrails, signage, or the like. In particular, the present disclosure sets out to provide a pile or steel foundation cold roll formed from a thin cast steel strip having a thickness of 2.5 mm or less, 2.0 mm or less, or 1.6 mm or less or a pile or steel foundation cast as a thin cast steel shape with a material thickness of 2.5 mm or less, 2.0 mm or less, or 1.6 mm or less. The pile or steel foundation is produced from a thin cast steel strip that has been cold roll formed using one or more roll stands. Additionally, a punch system, a CNC plasma system, and/or a roll system, or the like, may also be relied on to provide thru-holes, slots, and/or spot welds, as noted below. The present disclosure also sets out to provide a pile or steel foundation cold roll formed from a thin cast steel strip that does not require a separately applied protective coating such as, for example, a zinc coating as provided on hot-dipped galvanized structural members. As used herein, separately applied coatings are protective coatings that may be a surface protectant that is independent of the composition of the steel. Examples of such separately applied protective coatings include a zinc coating, a galvanized coating (e.g. a hot dipped galvanized coating), an aluminum-silicon corrosion resistant coating, or the like. More importantly, the piles or steel foundations of the present disclosure produce the corrosion resistance, as set forth below, without the aid of a separately applied coating. Inherently, by definition, the ultra-high strength weathering steel disclosed herein possesses the requisite corrosion resistance that hot-dipped galvanizing would otherwise be relied on for. Thereby, the weathering steel of the present disclosure would not require or possess a zinc coating, a hot-dipped galvanized coating, or the like nor would one be applied.

In one set of examples, the present disclosure sets out to provide a light-gauge, ultra-high strength weathering steel formed by shifting of the peritectic point away from the carbon region and/or increasing a transition temperature of the peritectic point of the composition. Specifically, shifting the peritectic point away from the carbon region and/or increasing a transition temperature of the peritectic point of the composition appears to inhibit defects and results in a high strength martensitic steel sheet that is defect free. In the present example, the addition of nickel is relied on for this wherein the addition of nickel must be sufficient enough to shift the 'peritectic point' away from the carbon region that would otherwise be present in the same composition without the addition of nickel. Also disclosed are products produced from an ultra-high strength weathering steel being of various shapes, as additionally disclosed herein, and having improved strength properties that were not previously available.

In another set of examples, the present disclosure sets out to eliminate the prior austenite grain boundary depressions but maintain a smear pattern. In the present set of examples, the thin cast steel strip undergoes a high friction rolling condition where grain boundary depressions form a smear pattern at, at least, the surface of the thin cast steel strip. Specifically, the present example sets out to form the smear pattern of the prior austenite grain boundary depressions upon eliminating the prior austenite grain boundary depressions from the surface and improving the formability of the steel strip or steel product. By improving formability of the steel strip products being of various shapes, as additionally disclosed herein, and having improved strength properties become available that were not previously available. The present example is not only applied with the above-mentioned ultra-high strength weathering steel but may additionally be applied with martensitic steels, other weathering steels, and/or steel strips or products which exhibit prior austenite grain boundary depressions.

Still yet, in another set of examples, the present disclosure sets out to eliminate grain boundary depressions and smear patterns formed therefrom. In the present set of examples, the thin cast steel strip undergoes surface homogenization, thereby, eliminating the smear pattern. As a result, the thin cast steel strip has a surface not only free of prior-austenite grain boundary depressions but additionally free of the smear pattern produced as a result of the high friction rolling condition, to provide, in some examples, a thin cast steel strip surface having a surface roughness (Ra) that is not more than 2.5 μm. The present examples are not only applied with the above-mentioned ultra-high strength weathering steel but may additionally be applied with martensitic steels, other weathering steels, and/or steel strips or products which exhibit prior austenite grain boundary depressions.

Ultra-High Strength Weathering Steel

First, presently disclosed is a light-gauge, ultra-high strength weathering steel sheet made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. and above $Ar_3$ temperature at a cooling rate greater than 15° C./s before rapidly cooling and/or before hot rolling, when hot rolled; and (c) rapidly cooling to form a steel sheet with a microstructure having by volume at least 75% martensite, a yield strength of between 700 and 1600 MPa, a tensile strength of between 1000 and 2100 MPa and an elongation of between 1% and 10%.

Here and elsewhere in this disclosure elongation means total elongation. "Rapidly cooling" means to cool at a rate of more than 100° C./s to between 100 and 200° C. Rapidly cooling the present compositions, with an addition of nickel, achieves up to more than 95% martensitic phase steel strip. In one example, rapidly cooling forms a steel sheet with a microstructure having by volume at least 95% martensite. The addition of nickel must be sufficient enough to shift the 'peritectic point' away from the carbon region that would otherwise be present in the same composition without the addition of nickel. Specifically, the inclusion of nickel in the composition is believed to contribute to the shifting of the peritectic point away from the carbon region and/or increases a transition temperature of the peritectic point of the composition, which appears to inhibit defects and results in a high strength martensitic steel sheet that is defect free. In one example, the light-gauge, ultra-high strength weathering steel sheet may also be hot rolled to between 15% and 50% reduction before rapidly cooling.

Carbon levels in the present sheet steel are preferably not below 0.20% in order to inhibit peritectic cracking of the steel sheet. The addition of nickel is provided to further inhibit peritectic cracking of the steel sheet, but does so independent of relying on the carbon composition alone. The impact of nickel on the corrosion index is reflected in the following equation for determining the corrosion index calculation: $Cu*26.01+Ni*3.88+Cr*1.2+Si*1.49+P*17.28-Cu*Ni*7.29-Ni*P*9.1-Cu*Cu*33.39$ (where each element is a by weight percentage).

The molten melt may be solidified at a heat flux greater than 10.0 $MW/m^2$ into a steel sheet less than 2.5 mm in thickness, and the sheet may be cooled in a non-oxidizing atmosphere to below 1080° C. and above $Ar_3$ temperature at a cooling rate greater than 15° C./s before rapidly cooling and/or before hot rolling, when hot rolled. A non-oxidizing atmosphere is an atmosphere typically of an inert gas such as nitrogen or argon, or a mixture thereof, which contains less than about 5% oxygen by weight. In another example, the sheet may be cooled in a non-oxidizing atmosphere to below 1100° C. and above $Ar_3$ temperature at a cooling rate greater than 15° C./s before rapidly cooling and/or before hot rolling, when hot rolled.

In some examples, the martensite in the steel sheet may form from an austenite grain size of greater than 100 μm. In other examples, the martensite in the steel sheet may form from an austenite grain size of greater than 150 μm.

The steel sheet is rapidly cooled to form a steel sheet with a microstructure having at least 75% martensite, a yield strength of between 700 and 1600 MPa, a tensile strength of between 1000 and 2100 MPa and an elongation of between 1% and 10%. In other examples, the steel sheet is rapidly cooled to form a steel sheet with a microstructure having at least 75% martensite plus bainite. In one specific example, rapidly cooling forms a steel sheet with a microstructure having by volume at least 95% martensite plus bainite.

In some examples, the steel sheet may be hot rolled to between 15% and 35% reduction before rapidly cooling. In other examples, the steel sheet may be hot rolled to between 15% and 50% reduction before rapidly cooling.

The molten steel used to produce the ultra-high strength weathering steel sheet is silicon killed (i.e., silicon deoxidized) comprising between 0.10% and 0.50% by weight silicon. The steel sheet may further comprise by weight less than 0.008% aluminum or less than 0.006% aluminum. The molten melt may have a free oxygen content between 5 to 70 ppm or between 5 to 60 ppm. The steel sheet may have a total oxygen content greater than 50 ppm. The inclusions include $MnOSiO_2$ typically with 50% less than 5 μm in size and have the potential to enhance microstructure evolution and, thus, the strip mechanical properties.

Also disclosed is a method of making a light-gauge, ultra-high strength weathering steel sheet comprising the steps of: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than 0.12% niobium, less than 0.5% molybdenum, between 0.5% and 1.5% nickel, and silicon killed containing less than 0.01% aluminum, and (ii) the remainder iron and impurities resulting from melting; (b) forming the molten melt into a casting pool supported on casting surfaces of a pair of cooled casting rolls having a nip there between; (c) counter rotating the casting rolls and solidifying at a heat flux greater than 10.0 $MW/m^2$ producing a steel sheet less than 2.5 mm in thickness and cooling the sheet in a non-oxidizing atmosphere to below 1080° C. and above $Ar_3$ temperature at a cooling rate greater than 15° C./s before rapidly cooling and/or before hot rolling, when hot rolled, and (d) rapidly cooling to form a steel sheet with a microstructure having at least 75% martensite, a yield strength of between 700 and 1600 MPa, a tensile strength of between 1000 and 2100 MPa and an elongation of between 1% and 10%. In one specific example, rapidly cooling forms a steel sheet with a microstructure having by volume at least 95% martensite plus bainite. The sheet may be cooled in a non-oxidizing atmosphere to below 1100° C. and above $Ar_3$ temperature at a cooling rate greater than 15° C./s before rapidly cooling and/or before hot rolling, when hot rolled. The steel sheet composition cannot be made with carbon levels below 0.20% because it is inoperative with peritectic cracking of the steel sheet. In one example, the light-gauge, ultra-high strength weathering steel sheet may be hot rolled to between 15% and 50% reduction before rapidly cooling.

Further, the method of making a light-gauge, ultra-high strength weathering steel sheet may comprise the step of tempering the steel sheet at a temperature between 150° C. and 250° C. for between 2 and 6 hours.

The molten melt may have a free oxygen content between 5 to 70 ppm or between 5 to 60 ppm. The steel sheet may have a total oxygen content greater than 50 ppm. The molten melt may be solidified at a heat flux greater than 10.0 $MW/m^2$ into a steel sheet less than 2.5 mm in thickness, and cooled in a non-oxidizing atmosphere to below 1080° C. and above $Ar_3$ temperature at a cooling rate greater than 15° C./s before rapidly cooling and/or before hot rolling, when hot rolled. In another example, the sheet may be cooled in a non-oxidizing atmosphere to below 1100° C. and above $Ar_3$ temperature at a cooling rate greater than 15° C./s before rapidly cooling and/or before hot rolling, when hot rolled.

In some embodiments, the martensite in the steel sheet may come from an austenite grain size of greater than 100 μm. In other embodiments, the martensite in the steel sheet may come from an austenite grain size of greater than 150 μm.

The method of making the light-gauge, ultra-high strength weathering steel sheet may further comprise hot rolling the steel sheet to between 15% and 35% reduction and, thereafter, rapidly cooling to form a steel sheet with a microstructure having at least 75% by volume martensite, a yield strength of between 700 and 1600 MPa, a tensile strength of between 1000 and 2100 MPa and an elongation of between 1% and 10%. In some embodiments, the method of making light-gauge, ultra-high strength steel sheet may further comprise hot rolling the steel sheet to between 15% and 50% reduction and, thereafter, rapidly cooling to form a steel sheet with a microstructure having at least 75% by volume martensite plus bainite, a yield strength of between 700 and 1600 MPa, a tensile strength of between 1000 and 2100 MPa and an elongation of between 1% and 10%. Furthermore, the method of making hot rolled light-gauge, ultra-high strength steel sheet may comprise hot rolling the steel sheet to between 15% and 35% reduction and, thereafter, rapidly cooling to form a steel sheet with a microstructure having at least 75% by volume martensite plus bainite, a yield strength of between 700 and 1600 MPa, a tensile strength of between 1000 and 2100 MPa and an elongation of between 1% and 10%. In specific examples of the above, hot rolling the steel sheet and, thereafter, rapidly cooling forms a steel sheet with a microstructure having by volume at least 95% martensite plus bainite.

Also disclosed is a steel pile comprising a web and one or more flanges cold roll formed from a carbon alloy steel sheet having a composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum where the carbon alloy steel sheet has a microstructure having at least 75% by volume martensite or martensite plus bainite, a yield strength of between 700 and 1600 MPa, a tensile strength of between 1000 and 2100 MPa, an elongation of between 1% and 10%, and having a corrosion index of 6.0 or greater.

High Friction Rolled High Strength Weathering Steel

Second, in one set of examples, presently disclosed is a carbon alloy thin cast steel strip having an as cast thickness of less than or equal to 2.5 mm. These examples are not only applied with the above-mentioned ultra-high strength weathering steel but may additionally be applied with martensitic steels, other weathering steels, and/or steel strips or products which exhibit prior austenite grain boundary depressions. The carbon alloy thin cast steel strip may comprise, by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminium, and the remainder iron and impurities resulting from melting. After high friction hot rolling the thickness of the carbon alloy thin cast steel strip is reduced by 15% to 50% of the as cast thickness. The hot rolled steel strip comprises a pair of opposing high friction hot rolled surfaces primarily free, substantially free, or free of prior austenite grain boundary depressions and having a smear pattern. In some embodiments, the steel strip comprises a microstructure having by volume at least 75% martensite or at least 75% martensite plus bainite, a yield strength of between 700 and 1600 MPa, a tensile strength of between 1000 and 2100 MPa, and an elongation of between 1% and 10%. In some examples, the steel strip is a weathering steel with a corrosion index of 6.0 or greater.

In some examples, the pair of opposing high friction hot rolled surfaces are substantially free of prior austenite grain boundary depressions. In some examples, the pair of opposing high friction hot rolled surfaces are primarily free of prior austenite grain boundary depressions.

Also disclosed is a method of making hot rolled carbon alloy steel strip comprising by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and the remainder iron and impurities resulting from melting, the method comprising the steps of:

(a) preparing a molten steel melt;
(b) forming the melt into a casting pool supported on casting surfaces of a pair of cooled casting rolls having a nip there between;
(c) counter rotating the casting rolls and solidifying at a heat flux greater than 10.0 $MW/m^2$ the molten melt into a steel strip of less than or equal to 2.5 mm in thickness delivered downwardly from the nip and cooling the strip in a non-oxidizing atmosphere to below 1080° C. and above the $Ar_3$ temperature at a cooling rate greater than 15° C./s;
(d) high friction hot rolling the thin cast steel strip to a hot rolled thickness of between a 15% and 50% reduction of the as cast thickness producing a hot rolled steel strip primarily free, substantially free, or free of prior austenite grain boundary depressions and having a smear pattern.

The high friction hot rolled thin cast steel strip primarily free, substantially free, or free of prior-austenite grain boundary depressions and having a smear pattern may be a weathering steel with a corrosion index of 6.0 or greater. Also, the high friction hot rolled steel strip may comprise a microstructure having, by volume, at least 75% martensite or at least 75% martensite plus bainite, a yield strength of between 700 and 1600 MPa, a tensile strength of between 1000 and 2100 MPa, and an elongation of between 1% and 10%.

High Friction Rolled High Strength Martensitic Steel

Third, in yet another set of examples, presently disclosed is a carbon alloy thin cast steel strip comprising a pair of opposing high friction hot rolled surfaces that have been surface homogenized, upon having been high friction rolled. These present examples are not only applied with the above-mentioned ultra-high strength weathering steel but may additionally be applied with martensitic steels, other weathering steels, and/or steel strips or products which exhibit prior austenite grain boundary depressions. Upon being surface homogenized, the pair of opposing high friction hot rolled surfaces are free of the smeared grain boundary depressions which were previously formed as a result of the high friction rolling process. In some embodiments, the carbon alloy thin cast steel strip may further comprise a microstructure having, by volume, at least 75% martensite or at least 75% martensite plus bainite with a yield strength of between 700 and 1600 MPa, a tensile strength of between 1000 and 2100 MPa, and an elongation of between 1% and 10%. In some embodiments, the steel strip comprises a microstructure having, by volume, at least 90% martensite or at least 90% martensite plus bainite. In some embodiments, the steel strip of claim 1 comprises a microstructure having, by volume, at least 95% martensite or at least 95% martensite plus bainite.

Exemplary homogenized steel strips within the scope of this disclosure may comprise, by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and the remainder iron and impurities resulting from melting.

Also disclosed are methods of making hot rolled carbon alloy steel strip. The method may comprise the steps of:

(a) preparing a molten steel melt;
(b) forming the melt into a casting pool supported on casting surfaces of a pair of cooled casting rolls having a nip there between;
(c) counter rotating the casting rolls and solidifying at a heat flux greater than 10.0 $MW/m^2$ the molten melt into a steel strip of less than or equal to 2.5 mm in thickness delivered downwardly from the nip and cooling the strip in a non-oxidizing atmosphere to below 1080° C. and above the $Ar_3$ temperature at a cooling rate greater than 15° C./s;
(d) high friction rolling the thin cast steel strip to a hot rolled thickness of between a 15% and 50% reduction of the as cast thickness producing a hot rolled steel strip free of prior-austenite grain boundary depressions and having a smear pattern; and
(e) surface homogenizing the high friction hot rolled steel strip to eliminate the smear pattern.

The high friction hot rolled homogenized thin cast steel strip may comprise a microstructure having, by volume, at least 75% martensite or at least 75% martensite plus bainite, a yield strength of between 700 and 1600 MPa, a tensile strength of between 1000 and 2100 MPa, and an elongation of between 1% and 10%, thereby, providing a high strength martensitic steel. Further, the high friction hot rolled homogenized steel strip may comprise, by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and the remainder iron and impurities resulting from melting.

The present disclosure further sets out as to how each of the thin cast steel strips, the above compositions, and/or the above properties, as described, may be relied on for an ultra-high strength weathering steel pile. Specifically, in one example an ultra-high strength weathering steel pile comprises a plurality of sidewalls, each sidewall having a thickness of about 2.5 mm or less, 2.0 mm or less, or 1.6 mm or less. The pile may be formed from a steel strip. Specifically, the pile may be formed from an as cast steel strip. The pile may be formed from a hot rolled as cast steel strip. Moreover, the pile may be cold roll formed. The pile may have a composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and the remainder iron and impurities resulting from melting. The pile may further comprise, or have, a corrosion index of 6.0 or greater, a yield strength of between 700 and 1600 MPa, a tensile strength of between 1000 and 2100 MPa, and/or an elongation of between 1% and 10%.

In some examples, the composition of the pile includes an amount of nickel sufficient for shifting a peritectic point away from the carbon region and/or increasing a transition temperature of the peritectic point to form a carbon alloy steel strip having a microstructure of at least 75% by volume martensite or martensite plus bainite. In some examples, the pile may be formed from a steel strip where the as cast thickness of the steel strip is hot rolled having a hot rolled thickness of between a 15% and 50% reduction of the as cast thickness. The hot rolled material may be high friction rolled to provide a high friction rolled thickness.

Various features and shapes for the ultra-high strength weathering steel are further described herein. These features may be provided in combination or independent of one another. In some examples the ultra-high strength weathering steel pile may be a C-channel where the plurality of sidewalls are a web and one or more flanges. More specifically, the ultra-high strength weathering steel pile may be a hemmed C-channel and/or a corrugated C-channel where the plurality of sidewalls are a web and one or more flanges. In some examples the ultra-high strength weathering steel pile may be a tube where the plurality of sidewalls form the tube. More specifically, the ultra-high strength weathering steel pile may be a square tube or a rectangular tube. Further, the ultra-high strength weathering steel pile may be a square tube or a rectangular tube, generally, where one or more of the plurality of sidewalls further comprise one or more corrugations. The plurality of sidewalls do not comprise a separately applied coating. The plurality of sidewalls are ungalvanized. At least one sidewall of the plurality of sidewalls may be a hem. More specifically, the one or more flanges of the hemmed C-channel may be a single hem. A first layer and a second layer of each single hem of the one or more flanges may be secured together by one or more spot welds. The first layer of the one or more flanges may transition to the second layer through a teardrop transition. Additionally, or alternatively, at least one of the plurality of sidewalls may comprise one or more corrugations. In some examples, the web of a C-channel may comprise one or more corrugations. Additionally, or alternatively, the one or more flanges of a C-channel may comprise one or more corrugations.

More specifically, the ultra-high strength weathering steel pile may comprise a web and a pair of opposing flanges where each have one or more discontinuities formed therein. In one example the web may comprise a discontinuity that is a V-shaped transition. The V-shaped transition may be centrally positioned on the web relative the height of the pile. Such a pile may be referred to as a M-Channel. Additionally, or alternatively, one flange or both flanges of the pair of opposing flanges may comprise a discontinuity that is a V-shaped transition. The V-shaped transition of the flanges may be centrally positioned on the flange relative the width of the pile. In some examples the discontinuities may be one or more corrugations that are arcs. The arcs may be true arcs. Alternatively, the arcs may comprise one or more flats. The one or more flats may be at least 1× the material thickness. In one example, the web may comprise two corrugations that are arcs and that may be evenly spaced on the web relative the height of the pile. Additionally, or alternatively, one flange or both flanges of the pair of opposing flanges may comprise one or more corrugations that are arcs. In each of the examples above one flange or both flanges of the pair of opposing flanges may comprise a return lip. The return lip may return at an angle oblique relative to both the web and the corresponding flange. In examples of the above the height of the ultra-high strength weathering steel pile a height of the pile extending the web may be between 4 and 12 inches and a width of the pile extending each flange of the pair of opposing flanges may be between 2 and 8 inches. In other examples of the above the height of the ultra-high strength weathering steel pile may be between 2 and 14 inches and the width may be between 1 and 10 inches.

In some examples an ultra-high strength weathering steel pile comprises a thickness of about 2.5 mm or less, 2.0 mm or less, or 1.6 mm or less. The pile may be formed from a thin cast steel strip that is cold roll formed into the steel pile having a plurality of sidewalls with a corrosion index of 6.0 or greater. The ultra-high strength weathering steel pile may further comprise a yield strength of between 700 and 1600 MPa, a tensile strength of between 1000 and 2100 MPa, and an elongation of between 1% and 10%. The composition of the ultra-high strength weathering steel pile may include an amount of nickel sufficient for shifting a peritectic point away from the carbon region and/or increasing a transition temperature of the peritectic point to form a carbon alloy steel strip having a microstructure of at least 75% by volume martensite or martensite plus bainite. In an example, the ultra-high strength weathering steel pile has a material composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and the remainder iron and impurities resulting from melting.

Also discussed herein is a solar arrangement. The solar arrangement may comprise an ultra-high strength weathering steel pile comprising a plurality of sidewalls and/or a web and a pair of opposing flanges where each have one or more discontinuities formed therein, each sidewall, web, and flanges may have a thickness of about 2.5 mm or less, 2.0 mm or less, or 1.6 mm or less. The ultra-high strength weathering steel pile of the solar arrangement may comprise, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and the remainder iron and impurities resulting from melting. The ultra-high strength weathering steel pile of the solar arrangement may comprise a yield strength of between 700 and 1600 MPa, a tensile strength of between 1000 and 2100 MPa, and an elongation of between 1% and 10%. In this example, a partial length of the ultra-high strength weathering steel pile is driven into a ground surface and one or more solar cells are supported above the ground surface by the ultra-high strength weathering steel pile. Accordingly, the ultra-high strength weathering steel pile of the solar arrangement may additionally, or alternatively, have the many features as described above and in the remainder of the disclosure.

Examples of the ultra-high strength weathering steel piles may also be stored and/or transported in a nesting arrangement. A nesting arrangement of ultra-high strength weathering steel piles may comprise a row of steel piles having a first, second, and third steel pile each comprising a web and a pair of opposing flanges, each having discontinuities formed therein, where a one flange of the pair of opposing flanges of the first steel pile overlaps and interlocks with one flange of the pair of opposing flanges of the second steel pile and one flange of the pair of opposing flanges of the third steel pile overlaps and interlocks with another flange of the pair of opposing flanges of the second steel pile. The nesting arrangement may further comprising a second row of steel piles having a fourth, fifth, and sixth steel pile each comprising a web and a pair of opposing flanges, each having discontinuities formed therein, where the fourth, fifth, and sixth steel piles are respectively arranged like the first, second, and third steel piles and are stacked on top of the first, second, and third steel piles forming a stack of two rows. In some examples, the nesting arrangement may comprise multipole rows with multiple piles therein such as, for example, at least five rows of multiple steel piles.

BRIEF DESCRIPTION OF THE DRAWINGS

The invention may be more fully illustrated and explained with reference to the accompanying drawings in which.

DETAILED DESCRIPTION OF THE DRAWINGS

Figure 1:
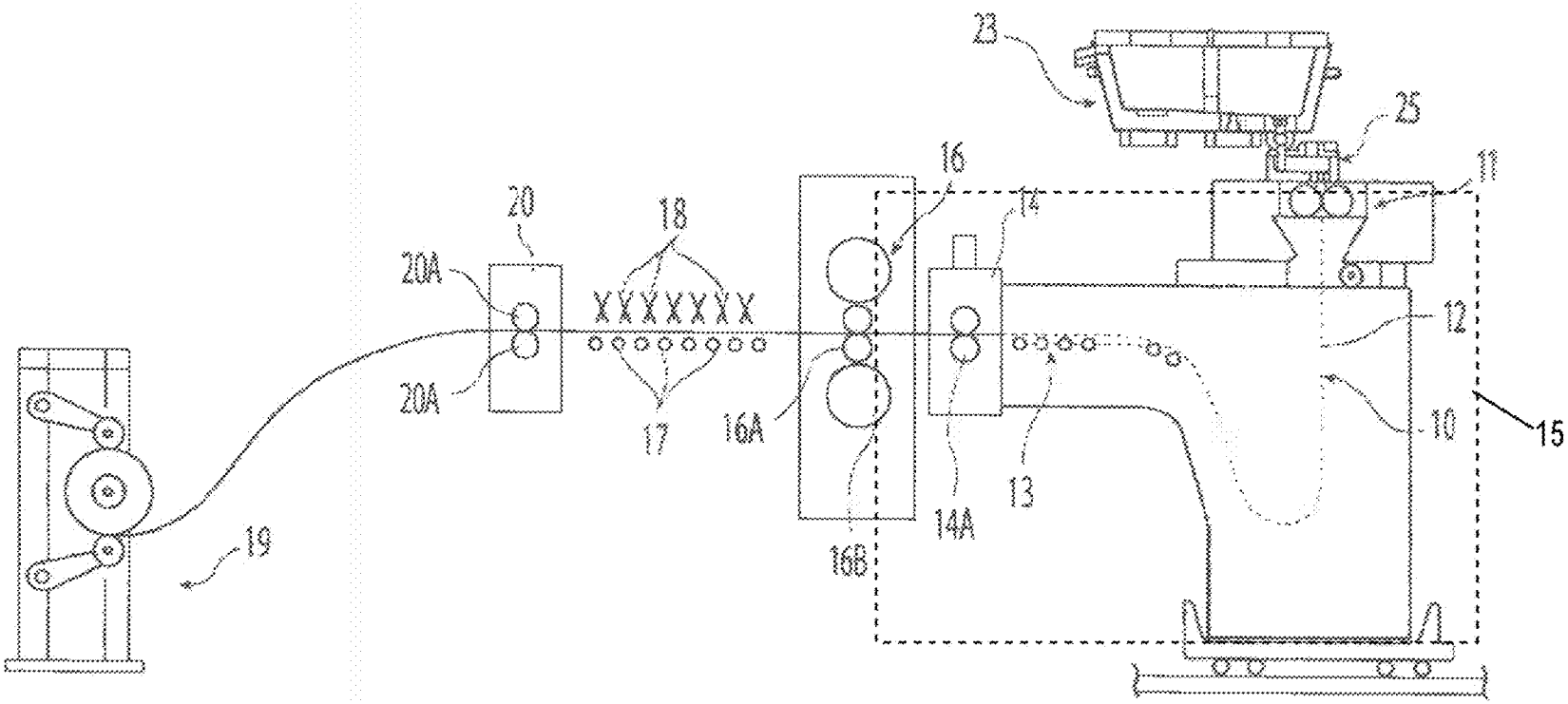
FIG. 1 illustrates a strip casting installation incorporating an in-line hot rolling mill and coiler.

Described herein, in one example, is a light-gauge, ultra-high strength weathering steel sheet. A light-gauge, ultra-high strength weathering steel sheet may be made from a molten melt. The molten melt may be processed through a twin roll caster. In one example, the light-gauge, ultra-high strength weathering steel sheet may be made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ producing a steel sheet less than 2.5 mm in thickness and cooling in a non-oxidizing atmosphere to below 1080° C. and above $Ar_3$ temperature at a cooling rate greater than 15° C./s before rapidly cooling and/or before hot rolling, when hot rolled; and (c) rapidly cooling to form a steel sheet with a microstructure having at least 75% by volume martensite or martensite plus bainite, a yield strength of between 700 and 1600 MPa, a tensile strength of between 1000 and 2100 MPa and an elongation of between 1% and 10%. In one example, the light-gauge, ultra-high strength weathering steel sheet may also be hot rolled to between 15% and 50% reduction before rapid cooling. The sheet may be cooled in a non-oxidizing atmosphere to below 1100° C. and above $Ar_3$ temperature at a cooling rate greater than 15° C./s before rapidly cooling and/or before hot rolling, when hot rolled. The $Ar_3$ temperature is the temperature at which austenite begins to transform to ferrite during cooling. In other words, the $Ar_3$ temperature is the point of austenite transformation. In each example, the nickel shifts the peritectic point away from the carbon region and/or increases a transition temperature of the peritectic point of the composition of the steel sheet to provide a steel sheet that is defect free. The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

Also described herein are thin cast steel strips having hot rolled exterior side surfaces characterized as being primarily free, substantially free, or free of prior austenite grain boundary depressions but having smears, or elongated surface structures, such as in the examples of a high friction rolled high strength martensitic steel. Also described herein are methods or processes for producing same. These examples are not only applied with the above-mentioned ultra-high strength weathering steel but may additionally be applied with martensitic steels, other weathering steels, and/or steel strips or products which exhibit prior austenite grain boundary depressions.

Further described herein are thin steel strips having hot rolled exterior side surfaces characterized as being primarily free, substantially free, or free of prior austenite grain boundary depressions and free of smears, or elongated surface structures, such as in the examples of a high friction rolled high strength weathering steel. Also described herein are methods or processes for producing same. These examples are not only applied with the above-mentioned ultra-high strength weathering steel but may additionally be applied with martensitic steels, other weathering steels, and/or steel strips or products which exhibit prior austenite grain boundary depressions.

As used herein, primarily free means less than 50% of each opposing hot rolled exterior side surface contains prior austenite grain boundaries or prior austenite grain boundary depressions after acid etching (pickling). At least substantially free of all prior austenite grain boundaries or prior austenite grain boundary depressions means that 10% or less of each opposing hot rolled exterior side surface contains prior austenite grain boundary depressions or prior austenite grain boundary depressions after acid etching (pickling). Said depressions form etched grain boundary depressions after acid etching (also known as pickling) to render the prior austenite grain boundaries visible at 250× magnification. In other instances, free connotes that each opposing hot rolled exterior side surface is free, that is, completely devoid, of prior austenite grain boundary depressions, which includes being free of any prior austenite grain boundary depressions after acid etching. It is stressed that prior austenite grain boundaries may still exist within the material of the strip after hot rolling where the grain boundary depressions and separations on the surface have been removed by way of the techniques described herein (e.g. where hot rolling occurs at a temperature above the $A_{r3}$ temperature using roll bite coefficients of friction equal to or greater than 0.20).

Figure 2:
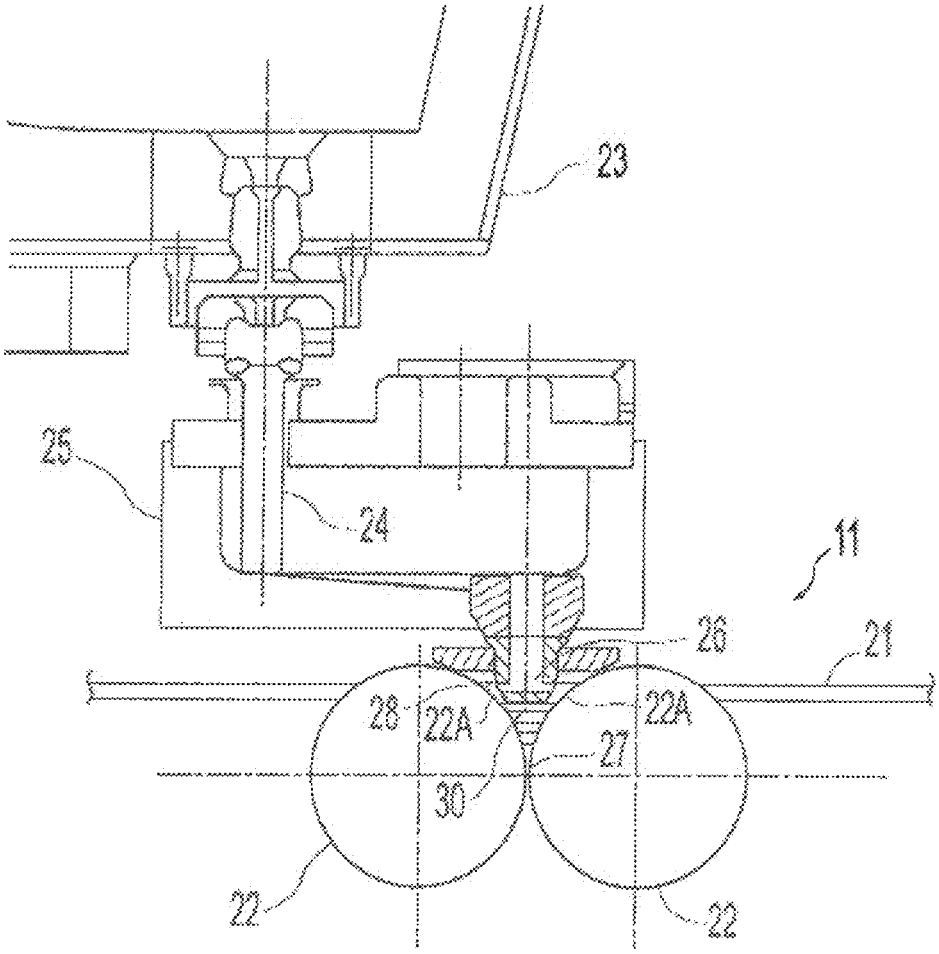
FIG. 2 illustrates details of the twin roll strip caster.

FIGS. 1 and 2 illustrate successive parts of strip caster for continuously casting steel strip, or steel sheet, of the present invention. A twin roll caster 11 may continuously produce a cast steel strip 12, which passes in a transit path 10 across a guide table 13 to a pinch roll stand 14 having pinch rolls 14A. Immediately after exiting the pinch roll stand 14, the strip passes into a hot rolling mill 16 having a pair of work rolls 16A and backing rolls 16B, where the cast strip is hot rolled to reduce a desired thickness. The hot rolled strip passes onto a run-out table 17 where the strip enters an intensive cooling section via water jets 18 (or other suitable means). The rolled and cooled strip then passes through a pinch roll stand 20 comprising a pair of pinch rolls 20A and then to a coiler 19.

As shown in FIG. 2, twin roll caster 11 comprises a main machine frame 21, which supports a pair of laterally positioned casting rolls 22 having casting surfaces 22A. Molten metal is supplied during a casting operation from a ladle (not shown) to a tundish 23, through a refractory shroud 24 to a distributor or moveable tundish 25, and then from the distributor or moveable tundish 25 through a metal delivery nozzle 26 between the casting rolls 22 above the nip 27. The molten metal delivered between the casting rolls 22 forms a casting pool 30 above the nip supported on the casting rolls. The casting pool 30 is restrained at the ends of the casting rolls by a pair of side closure dams or plates 28, which may be urged against the ends of the casting rolls by a pair of thrusters (not shown) including hydraulic cylinder units (not shown) connected to the side plate holders. The upper surface of casting pool 30 (generally referred to as the "meniscus" level) usually is above the lower end of the delivery nozzle so that the lower end of the delivery nozzle is immersed within the casting pool 30. Casting rolls 22 are internally water cooled so that shells solidify on the moving casting roll surfaces as they pass through the casting pool, and are brought together at the nip 27 between them to produce the cast strip 12, which is delivered downwardly from the nip between the casting rolls.

The twin roll caster may be of the kind that is illustrated and described in some detail in U.S. Pat. Nos. 5,184,668, 5,277,243, 5,488,988, and/or U.S. patent application Ser. No. 12/050,987, published as U.S. Publication No. 2009/0236068 A1. Reference is made to those patents and publications which are incorporated by reference for appropriate construction details of a twin roll caster that may be used in an example of the present invention.

After the thin steel strip is formed (cast) using any desired process, such as the strip casting process described above in conjunction with FIGS. 1 and 2, the strip may be hot rolled and cooled to form a desired thin steel strip having opposing hot rolled exterior side surfaces at least primarily free, substantially free, or free of prior austenite grain boundary depressions. As illustrated in FIG. 1, the in-line hot rolling mill 16 provides 15% to 50% reductions of strip from the caster. On the run-out-table 17, the cooling may include a water cooling section to control the cooling rates of the austenite transformation to achieve desired microstructure and material properties.

Figure 3:
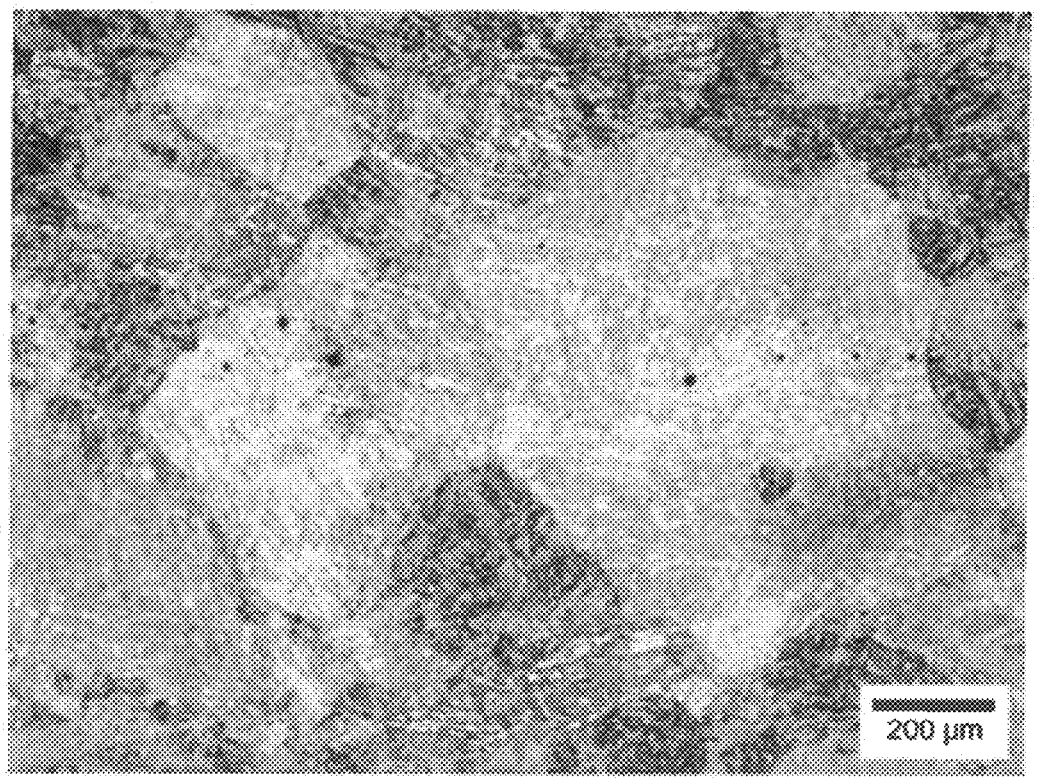
FIG. 3 is a micrograph of a steel sheet with a microstructure having at least 75% martensite.

FIG. 3 shows a micrograph of a steel sheet with a microstructure having at least 75% martensite from a prior austenite grain size of at least 100 μm. In some examples, the steel sheet is rapidly cooled to form a steel sheet with a microstructure having at least 90% by volume martensite or martensite and bainite. In another example, the steel sheet is rapidly cooled to form a steel sheet with a microstructure having at least 95% by volume martensite or martensite and bainite. In each of these examples, the steel sheet may additionally be hot rolled to between 15% and 50% reduction before rapid cooling.

Referring back to FIG. 1, a hot box 15 is illustrated. As shown by FIG. 1, after the strip has formed, it may pass into an environmentally controlled box, called a hot box 15, where it continues to passively cool before being hot rolled into its final gauge through a hot rolling mill 16. The environmentally controlled box, having a protective atmosphere, is maintained until entry into the hot rolling mill 16. Within the hot box, the strip is moved on the guide table 13 to the pinch roll stand 14. In examples of the present disclosure, undesirable thermal etching may occur in the hot box 15. Based upon whether thermal etching has occurred in the hot box the strip may be hot rolled under a high friction rolling condition based upon the parameters defined in greater detail below.

In particular instances, the methods of forming a thin steel strip further include hot rolling the thin steel strip using a pair of opposing work rolls generating a heightened coefficient of friction (μ) sufficient to generate opposing hot rolled exterior side surfaces of the thin steel strip characterized as being primarily free substantially free, or free of prior austenite grain boundary depressions, and being characterized as having elongated surface structure associated with surface smear patterns formed under shear through plastic deformation. In certain instances, the pair of opposing work rolls generate a coefficient of friction (μ) equal to or greater than 0.20 0.25, 0.268, or 0.27, each with or without use of lubrication at a temperature above the $A_{r3}$ temperature. It is appreciated that the coefficient of friction may be increased by increasing the surface roughness of the surfaces of the work rolls, eliminating the use of any lubrication, reducing the amount of lubrication used, and/or electing to use a particular type of lubrication. Other mechanisms for increasing the coefficient of friction as may be known to one of ordinary skill may also be employed—additionally or separately from the mechanisms previously described. The above process is referred to herein, generally, as high friction rolling.

As mentioned above, it is appreciated that high friction rolling may be achieved by increasing the surface roughness of the surfaces of one or more of the work rolls. This is referred to herein, generally, as work roll surface texturing. The work roll surface texturing may be modified and measured by various parameters for use in a high friction rolling application. By example, the average roughness (Ra) of the profile of a work roll may provide a point of reference for generating the requisite coefficient of friction for the roll bite as noted in the examples above. To achieve high friction rolling by way of work roll surface texturing in one example newly ground and textured work rolls may have a Ra between of between 2.5 μm and 7.0 μm. Newly ground and textured work rolls are referred to herein more generally as new work rolls. In a specific example, new work roll(s) may have a Ra of between 3.18 μm and 4.0 μm. The average roughness of a new work roll may decrease during use, or upon wear. Therefore, used work roll(s) may also be relied on to produce the high friction rolling conditions noted above so long as the used work roll(s) have, in one example, a Ra of between 2.0 μm and 4.0 μm. In a specific example, used work roll(s) may have a Ra of between 1.74 μm and 3.0 μm while still achieving the high friction rolling conditions noted above.

Additionally, or alternatively, the average surface roughness depth (Rz) of the work roll profile may also be relied on as an identifier to achieve the high friction rolling conditions noted above. New work roll(s) may have a Rz of between 20 μm and 41 μm. In one specific example, new work roll(s) may have a Rz of between 21.90 μm and 28.32 μm. Used work roll(s) may be relied on for the high friction rolling conditions noted above in one example so long as they maintain a Rz of between 10 μm and 20 μm before being removed from service. In one specific example, used work roll(s) have a Rz of between 13.90 μm and 20.16 μm before being removed from service.

Still yet, the above parameters may be further defined by the average spacing between the peaks across the profile (Sm). New work rolls(s) relied on to produce the high friction rolling condition may comprise a Sm of between 90 μm and 150 μm. In one specific example, new work roll(s) relied on to produce the high friction rolling condition comprise a Sm of between 96 μm and 141 μm. Used work roll(s) may be relied on for the high friction rolling conditions noted above in one example so long as they maintain a Sm of between 115 μm and 165 μm.

Table 1, below illustrates measured test data for work roll surface texturing relied on to produce a high friction rolling condition, by position on the work roll, and further provides a comparison between the new work roll parameters and the used work roll parameters, before the used work roll is to be removed from service:

TABLE 1

| | | New Rolls | | | Used Rolls | | | Delta (Δ) | | |
|---|---|---|---|---|---|---|---|---|---|---|
| Roll | Position | Ra | Sm | Rz | Ra | Sm | Rz | Ra | Sm | Rz |
| Top Roll | OS Qtr* | 3.64 | 128 | 25.74 | 2.56 | 121 | 17.30 | | | |
| Top Roll | OS Qtr* | 3.88 | 125 | 24.44 | 3.02 | 128 | 17.64 | | | |
| Top Roll | OS Qtr* | 3.80 | 112 | 23.54 | 2.78 | 128 | 19.06 | | | |
| Top Roll | Avg OS Qtr* | 3.77 | 121.67 | 24.57 | 2.79 | 125.67 | 18.00 | 0.99 | −4.00 | 6.57 |
| Top Roll | Ctr** | 3.48 | 119 | 24.1 | 2.76 | 154 | 18.46 | | | |
| Top Roll | Ctr** | 3.44 | 112 | — | 2.36 | 134 | 17.46 | | | |
| Top Roll | Ctr** | 4.06 | 117 | 26.12 | 2.64 | 121 | 16.36 | | | |
| Top Roll | Avg Ctr** | 3.66 | 116.00 | 25.11 | 2.59 | 136.33 | 17.43 | 1.07 | −20.33 | 7.68 |
| Top Roll | DS Qtr*** | 3.46 | 121 | 25.12 | 2.44 | 150 | 17.22 | | | |
| Top Roll | DS Qtr | 3.40 | 106 | 25.46 | 3.02 | 160 | 18.00 | | | |
| Top Roll | DS Qtr | 3.62 | 129 | 25.36 | 2.84 | 151 | 20.16 | | | |
| Top Roll | Avg DS Qtr | 3.49 | 118.67 | 25.31 | 2.77 | 153.67 | 18.46 | 0.73 | −35.00 | 6.85 |
| Top Roll | Overall Avg | 3.61 | 118.83 | 29.72 | 2.45 | 140.44 | 16.94 | | | |
| Bottom Roll | OS Qtr | 3.84 | 126 | 28.32 | 2.32 | 142 | 16.44 | | | |
| Bottom Roll | OS Qtr | 3.52 | 112 | 24.44 | 2.34 | 133 | 15.94 | | | |
| Bottom Roll | OS Qtr | 3.52 | 122 | 24.28 | 2.40 | 133 | 16.34 | | | |
| Bottom Roll | Avg OS Qtr | 3.63 | 120.00 | 25.68 | 2.35 | 136 | 16.24 | 1.27 | −16.00 | 9.44 |
| Bottom Roll | Ctr | 3.18 | 96 | 21.9 | 2.34 | 153 | 15.82 | | | |
| Bottom Roll | Ctr | 3.66 | 109 | 24.68 | 2.32 | 154 | 15.64 | | | |
| Bottom Roll | Ctr | 3.84 | 127 | 25.94 | 2.06 | 141 | 13.54 | | | |
| Bottom Roll | Avg Ctr | 3.56 | 110.67 | 24.17 | 2.24 | 149.33 | 15.00 | 1.32 | −38.67 | 9.17 |
| Bottom Roll | DS Qtr | 3.34 | 112 | 25.08 | 1.92 | 145 | 20.02 | | | |
| Bottom Roll | DS Qtr | 3.30 | 125 | 22.12 | 1.74 | 115 | 12.90 | | | |
| Bottom Roll | DS Qtr | 4.00 | 141 | 26.38 | 2.30 | 165 | 16.60 | | | |
| Bottom Roll | Avg DS Qtr | 3.55 | 126.00 | 24.53 | 1.99 | 141.67 | 16.51 | 1.56 | 15.67 | 8.02 |
| Bottom Roll | Overall Avg | 3.58 | 118.89 | 24.79 | 2.19 | 142.33 | 15.92 | | | |

*"OS Qtr" is the Operator Side Quarter area; and "Avg" is Average
**"Ctr" is Center of strip; and "Avg" is Average
***"DS Qtr" is the Drive Side Quarter area; and "Avg" is Average To determine whether high friction rolling is applicable for examples of the present disclosure may be dependent upon whether thermal etching has occurred in the hot box. Thermal etching is a byproduct, or consequence, of the casting process which exposes the prior austenite grain boundary depressions at the surface of steel strip. As indicated above, the prior austenite grain boundary depressions may be susceptible to causing the above-mentioned defect phenomenon along etched prior austenite grain boundary depressions upon further acid etching. Specifically, thermal etching reveals prior austenite grain boundary depressions in a steel strip by formation of grooves in the intersections of the prior-austenite grain boundary depressions and the surface when the steel is exposed to a high temperature in an inert atmosphere, such as the hot box. These grooves make the prior austenite grain boundary depressions visible at the surface. Accordingly, examples of the present process identify high friction rolling as the step for producing the desired steel properties upon thermal etching in the hot box. Irrespective of the presence of thermal etching and evidence of prior austenite grain boundary depressions, high friction rolling may be provided to increase recrystallization of the thin steel strip.

Figure 5:
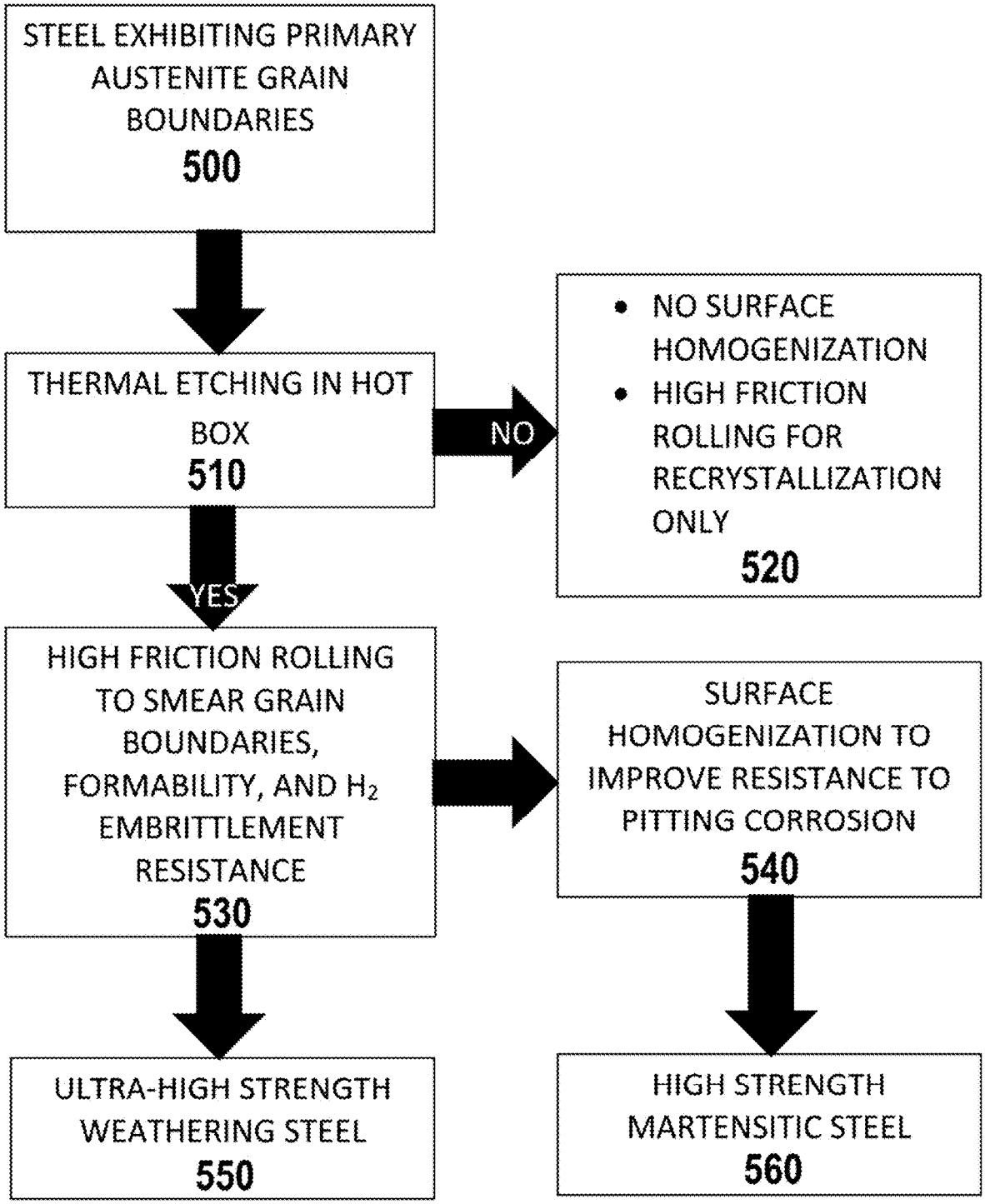
FIG. 5 is a flow diagram of processes according to one or more aspects of the present disclosure.

FIG. 5 is a flow diagram illustrating the process for applying high friction rolling and/or surface homogenization. In the present examples, to determine whether the steel strip or steel product is to undergo high friction rolling is dependent upon whether undesirable thermal etching has occurred in the hot box 510. If thermal etching has not occurred in the hot box high friction rolling is not necessary and is not undertaken to (1) smear the prior austenite grain boundary depressions, (2) increase formability of the steel product such as, for example, in an ultra-high strength weathering steel, and/or (3) improve hydrogen ($H_2$) embrittlement resistance. However, high friction rolling may still be pursued to achieve recrystallization 520 or to produce a microstructure as otherwise disclosed herein even if thermal etching has not occurred in the hot box. If thermal etching has occurred in the hot box 510 high friction rolling is performed 530 to (1) smear the prior austenite grain boundary depressions, (2) increase formability of a ultra-high strength weathering steel, and/or (3) improve hydrogen ($H_2$) embrittlement resistance by removing the prior austenite grain boundary depressions and eliminating weak spots which form as defects following a 120 hour corrosion test. In one example of the present disclosure, an ultra-high strength weathering steel 550, with a smear pattern, is produced. In another embodiment of the present disclosure, the smear pattern is removed, thereby improving resistance to pitting corrosion 540, such as that which is required in automotive applications. Such an embodiment produces, by example, a high strength martensitic steel 560. The smear pattern may be removed by way of a surface homogenization process. FIG. 5 additionally illustrates a surface homogenization process 540. Applicability of the surface homogenization process is discussed in greater detail below with respect to the present disclosure. Representative examples are also discussed in greater detail below.

Ultra-High Strength Weathering Steel

In some embodiments, a light-gauge, ultra-high strength weathering steel sheet may be made from a molten melt. The molten melt may be processed through a twin roll caster. In one example, the light-gauge, ultra-high strength weathering steel sheet may be made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ producing a steel sheet less than 2.5 mm in thickness and cooling in a non-oxidizing atmosphere to below 1080° C. and above $Ar_3$ temperature at a cooling rate greater than 15° C./s before rapidly cooling and/or before hot rolling, when hot rolled; and (c) rapidly cooling to form a steel sheet with a microstructure having at least 75% by volume martensite or martensite plus bainite, a yield strength of between 700 and 1600 MPa, a tensile strength of between 1000 and 2100 MPa and an elongation of between 1% and 10%. In one example, the light-gauge, ultra-high strength weathering steel sheet may also be hot rolled to between 15% and 50% reduction before rapid cooling. The sheet may be cooled in a non-oxidizing atmosphere to below 1100° C. and above $Ar_3$ temperature at a cooling rate greater than 15° C./s before rapidly cooling and/or before hot rolling, when hot rolled. The $Ar_3$ temperature is the temperature at which austenite begins to transform to ferrite during cooling. In other words, the $Ar_3$ temperature is the point of austenite transformation. In each example, the nickel shifts the peritectic point away from the carbon region and/or increases a transition temperature of the peritectic point of the composition of the steel sheet to provide a steel sheet that is defect free. The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

Figure 4:
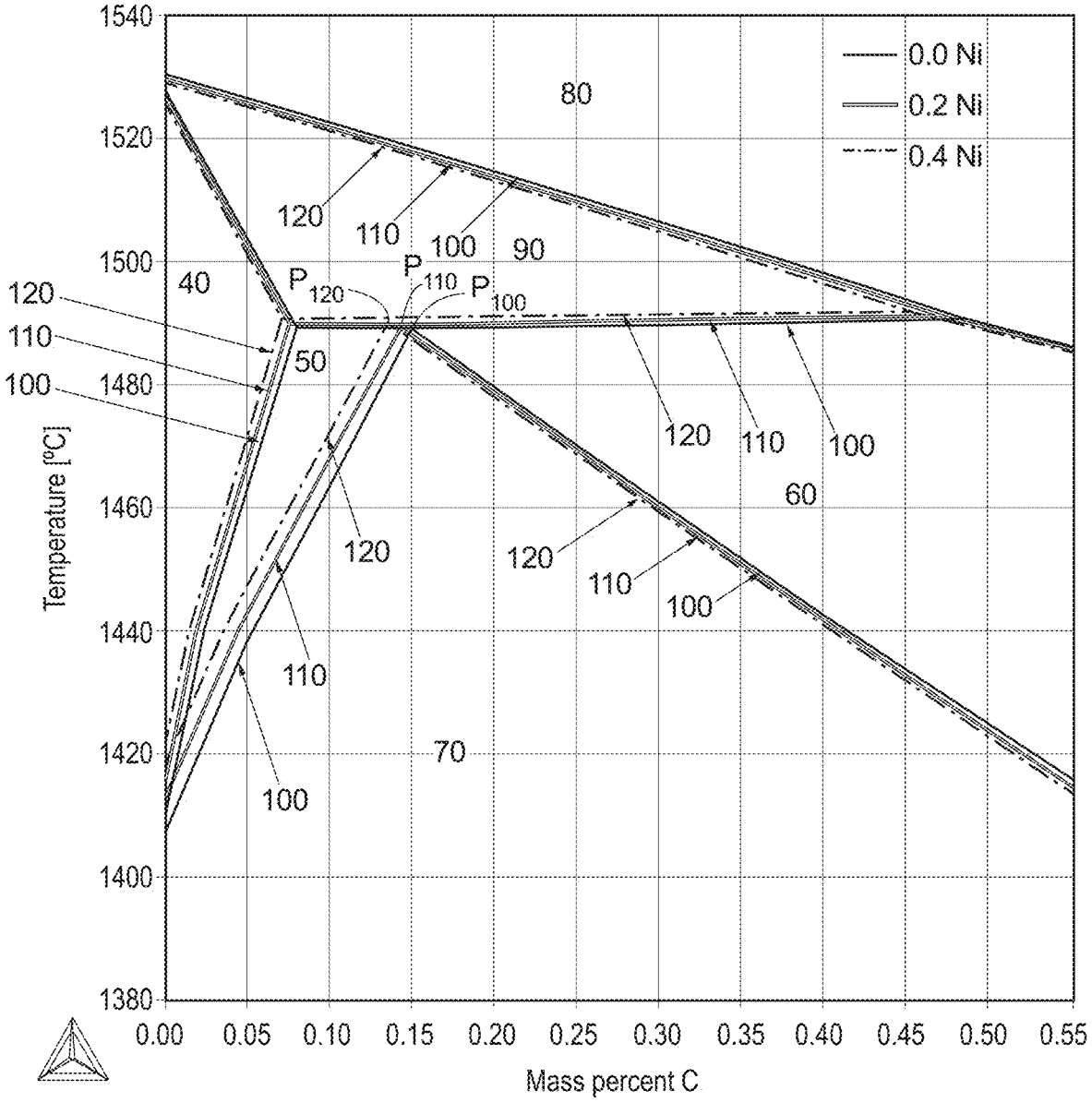
FIG. 4 is a phase diagram illustrating the effect of nickel to shift the peritectic point away from the carbon region.

The present steel sheet examples provide an addition of nickel to further prevent peritectic cracking while maintaining or improving hardenability. In particular, between 0.5% and 1.5%, by weight, nickel is added. The addition of nickel is believed to prevent the strip shell from buckling caused by the volume change in the peritectic region during phase transformation on the casting rolls and therefore enhances the even heat transfer during the strip solidification. It is believed that the addition of nickel shifts the peritectic point away from the carbon region and/or increases the transition temperature of the peritectic point of the composition to form a steel sheet that is defect free. The phase diagram of FIG. 4 illustrates this. In particular, the phase diagram of FIG. 4 illustrates the impact of each of 0.0%, by weight, nickel 100, 0.2%, by weight, nickel 110, and 0.4%, by weight, nickel 120. As illustrated by FIG. 4, the peritectic points $P_{100}$, $P_{110}$, and $P_{120}$, found at the intersection of the liquid+delta phase 90, the delta+gamma phase 50, and the liquid+gamma phase 60, is shifting a lower mass percent carbon (C) to a higher temperature as nickel is increased. The carbon content, otherwise, makes the steel strip susceptible to defects at lower temperatures in a steel strip having high yield strengths. The addition of nickel shifts the peritectic point away from the carbon region and/or increases the transition temperature of the peritectic point of the steel sheet to provide a defect free martensitic steel strip with high yield strengths.

The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

Table 2, below, shows several compositional examples of a light-gauge, ultra-high strength weathering steel sheet of the present disclosure.

TABLE 2

| Example | | No. 1 | No. 2 | No. 3 | No. 4 |
|---|---|---|---|---|---|
| % Weight | C | 0.2272 | 0.2212 | 0.2835 | 0.2733 |
| | Mn | 0.91 | 0.94 | 0.91 | 1 |
| | Si | 0.22 | 0.2 | 0.21 | 0.2 |
| | S | 0.001 | 0.0006 | 0.0011 | 0.0018 |
| | P | 0.015 | 0.011 | 0.011 | 0.014 |
| | Cu | 0.34 | 0.16 | 0.19 | 0.32 |
| | Cr | 0.25 | 0.15 | 0.15 | 0.18 |
| | Ni | 0.66 | 0.75 | 1.01 | 0.78 |
| | V | 0.004 | 0.003 | 0.002 | 0.005 |
| | Nb | 0.002 | 0.002 | 0 | 0.004 |
| | Ca | 0 | 0.0001 | 0.0004 | 0 |
| | Al | 0.00008 | 0.0003 | 0.0016 | 0.0021 |
| | LecoN | 0.0066 | 0.0029 | 0.0039 | 0.0048 |
| | CEAWS | 0.54 | 0.507 | 0.585 | 0.592 |
| Mn/S | | 910 | 1567 | 827 | 556 |
| Mn/Si | | 4.1 | 4.7 | 4.3 | 5 |
| Corrosion index | | 6.71 | 6.01 | 6.84 | 6.77 |

In Table 2, LecoN is the measured, percent by weight, nitrogen ($N_2$) and CEAWS is the measured, percent by weight, carbon equivalent (CE).

Other elements relied on for hardenability produce the opposite effect by shifting the peritectic point closer the carbon region. Such elements include chromium and molybdenum which are relied on to increase hardenability but ultimately result in peritectic cracking. Through the addition of nickel, hardenability is improved and peritectic cracking is reduced to provide a fully quenched martensitic grade steel strip with high strength.

In the present compositions the addition of nickel may be combined with limited amounts of chromium and/or molybdenum, as described herein. As a result, nickel reduces any impact these hardening elements may have to produce peritectic cracking. In one example, however, the additional nickel would not be combined with a purposeful addition of boron. A purposeful addition is 5 ppm of boron, or more. In other words, in one example the addition of nickel would be used in combination with substantially no boron, or less than 5 ppm boron. Additionally, the light-gauge, ultra-high strength weathering steel sheet may be made by the further tempering the steel sheet at a temperature between 150° C. and 250° C. for between 2 and 6 hours. Tempering the steel sheet provides improved elongation with minimal loss in strength. For example, a steel sheet having a yield strength of 1250 MPa, tensile strength of 1600 MPa and an elongation of 2% was improved to a yield strength of 1250 MPa, tensile strength of 1525 MPa and an elongation of 5% following tempering as described herein.

The light-gauge, ultra-high strength weathering steel sheet may be silicon killed containing by weight less than 0.008% aluminum or less than 0.006% aluminum. The molten melt may have a free oxygen content between 5 to 70 ppm or between 5 to 60 ppm. The steel sheet may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel sheet less than 2.5 mm in thickness, and cooled in a non-oxidizing atmosphere to below 1080° C. and above $Ar_3$ temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel sheet may form from an austenite grain size of greater than 100 μm. In other embodiments, the martensite in the steel sheet may form from an austenite grain size of greater than 150 μm. Rapid solidification at heat fluxes greater than 10 $MW/m^2$ enables the production of an austenite grain size that is responsive to controlled cooling to enable the production of a defect free sheet.

The steel sheet additionally may be hot rolled to between 15% and 50% reduction and, thereafter, rapidly cooled to form a steel sheet with a microstructure having at least 75% martensite plus bainite, a yield strength of between 700 and 1600 MPa, a tensile strength of between 1000 and 2100 MPa and an elongation of between 1% and 10%. Further, the steel sheet may be hot rolled to between 15% and 35% reduction and, thereafter, rapidly cooled to form a steel sheet with a microstructure having at least 75% martensite plus bainite, a yield strength of between 700 and 1600 MPa, a tensile strength of between 1000 and 2100 MPa and an elongation of between 1% and 10%. In one example, the steel sheet is hot rolled to between 15% and 50% reduction and, thereafter, rapidly cooled to form a steel sheet with a microstructure having at least 90% by volume martensite or martensite and bainite. In still yet another example, the steel sheet is hot rolled to between 15% and 50% reduction and, thereafter, rapidly cooled to form a steel sheet with a microstructure having at least 95% by volume martensite or martensite and bainite.

Many products may be produced from the light-gauge, ultra-high strength weathering ("UHSW") steel sheet of the type described herein. One example of a product that may be produced from a light-gauge, ultra-high strength weathering steel sheet includes a steel pile. More specifically, piles, or foundations, for solar arrangements, are examples of uses for a product produced from the light-gauge, ultra-high strength weathering steel sheet. As used herein, a solar arrangement is a structure for supporting solar cells, such as on a solar farm of photovoltaic power stations designed for the supply of solar power for use in an electric grid. The highway industry has similar demand for foundations such as, for example, to support guardrails, signage, or the like. The pile or steel foundation may be produced from a thin cast steel strip that has been cold roll formed using one or more roll stands. Additionally, a punch system, a CNC plasma system, and/or a roll system, or the like, may also be relied on to provide thru-holes, slots, continuous welds, partial welds, and/or spot welds, as noted below.

Figure 10:
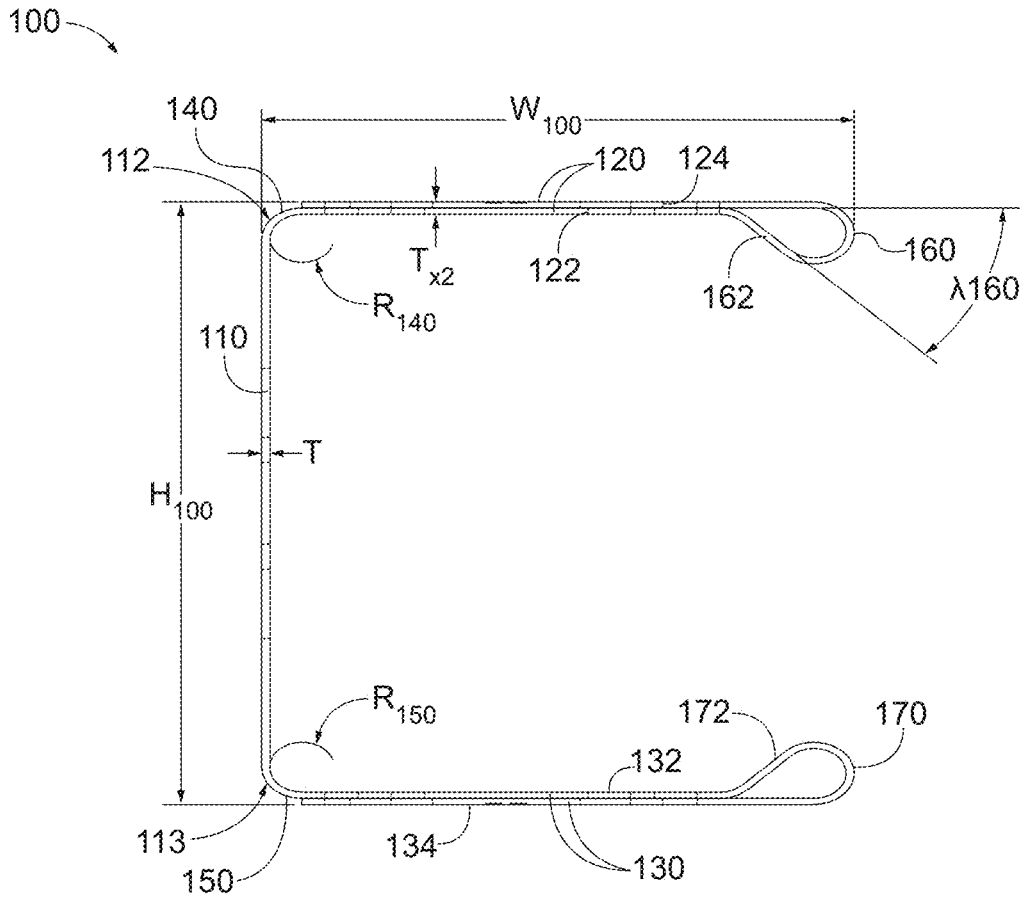
FIG. 10 is a cross-section of a hemmed C-channel shape of a pile or steel foundation cold roll formed from a thin cast steel strip according to one or more aspects of the present disclosure.

In one example, a steel pile comprises a web and one or more flanges cold roll formed from the carbon alloy steel strip of the varieties described above. FIGS. 10, 12-15, 22, 24, and 26 illustrate cross-sectional examples of UHSW steel piles cold roll formed from a thin cast steel strip. In FIG. 10, the UHSW steel pile 100 is a C-channel comprising a web 110, a first flange 120, and a second flange 130 and is an exemplary example referred to herein as a hemmed C-channel, or NXW pile. The web 110 extends a height $H_{100}$ of the steel pile 100 and transitions at a curved transition 140 into the first flange 120 at a first end 112 of the web 100. The web 110 additionally transitions at a curved transition 150 into the second flange 130 at a second end 113 of the web 110, opposite the first end 112 of the web 110. In the present example, each curved transition 140, 150 has a respective radius $R_{140}$, $R_{150}$, each forming an arc extending 90 degrees. Accordingly, each flange 120, 130 is perpendicular to the web 110. In FIG. 10, the first flange 120 is parallel to and opposite of the second flange 130. Both the first flange 120 and the second flange 130 extend a width $W_{100}$ of the steel pile 100 from the web 110 and in the same direction.

In FIG. 10, the first flange 120 and the second flange 130 comprise a hem structure. Referring specifically to the first flange 120, the hem structure is a single hem comprising a first layer 122 and a second layer 124 where the first layer 122 extends from the curved transition 140 in a direction of the width $W_{100}$ of the steel pile 100 to a teardrop transition 160. The teardrop transition 160 is an open hem that transitions to a closed hem. The teardrop transition 160 advances inwardly of the steel pile 100 in a direction of both the width $W_{100}$ and the height $H_{100}$ of the steel pile toward the opposing second flange 130. In one specific example, the first layer 122 advances into a first leg 162 of the teardrop transition 160 at an angle $\lambda_{160}$ of 45 degrees, relative the direction of steel pile width $W_{100}$. From the first leg 162, the teardrop transition 160 advances through an arc to the second layer 124. The second layer 124 is positioned to an exterior side of the first layer 122 at a closed hem. The second layer 124 abuts the first layer 122 and travels parallel with the first layer 122. In FIG. 10, the second layer 124 extends the steel pile width $W_{100}$ to the curved transition 140. Additionally, the teardrop transition 160 is maintained within the steel pile height $H_{100}$, as defined by the hem sections of each respective first flange 120 and second flange 130.

Still referring to FIG. 10, and similar to, but opposite of, the first flange 120, the second flange 130 comprises a hem structure. The hem structure of the second flange comprises a first layer 132 and a second layer 134 where the first layer 132 extends from the curved transition 150 in a direction of the width $W_{100}$ of the steel pile 100 to a teardrop transition 170. The teardrop transition 170 is an open hem that transitions to a closed hem as follows. The teardrop transition 170 advances inwardly of the steel pile 100 in a direction of both the width $W_{100}$ and the height $H_{100}$ of the steel pile toward the opposing first flange 120. In one specific example, the first layer 132 advances into a first leg 172 of the teardrop transition 170 at an angle of 45 degrees relative the direction of the steel pile width $W_{100}$. From the first leg 172, the teardrop transition 170 advances through an arc to the second layer 134. The second layer 134 is positioned to an exterior side of the first layer 132 at a closed hem. The second layer 134 abuts the first layer 132 and travels parallel with the first layer. In FIG. 10, the second layer 134 extends the steel pile width $W_{100}$ to the curved transition 150. The teardrop transition 170 is maintained within the steel pile height $H_{100}$, as defined by the hem sections of each respective first flange 120 and second flange 130. In the example of FIG. 10, the thickness T of the steel sheet, forming the steel pile 100, is 0.062 inches (") (1.575 mm). Thereby, the hem sections is 0.124" (3.15 mm). In some examples, the thickness of the steel sheet, forming the steel pile 100, may be 2 mm or less. In other examples, the thickness of the steel sheet, forming the steel pile 100, may be 2.5 mm or less.

Figure 11:
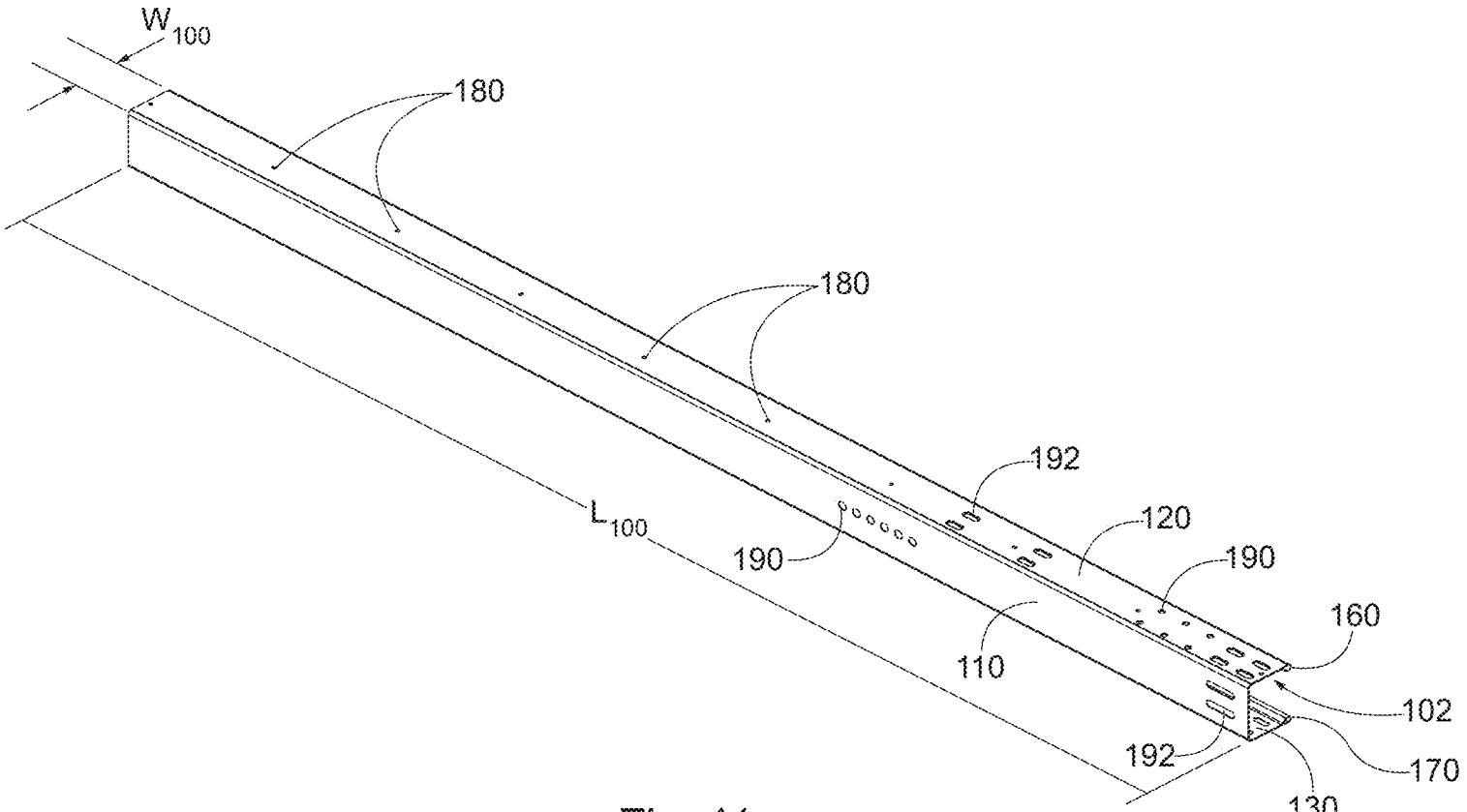
FIG. 11 is a perspective view of the pile or steel foundation of FIG. 10 as cold roll formed from a thin cast steel strip according to one or more aspects of the present disclosure.

FIG. 11 illustrates a perspective view of the steel pile 100 of FIG. 10 at the first flange 120. The steel pile 100 has a length $L_{100}$ where the web 110, first flange 120, and the second flange 130 extend the steel pile length $L_{100}$. One or more spot welds 180 may be provided at the first flange 120 and the second flange 130 to maintain the first layer 122, 132 in abutting relationship with the second layer 124, 134, respectively (as illustrated by FIG. 10). The spot welds 180 may be spaced between 6" to 24" apart along the steel pile length $L_{100}$. The spot welds 180 may also be centered relative the steel pile width $W_{100}$ or offset relative the steel pile width $W_{100}$. Further, the spot welds 180 may be consistently spaced or the spot weld 180 spacing may be variable along the steel pile length $L_{100}$. In one example, a first spot weld is 0.50" from a first end 102 of the steel pile and be spaced evenly at 13.22" apart along the remaining steel pile length $L_{100}$. The spot welds 180 may also be centered relative the steel pile width $W_{100}$ or offset relative the steel pile width $W_{100}$, or a combination thereof. In one example, the spot welds are positioned 2.68" from the outermost tangent of a respective teardrop transition 160, 170.

Still referring to FIG. 11, the first flange 120 and/or the second flange 130 may additionally comprise one or more thru-holes 190 and/or one or more slots 192. The thru-holes 190 and the slots 192 may be provided for securing items to the steel pile such as, for example, a solar arrangement, highway barriers, or the like. One or more thru-holes 190 and/or one or more slots 192 may additionally, or alternatively, be provided in the web 110. This perspective view is also representative of a perspective view of the steel pile profiles of FIGS. 12-15.

In the UHSW steel pile 100 example of FIGS. 10-11 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the C-channel of FIG. 11 is produced from the width of the steel sheet and, thereby, has a total cross-sectional material length of 50" or less. More specifically, the total cross-sectional material length may be half or a third of the width of the steel sheet. At the hemmed flanges the material thickness T is maintained at each layer. However, by abutting the first layer 122, 132 and the second layer 124, 134, and although the material thickness is maintained as T, the flange thickness has doubled as reflected by $T_{X2}$ in FIG. 10. In FIG. 10 the doubled flange thickness $T_{X2}$ extends from the teardrop transition 160 to the curved transition 140. In the example of FIG. 10, the height $H_{100}$ of the steel pile is greater than the width $W_{100}$ of the steel pile. In the example of FIG. 10, the steel pile 100 is symmetrical about an axis bisecting the height $H_{100}$ of the steel pile 100. A typical UHSW steel pile of FIG. 10 may be, for example, a 6×4, 6×6, 8×4.5, 8×5, 8×6, 8×8, 10×8, 10×10, 12×8, 12×10, 12×12, 14×10, 14×12, 14×14 (in inches) C-channel (with or without corrugations), and anything in between or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 12:
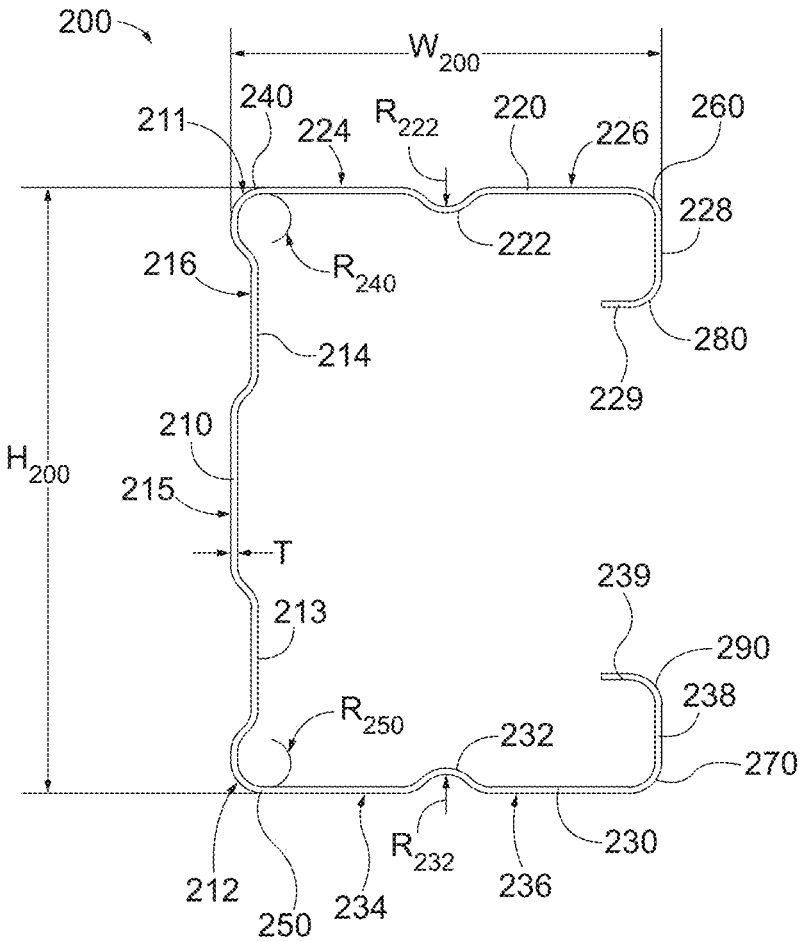
FIG. 12 is a cross-section of a corrugated C-channel shape of a pile or steel foundation cold roll formed from a thin cast steel strip according to one or more aspects of the present disclosure.

Turning now to FIG. 12, a C-channel UHSW steel pile 200 is illustrated. The C-channel comprises a web 210, a first flange 220, and a second flange 230 and is an exemplary example referred to herein as a corrugated C-channel, or NCW pile. The web 210 extends a height $H_{200}$ of the steel pile 200 and transitions at a curved transition 240 into the first flange 220 at a first end 211. The web 210 also transitions at a curved transition 250 into the second flange 230 at a second end 212. In the present example, each curved transition 240, 250 has a respective radius $R_{240}$, $R_{250}$. Each radius $R_{240}$, $R_{250}$ forms an arc greater than 90 degrees. Still, each flange 220, 230 remains generally perpendicular to the web 210. The web 210 further comprises one or more web corrugations. In FIG. 12, The web 210 comprises a first web corrugation 213 and a second web corrugation 214. To form the web corrugations, an outside surface 215 of the web 210 is offset from one or more inside surfaces 216 of the web 210, in a direction of the steel pile width $W_{200}$. Both the outside surface 215 and each inside surface 216 extend in a direction of the steel pile height $H_{200}$ where the outside surface 215 and each inside surface 216 are perpendicular to the first flange 220 and/or the second flange 230. The outside surface 215 and each inside surface 216 form the majority of the web 200 such that the web is referred to as remaining generally perpendicular to the first flange 220 and/or the second flange 230. Each curved transition 240, 250 extends from a respective first flange 220 or second flange 230 along the arc formed by the radius $R_{240}$, $R_{250}$, respectively. As noted above, the arc of each curved transition 240, 250 extends greater than 90 degrees to form the web corrugation at a respective inside surface 216 which then transitions to the outside surface 215. The outside surface 215 is centrally positioned on the web 210, relative the steel pile height $H_{200}$. In FIG. 12, the arc formed by radius $R_{240}$ and the arc formed by radius $R_{250}$ each further comprise a tangent that is aligned with the outside surface 215 in the direction of the steel pile height $H_{200}$.

The web corrugations 213, 214 of the UHSW steel pile of FIG. 12 each comprise a surface which is perpendicular to the first flange 220 and the second flange 230. From each respective curved transition 240, 250 the web 210 is recessed, forming the two web corrugations 213, 214. Each web corrugation then returns to full width $W_{200}$ and is connected by the outside surface 215 of the web 210. In contrast, and as illustrated by the flange corrugations 222, 232, below, the corrugation may be entirely formed by an arc.

Still referring to FIG. 12, the first flange 220 may also comprise one or more corrugations. In the example of FIG. 12, the first flange 220 comprises one flange corrugation 222 formed centrally along the steel pile width $W_{200}$. The flange corrugation 222 is an arc formed by a radius $R_{222}$ extending inwardly from between first outside surface 224 and a second outside surface 226 of the flange 220. Opposite the web 210, a first lip 228 extends from the first flange 220 at a curved transition 260. The first lip extends in a direction of the steel pile height $H_{200}$ and is parallel to the inside surface 216 and outside surface 215 of the web 210. The first lip 228 may further comprise a curved transition 280 into a return section 229. The return section 229 extends inwardly from the first lip 228 toward the web 210. The return section 229 is parallel with the first outside surface 224 and the second outside surface 226 of the flange 220.

Like the first flange 220, the second flange 230 may also comprise one or more corrugations. In the example of FIG. 12, the second flange 230 comprises one flange corrugation 232 formed centrally along the steel pile width $W_{200}$. The flange corrugation 232 is an arc formed by a radius $R_{232}$ extending inwardly from between first outside surface 234 and a second outside surface 236 of the flange 230. Opposite the web 210, a second lip 238 extends from the second flange 230 at a curved transition 270. The second lip extends in a direction of the steel pile height $H_{200}$ and is parallel to the inside surface 216 and outside surface 215 of the web 210. The second lip 228 may further comprise a curved transition 290 into a return section 239. The return section 239 extends inwardly from the lip 228 toward the web 210. The return section 239 is parallel with the first outside surface 234 and the second outside surface 236 of the second flange 230. In the example of FIG. 12, the thickness T of the steel sheet, forming the steel pile 200, is 0.062 inches (") (1.575 mm). In some examples, the thickness of the steel sheet, forming the steel pile 200, may be 2 mm or less. In other examples, the thickness of the steel sheet, forming the steel pile 200, may be 2.5 mm or less. The first flange 220 and/or the second flange 230 of the UHSW steel pile 200 of FIG. 12 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 210.

In the UHSW steel pile 200 example of FIG. 12 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the C-channel of FIG. 11 is produced from the width of the steel sheet and, thereby, has a total cross-sectional material length of 50" or less. More specifically, the total cross-sectional material length may be half or a third of the width of the steel sheet. At the corrugations, the material thickness T is maintained at each layer and transition. In the example of FIG. 12, the height $H_{200}$ of the steel pile is greater than the width $W_{200}$ of the steel pile. In the example of FIG. 12, the steel pile 200 is symmetrical about an axis bisecting the height $H_{200}$ of the steel pile 200. A typical UHSW steel pile of FIG. 12 may be, for example, a 6×4, 6×6, 8×4.5, 8×5, 8×6, 8×8, 10×8, 10×10, 12×8 12×10, 12×12, 14×10, 14×12, 14×14 (in inches) C-channel (with or without corrugations), and anything in between or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 13:
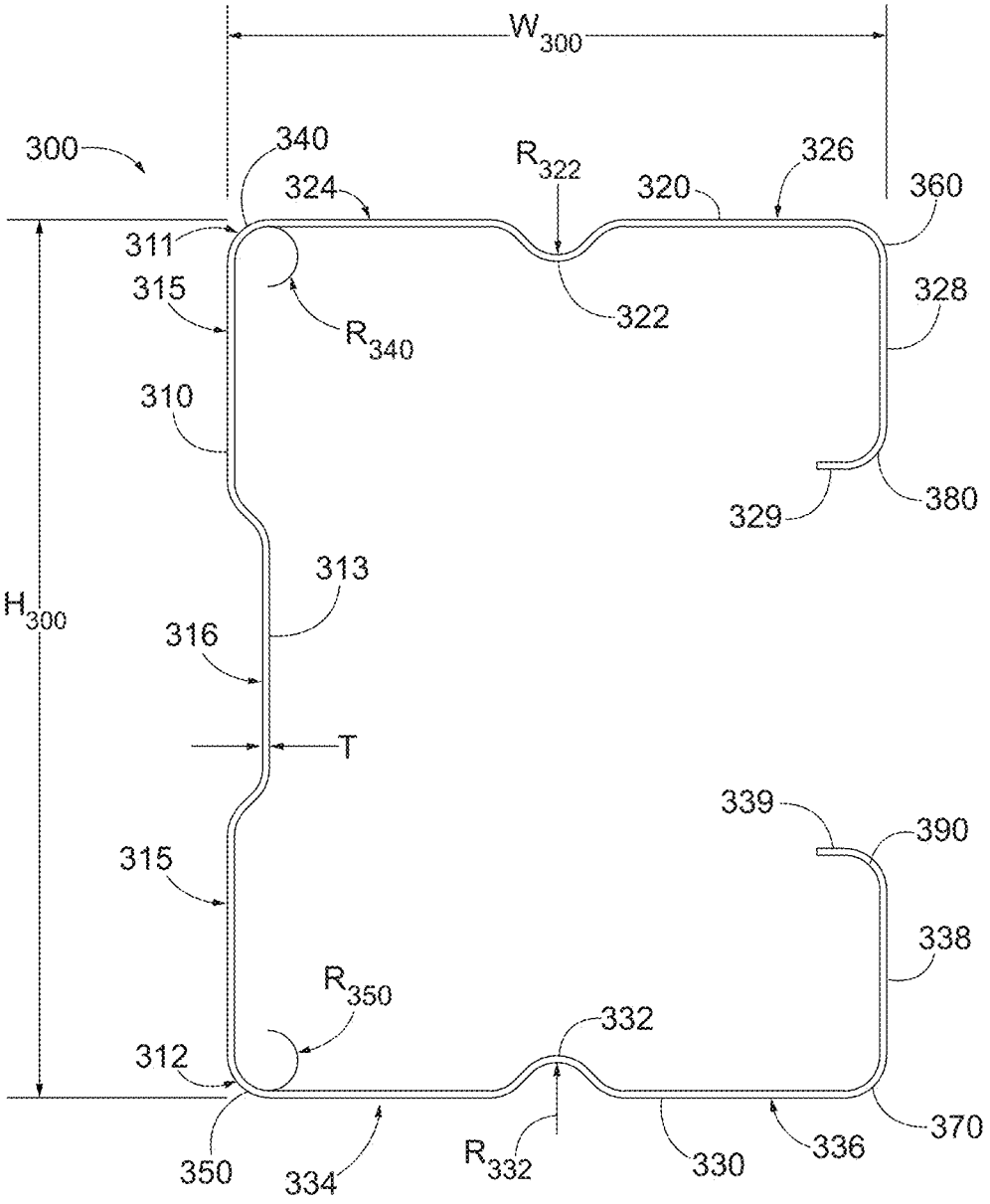
FIG. 13 is a cross-section of a corrugated C-channel shape of a pile or steel foundation cold roll formed from a thin cast steel strip according to one or more aspects of the present disclosure.

Turning now to FIG. 13, a UHSW steel pile 300 that is a C-channel comprising a web 310, a first flange 320, and a second flange 330 is illustrated and is another example of a corrugated C-channel, or NCW pile. Like the steel pile of FIG. 12, the web 310 of the steel pile 300 of FIG. 13 extends a height $H_{300}$ of the steel pile 300 and transitions at a curved transition 340 into the first flange 320 at a first end 311. The web 310 also transitions at a curved transition 350 into the second flange 330 at a second end 312. Each curved transition 340, 350 has a radius $R_{340}$, $R_{350}$, respectively. In FIG. 13, the web 310 comprises a single web corrugation 313. The single web corrugation 313 is centrally positioned relative the steel pile height $H_{300}$. This is in contrast to FIG. 12 where the web 210 comprises a first web corrugation 213 and a second web corrugation 214. To form the web corrugation of FIG. 13, an outside surface 315 of the web 310 is offset from an inside surface 316 of the web 310, in a direction of the steel pile width $W_{300}$. Both the outside surface 315 and the inside surface 316 extend in a direction of the steel pile height $H_{300}$ where the outside surface 315 and the inside surface 316 are perpendicular to the first flange 320 and/or the second flange 330. The outside surface 315 and each inside surface 316 form the majority of the web 300 such that the web is referred to as remaining generally perpendicular to the first flange 320 and/or the second flange 330. Each curved transition 340, 350 extends from a respective first flange 320 or second flange 330 along the arc formed by the radii $R_{340}$, $R_{350}$, respectively. Also. in contrast to FIG. 12, the arc of the curved transition 340, 350 of FIG. 13 only extend 90 degrees since the single web corrugation 313 is centrally positioned on the web 310 and are independent of the curved transitions 340, 350.

The single web corrugations 313 of the UHSW steel pile of FIG. 13 comprises an inside surface 316 which is perpendicular to the first flange 320 and the second flange 330. The inside surface 316 may additionally, or alternatively, be referred to as being recessed, relative the web 310, or the outside surface 315 of the web 310. In contrast, and as illustrated by the flange corrugations 322, 332, below, the corrugation may be entirely formed by an arc.

Still referring to FIG. 13, the first flange 320 may also comprise one or more corrugations. In the example of FIG. 13, the first flange 320 comprises one flange corrugation 322 formed centrally along the steel pile width $W_{300}$. The flange corrugation 322 is an arc formed by a radius $R_{322}$ extending inwardly from between a first outside surface 324 and a second outside surface 326 of the flange 320. Opposite the web 310, a first lip 328 extends from the first flange 320 at a curved transition 360. The first lip extends in a direction of the steel pile height $H_{300}$ and is parallel to the inside surface 316 and outside surface 315 of the web 310. The first lip 328 may further comprise a curved transition 380 into a return section 329. The return section 329 extends inwardly from the first lip 328 toward the web 310. The return section 329 is parallel to the first outside surface 324 and the second outside surface 326 of the flange 320.

Like the first flange 320, the second flange 330 may also comprise one or more corrugations. In the example of FIG.

13, the second flange 330 comprises one flange corrugation 332 formed centrally along the steel pile width $W_{300}$. The flange corrugation 332 is an arc formed by a radius $R_{332}$ extending inwardly from between first outside surface 334 and a second outside surface 336 of the flange 330. Opposite the web 310, a second lip 338 extends from the second flange 330 at a curved transition 370. The second lip extends in a direction of the steel pile height $H_{300}$ and is parallel to the inside surface 316 and outside surface 315 of the web 310. The second lip 328 may further comprise a curved transition 390 into a return section 339. The return section 339 extends inwardly from the lip 328 toward the web 310. The return section 339 is parallel to the first outside surface 334 and the second outside surface 336 of the second flange 330. In the example of FIG. 13, the thickness T of the steel sheet forming the steel pile 300 is 0.062 inches (") (1.575 mm). In some examples, the thickness of the steel sheet forming the steel pile 300 may be 2 mm or less. In other examples, the thickness of the steel sheet forming the steel pile 300 may be 2.5 mm or less. The first flange 320 and/or the second flange 330 of the UHSW steel pile 300 of FIG. 13 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 310.

In the UHSW steel pile 300 example of FIG. 13 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the C-channel of FIG. 11 is produced from the width of the steel sheet and, thereby, has a total cross-sectional material length of 50" or less. More specifically, the total cross-sectional material length may be half or a third of the width of the steel sheet. At the corrugations, the material thickness T is maintained at each layer and transition. In the example of FIG. 13, the height $H_{300}$ of the steel pile is greater than the width $W_{300}$ of the steel pile. In the example of FIG. 13, the steel pile 300 is symmetrical about an axis bisecting the height $H_{300}$ of the steel pile 300. A typical UHSW steel pile of FIG. 13 may be, for example, a 6×4, 8×4.5, 8×5, 8×6, 10×8, 12×8 12×10, 14×10, 14×12 (in inches) C-channel (with or without corrugations), or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 14:
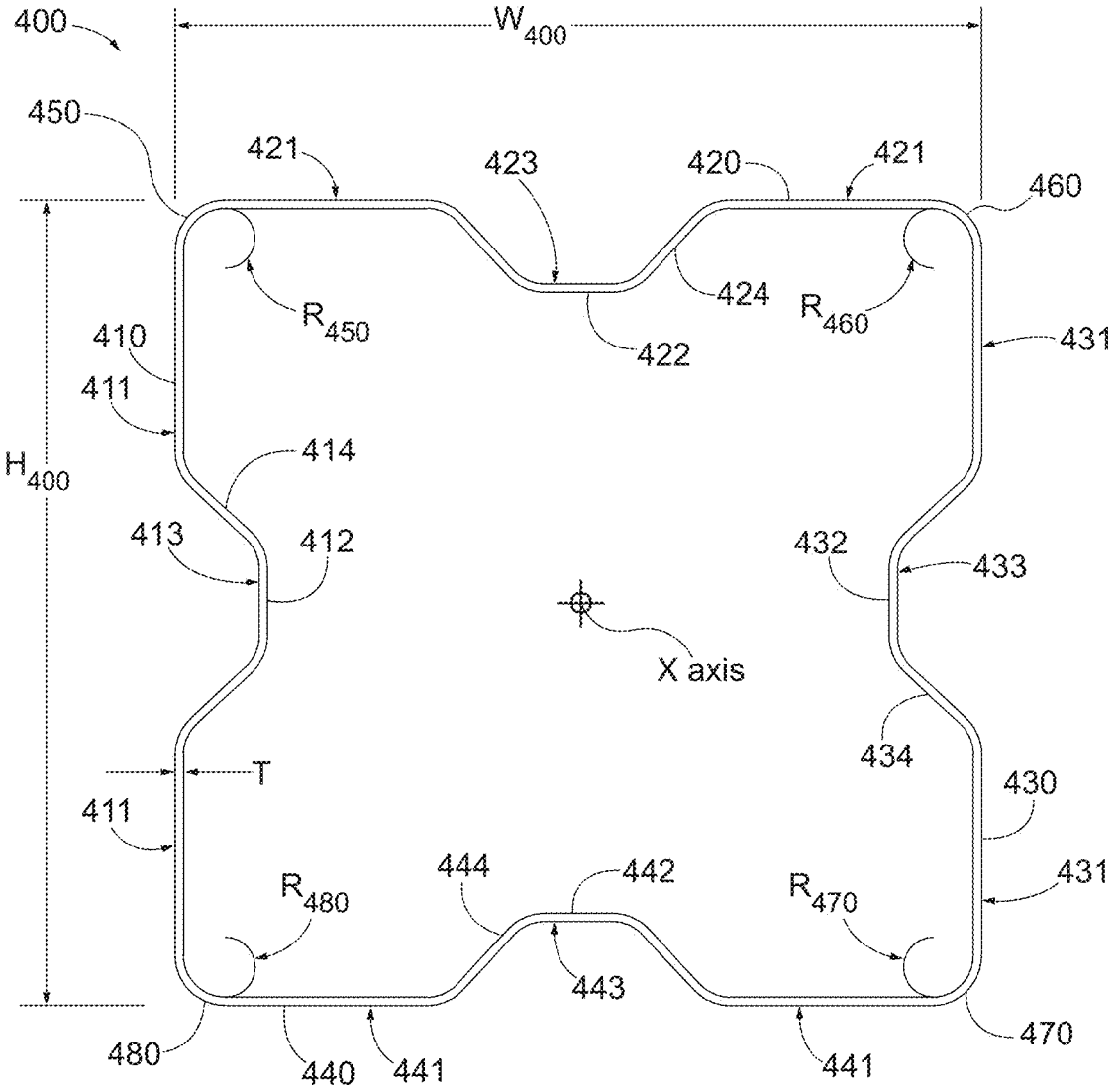
FIG. 14 is a cross-section of a square tube with stiffening members of a steel pile or steel foundation cold roll formed from a thin cast steel strip according to one or more aspects of the present disclosure.

Turning now to FIG. 14, a UHSW steel pile 400 having a tubular cross-section is illustrated. The steel pile 400 of FIG. 14 is square. The steel pile 400 comprises a first sidewall 410, a second sidewall 420, a third sidewall 430, and a fourth sidewall 440. The first sidewall 410 is generally parallel with the third sidewall 430. The second sidewall 420 is generally parallel with the fourth sidewall 440. Moreover, the first sidewall 410 and the third sidewall 430 are generally perpendicular to the second sidewall 420 and the fourth sidewall 440. As used in the present context, "generally" refers to the sidewall arrangement with the exceptions of the corrugations, as further described below. The height $H_{400}$ and the width $W_{400}$ steel pile 400 of FIG. 14 are the same, forming a cross-section that is generally square. Again, as used in the present context, "generally" refers to the wall arrangement with the exceptions of the corrugations. In other words, the general dimension of each sidewall of the steel pile 400, in cross-section, are the same. A curved transition is provided between each sidewall. More specifically, a first curved transition 450 is provided between the first sidewall 410 and the second sidewall 420; a second curved transition 460 is provide between the second sidewall 420 and the third sidewall 430; a third curved transition 470 is provided between the third sidewall 430 and the fourth sidewall 440; and a fourth curved transition 470 is provided between the fourth sidewall 440 and the first sidewall 410. Each curved transition 450, 460, 470, and 480 is an arc formed by respective radii $R_{450}$, $R_{460}$, $R_{470}$, and $R_{480}$.

One or more of the sidewalls of steel pile 400 of FIG. 14 may each comprise one or more corrugations. In the example of FIG. 14, each sidewall 410, 420, 430, 440 comprises one corrugation 412, 422, 432, 442, respectively. In FIG. 14 each sidewall and corrugation are of the same arrangement and size. Thereby, the cross-section of FIG. 14 is symmetrical along any plane extending the longitudinal axis $X_{axis}$. Like the web corrugations of FIGS. 12-13, each corrugation 412, 422, 432, 442 comprises an inside surface 413, 423, 433, 443, respectively, which is offset from and parallel to the outside surfaces 411, 421, 431, 441 of a sidewall 410, 420, 430, 440, respectively. In the example of FIG. 14, oblique sidewalls 480 are provided to transition from the inside surface to the outside surface. In FIG. 14, each inside surface comprises opposing oblique sidewalls 414, 424, 434, 444. An arc may be provided to transition between each surface, between each surface and an oblique sidewall, or the like. As noted above, the corrugation serves as a stiffener of the steel pile. In FIG. 14, each corrugation 412, 422, 432, 442 extends inwardly. In other examples, the corrugations may each extend outwardly, alternate, or form opposing halves. In some examples, one or more of the sidewalls may comprise multiple corrugations such as, for example, the web corrugations of FIG. 10. Additionally, or alternatively, the corrugation may be entirely formed by an arc, such as the flange corrugations as illustrated by FIGS. 12-13. The corrugations may be a combination of the corrugations described with respect to FIG. 14 and corrugations formed entirely by an arc.

In the UHSW steel pile 400 example of FIG. 14 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the tube of FIG. 14 is produced from the width of the steel sheet and, thereby, has a total cross-sectional material length of 50" or less. More specifically, the total cross-sectional material length may be half or a third of the width of the steel sheet. Moreover, a weld, rivet, overlap and/or joint may be provided to close the tubular steel pile of FIG. 14 when formed from a steel sheet. The welds may be a continuous weld, partial welds, and/or spot welds. The weld(s), rivet(s), overlap(s), and/or joint(s) may be positioned on an arc, on a corrugation, on an inside surface, on an outside surface, and/or on an oblique sidewall. A typical UHSW steel pile of FIG. 14 may be, for example, a 4×4, 6×6, 8×8, 12×12 (in inches) steel tube (with or without corrugations), and anything in between or the like.

Figure 15:
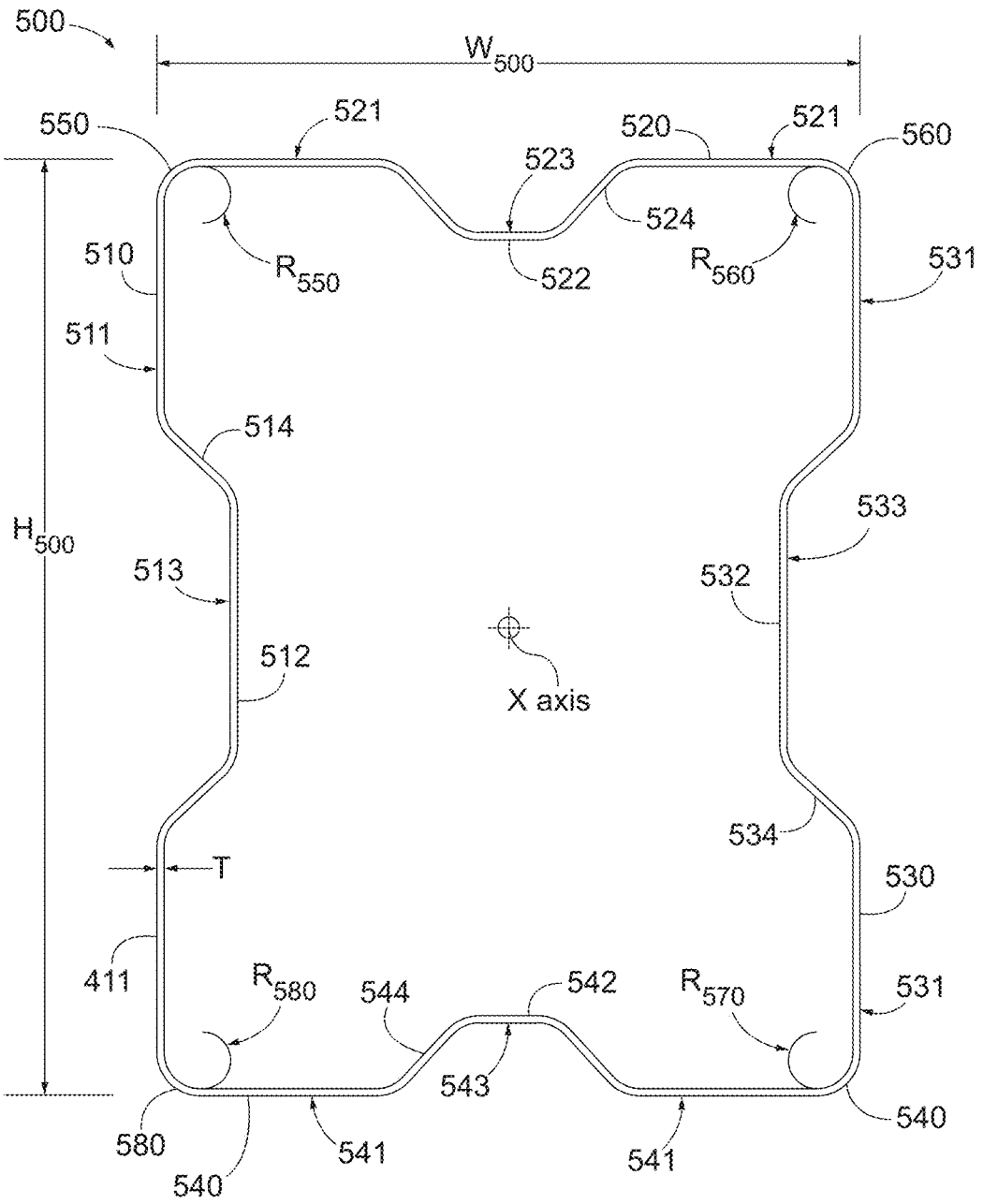
FIG. 15 is a cross-section of a rectangular tube with stiffening members of a steel pile or steel foundation cold roll formed from a thin cast steel strip according to one or more aspects of the present disclosure.

Turning now to FIG. 15, a UHSW steel pile 500 having a tubular cross-section is illustrated. In contrast to the square steel pile of FIG. 14, the steel pile 500 of FIG. 15 is rectangular. Like the steel pile of FIG. 14, the steel pile 500 comprises a first sidewall 510, a second sidewall 520, a third sidewall 530, and a fourth sidewall 540. The first sidewall 510 is generally parallel with the third sidewall 530. The second sidewall 520 is generally parallel with the fourth sidewall 540. Moreover, the first sidewall 510 and the third sidewall 530 are generally perpendicular to the second sidewall 520 and the fourth sidewall 540. As used in the present context, "generally" refers to the sidewall arrangement with the exceptions of the corrugations, as further described below. The height $H_{500}$ is greater than the width $W_{500}$ steel pile 500 of FIG. 15, forming a rectangular tube generally. Again, as used in the present context, "generally" refers to the wall arrangement with the exceptions of the corrugations. In other words, the overall dimension of first sidewall 510 and the third sidewall 530 and the overall dimension of the second sidewall 520 and the fourth sidewall 540 are the same. A curved transition is provided between each sidewall. More specifically, a first curved transition 550 is provided between the first sidewall 510 and the second sidewall 520; a second curved transition 560 is provide between the second sidewall 520 and the third sidewall 530; a third curved transition 570 is provided between the third sidewall 530 and the fourth sidewall 540; and a fourth curved transition 570 is provided between the fourth sidewall 540 and the first sidewall 510. Each curved transition 550, 460, 570, and 580 is an arc formed by respective radii $R_{550}$, $R_{560}$, $R_{570}$, and $R_{580}$.

One or more of the sidewalls of steel pile 500 of FIG. 15 may each comprise one or more corrugations. In the example of FIG. 15, each sidewall 510, 520, 530, 540 comprises one corrugation 512, 522, 532, 542, respectively. In FIG. 15 the corrugations of the first sidewall 510 and the third sidewall 530 are the same while the second sidewall 520 and the fourth sidewall 540 comprise the same corrugations that are different than the first and third sidewalls. Thereby, the cross-section of FIG. 15 is symmetrical along any plane extending the longitudinal axis $X_{axis}$ from corner to corner. Like the web corrugations of FIGS. 10, 12-13, each corrugation 512, 522, 532, 542 comprises an inside surface 513, 523, 533, 543, respectively, which is offset from and parallel to the outside surfaces 511, 521, 531, 541 of a sidewall 510, 520, 530, 540, respectively. In the example of FIG. 15, oblique sidewalls 514, 524, 534, 544 are provided to transition from the inside surface to the outside surface. In FIG. 15, each inside surface comprise opposing oblique sidewalls. An arc may be provided to transition between each surface, between each surface and an oblique sidewall, or the like. As noted above, the corrugation serves as a stiffener for the steel pile. In FIG. 15, each corrugation 512, 522, 532, 542 extends inwardly. In other examples, the corrugations may each extend outwardly, alternate, or form opposing halves. In some examples, one or more of the sidewalls may comprise multiple corrugations such as, for example, the web corrugations of FIG. 10. Additionally, or alternatively, the corrugation may be entirely formed by an arc, such as the flange corrugations as illustrated by FIGS. 12-13. The corrugations may be a combination of the corrugations described, above, with respect to FIG. 15 and the corrugations entirely formed by an arc.

In the UHSW steel pile 500 example of FIG. 15 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the tube of FIG. 15 is produced from the width, or less than the width, of the steel sheet and, thereby, has a total cross-sectional material length of 50" or less. More specifically, the total cross-sectional material length may be half or a third of the width of the steel sheet. Moreover, a weld, rivet, overlap and/or joint may be provided to close the tubular steel pile of FIG. 15 when formed from a steel sheet. The welds may be a continuous weld, partial welds, and/or spot welds. The weld(s), rivet(s), overlap(s), and/or joint(s) may be positioned on an arc, on a corrugation, on an inside surface, on an outside surface, and/or on an oblique sidewall. A typical UHSW steel pile of FIG. 15 may be, for example, a 6×4, 8×4.5, 8×5, 8×6, 10×8, 12×8 12×10, 14×10, 14×12 (in inches) steel tube (having corrugations), and anything in between or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

The shapes described above provide additional structural integrity for withstanding loads incurred by piles or steel foundations as further described below. Further, by increasing the structural integrity by way of the shape a much thinner material may be relied on for producing the steel pile than a traditional galvanized I-beam. Accordingly, a much thinner material also requires less force to be driven into the ground, while maintaining the requisite strength and integrity, because the cross-section of the present UHSW steel pile is reduced in comparison to prior piles and structural foundations.

In use, a partial length of the steel pile is driven into the earth or soil to provide a structural foundation. The steel pile is driven into the earth or soil using a ram, such as a piston or hammer. The ram may be a part of and is, at least, driven by a pile driver. The ram strikes or impacts the steel pile forcing the steel pile into the earth or soil. Due to the impact, prior steel piles may buckle or become deformed under the impact of the ram. To avoid buckling, or damage, to prior steel piles the RPM or force of the pile driver is maintained below a damaging threshold. The present steel pile has illustrated an ability for an increase in the RPM or force being applied to the steel pile without buckling, or damaging, the steel pile, as reflected by the strength properties of the steel pile, comparatively to prior steel piles. Specifically, as tested, prior steel piles of comparable dimensional characteristics were driven and structurally failed wherein the steel pile of the present disclosure provide an increase of RPM of 25%. Moreover, the prior steel piles were additionally not a weathering steel absent a galvanized, or zinc, surface. Thereby, prior steel piles are susceptible to corrosion due to their placement in exterior conditions, including earth and soil conditions, or require additional treatment such as, for example, galvanizing. Again, the present steel pile provides the necessary corrosion index for withstanding these conditions. The present strength properties and corrosion properties have not before been seen in combination for such a product.

The hemmed flanges of the hemmed C-channel, as described above and illustrated by FIG. 10, the corrugated web and flanges of the corrugated C-channel, as described above and illustrated by FIGS. 12-13, and the corrugated tubes, as described above and illustrated by FIGS. 14-15, further increase the stiffness of the steel pile to prevent buckling and/or to withstand the driving forces as noted above. By providing the features and shapes of the hemmed C-channel, the corrugated C-channel, and the corrugated tubes, the material thickness of the thin cast steel strip forming the ultra-high strength weathering steel pile may additionally be maintained at 2.5 mm or less, 2.0 mm or less, or 1.6 mm or less, as described herein. Reduction of the material thickness further aids in reducing the driving force required to drive the ultra-high strength weathering steel pile into the ground surface (e.g. earth or soil) by reducing the cross-sectional resistance between the ultra-high strength weathering steel pile and the ground surface. Moreover, because the ultra-high strength weathering steel pile does not possess a separately applied coating for corrosion resistance such a coating is not susceptible to being scraped off or removed during the installation process when contacting the ground surface and/or which may otherwise negatively impact ground water and/or soil conditions upon reacting therewith. As used herein, separately applied coatings are protective coatings that may be a surface protectant that is independent of the composition of the steel. Examples of such separately applied protective coatings include a zinc coating, a galvanized coating (e.g. a hot dipped galvanized coating), an aluminum-silicon corrosion resistant coating, or the like. More importantly, the piles or steel foundations of the present disclosure produce the corrosion resistance, as set forth below, without the aid of a separately applied coating. Inherently, by definition, weathering steels, including the ultra-high strength weathering steel disclosed herein, possess the requisite corrosion resistance the separately applied coating process of hot-dipped galvanizing would otherwise produce. Thereby, the weathering steel of the present disclosure would not require or possess a zinc coating, a hot-dipped galvanized coating, or the like.

Figure 16:
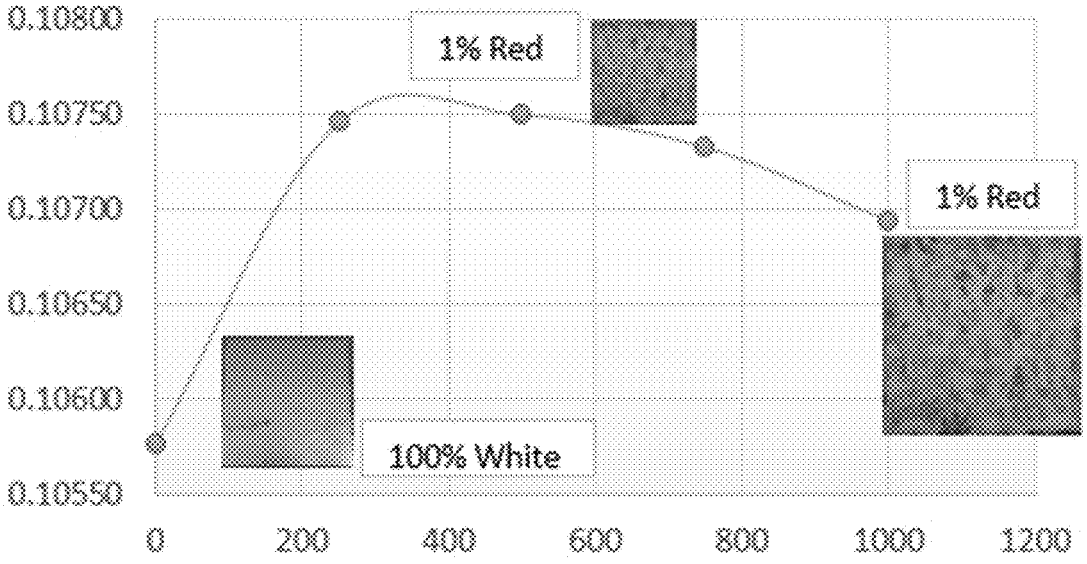
FIG. 16 is a graphical representation illustrating test results for a prior art hot-dipped galvanized (G324) steel material with representative images of the same.
Figure 17:
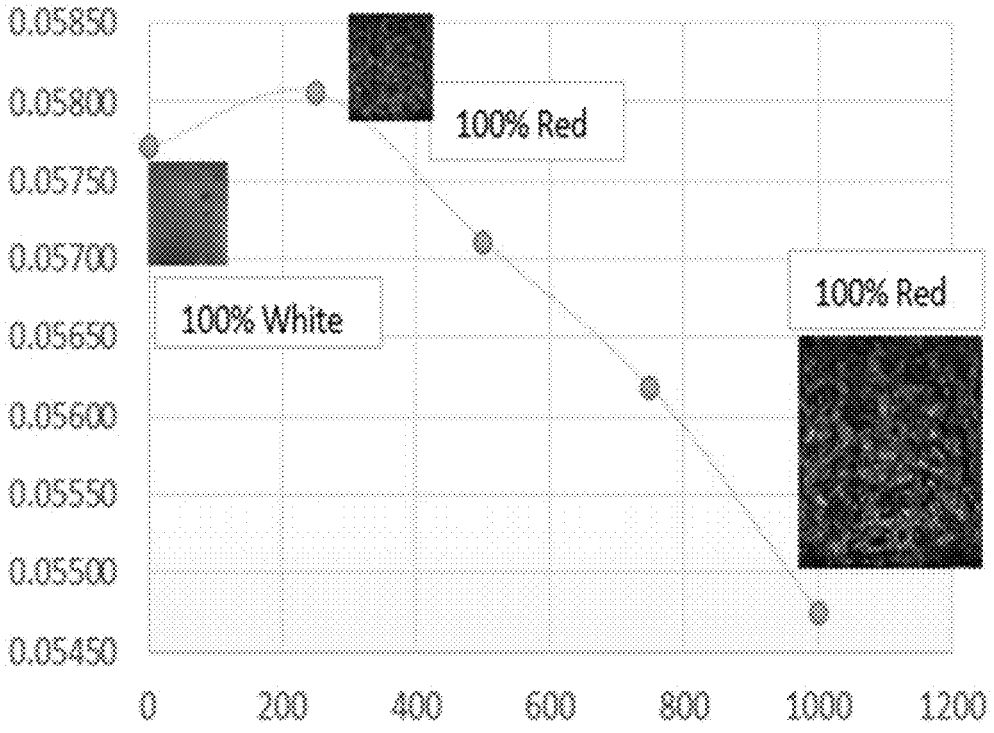
FIG. 17 is a graphical representation illustrating test results for a prior art (G100) steel material with representative images of the same.
Figure 18:
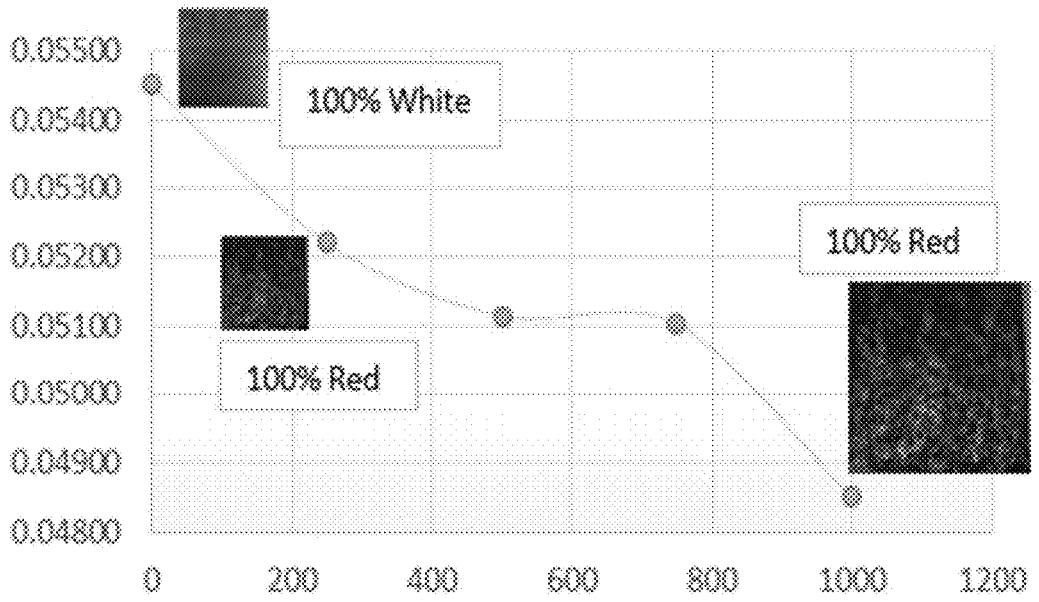
FIG. 18 is a graphical representation illustrating test results for a prior art (Gr70) steel material with representative images of the same.
Figure 19:
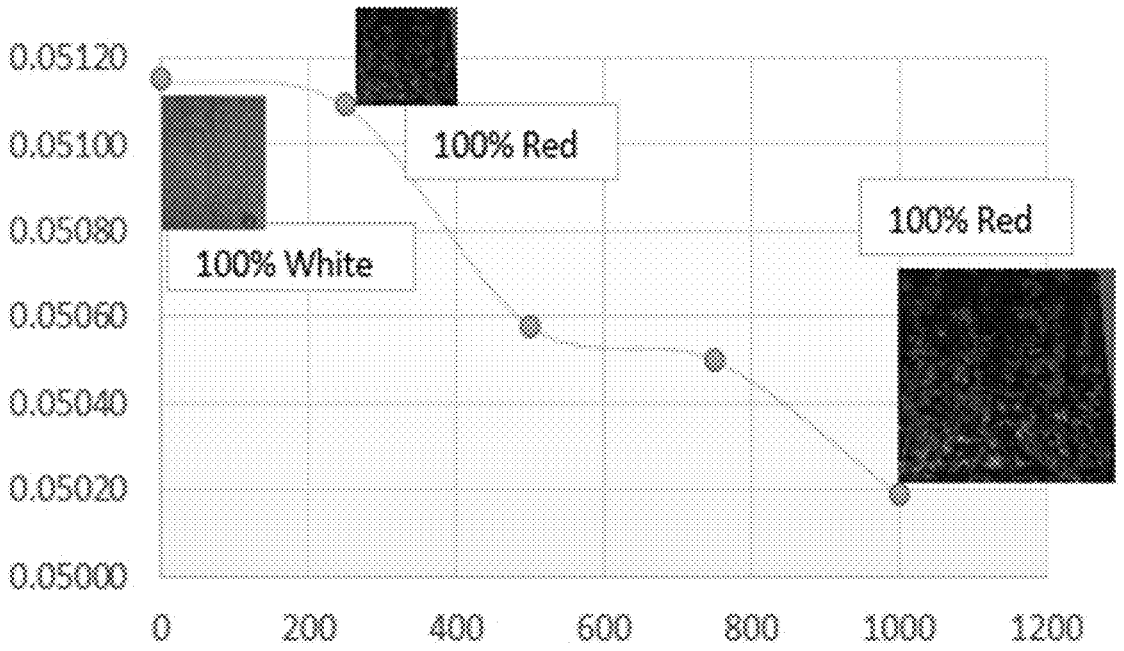
FIG. 19 is a graphical representation illustrating test results for a light-gauge, ultra-high strength weathering steel pile material of the present disclosure.

Steel piles formed of a light-gauge, ultra-high strength weathering steel of the present disclosure have been comparatively tested for operational life and corrosion resistant potential with prior steel pile materials. Prior steel pile materials include hot-dipped galvanized ("HDG") piles such as, for example, G235 grade steel, as well as ungalvanized steel such as, for example, G100, Gr 70, or the like. In solar arrangements, it has been the solar industry's convention to use piles designed from zinc-plated 50 ksi steel W6 I-Beams for structural purpose. Often a redox analysis is performed on soil types to identify the corrosive characteristics of soils. These characteristics are then relied on to determine the corrosive rates of materials being placed in the soils. Soil conditions may additionally, or alternatively, be analyzed for resistivity, pH, chlorides, and sulfates. Steel piles must be designated to withstand their load requirements regardless of corrosion. In order to comparatively test the operational life and corrosion resistant potential of the present material for a light-gauge, ultra-high strength weathering ("UHSW") steel pile a UHSW steel coupon was tested in direct comparison with steel coupons of varying material, such as G235, G100, and Gr7, using a salt-spray test. Specifically, testing was performed according to ASTM B117-18 standard specification on the four steel coupons of varying materials: "G235", "G100", "Gr70", and "UHSW". The test document specifies a 1000-hour salt spray test with inspection intervals at 250 hours. Random coupons (1 of 4) from each material type were chosen for inspection, and FIGS. 16-19 and Table 3, below, show an average of the thickness measurements taken at each corner for G235, G100, Gr70, and UHSW at intervals of 250 hours with both quantitative and qualitative descriptions. The thickness measurements were taken with calipers, and therefore represent the envelope of the thickness. Preliminary measurements are skewed by the initial buildup of oxidized material; however, each coupon shows relatively stable material loss rates after 250 hours. Each coupon is described for color and approximate percentage coverage. White coloring indicates zinc oxidation and red coloring indicates steel oxidation. The results of the comparative testing are reproduced in Table 3, below. FIGS. 16-19 illustrate the same test results in graphical format, accompanied by representative images, with FIG. 16 illustrating Steel Grade G325, FIG. 17 illustrating Steel Grade G100, FIG. 18 illustrating Steel Grade Gr70, and FIG. 19 illustrating the UHSW steel.

TABLE 3

| Material | G235 | G100 | Gr70 | UHSW |
|---|---|---|---|---|
| Initial Thickness* | 0.10576" | 0.05771" | 0.05451" | 0.05115" |
| Thickness* at Approx. 250 hrs. | 0.10746" | 0.05806" | 0.05220" | 0.05109" |
| Thickness* at Approx. 500 hrs. | 0.10750" | 0.05711" | 0.05114" | 0.05058" |
| Thickness* at Approx. 1000 hrs. | 0.10694" | 0.05475" | 0.04851" | 0.05019" |
| Appearance at Approx. 250 hrs. | 100% White | 100% Red | 100% Red | 100% Red |
| Appearance at Approx. 500 hrs. | Trace of Red | Same | Same | Same |
| Appearance at Approx. 750 hrs. | Approx. 1% Red | Same | Same | Same |
| Appearance at Approx. 1000 hrs. | Same | Same | Same | Same |

*Thickness values are the average of four readings taken at each corner of the coupon.

To compare the relative corrosion rates of the materials tested, the difference in material loss per hour was measured for each sample, and the initial data readings were excluded due to the appearance of oxidation generally skewing the results. In other words, the appearance of oxidation increased the measured thicknesses. After 250 hours, the results were generally more linear. The averages of this exercise, shown in Table 4, below, are used to create a relative relationship between the corrosion rate of the UHSW steel coupon with the other coupons:

TABLE 4

| Time (hours) | G235 | G100 | Gr70 | UHSW |
|---|---|---|---|---|
| 250 | 1.7 | 0.35 | −2.31 | −0.06 |
| 500 | 0.04 | −0.95 | −1.06 | −0.51 |
| 750 | −0.17 | −0.93 | −0.12 | −0.08 |
| 1000 | −0.39 | −1.43 | −2.51 | −0.31 |
| Average of "stabilized values >250" | −0.28 | −1.18 | −1.315 | −0.195 |
| Relative rate of galvanized | 100% | 421% | 470% | 70% |

Using this correlation alone, the UHSW coupon performed better than the galvanized coupon. It is notable that the measurements of the UHSW greatly outperformed the other steel coupons. The ultra-high strength weathering steel of the present disclosure exhibits a resistance to corrosion where one of ordinary skill would otherwise rely on a separately applied metallic coating or galvanizing to achieve the same. Thereby, the ultra-high strength weathering steel exhibits the combination of the requisite strength and corrosion properties, in combination with the benefits of the above shapes, for use as a pile or structural foundation where a separately applied coating would otherwise be required on a steel to achieve the same strength properties not otherwise present in prior weathering steel.

Table 5, below, illustrates the steel grade and chemistry for the UHSW steel coupon relied on in the above results of Tables 3-4.

TABLE 5

| Material | | UHSW |
|---|---|---|
| % | C | 0.2272 |
| Weight | Mn | 0.91 |
| | Si | 0.22 |
| | V | 0.001 |
| | S | 0.015 |
| | P | 0.34 |
| | Cr | 0.25 |
| | Ni | 0.66 |
| | Cu | 0.004 |
| | Mo | 0.002 |
| | Al | 0.00008 |
| | LecoN | 0.0066 |
| | CEAWS | 0.54 |

Additional testing was performed to evaluate the UHSW steel's corrosion rate in comparison to that of a galvanized ("HDG") steel for varied geometry, duration of burial, and simulated aging. Tables 6-7, below, illustrate the results from these tests. The materials were tested in moderately salty, low resistivity soil that was also designated as "very corrosive." Material geometry tested included small angle-shaped stakes, and full-sized cold roll formed C-piles. The material designated as "current applied" received a voltage high enough to artificially induce corrosion for approximately 24 hours, in an attempt to simulate the effects of longer-term installation. Under this comparative analysis, the UHSW steel material measurement rates varied from 77% to 99% the measured rates for the HDG steel material.

TABLE 6

| ID | Material | Surface Area, ($In^{2)}$ | Corrosion Current (mA) | Corrosion Rate, (mpy) |
|---|---|---|---|---|
| 1 | UHSW Stake | 100.04 | 40.00 | 28.20 |
| 2 | UHSW Stake | 100.04 | 40.00 | 28.20 |
| 3 | HDG Stake | 100.04 | 40.00 | 36.50 |
| 4 | HDG Stake | 100.04 | 35.00 | 31.90 |
| 5 | UHSW C-pile | 2171.00 | 110.00 | 3.60 |
| 6 | UHSW C-pile | 2270.00 | 120.00 | 3.70 |
| 7 | HDG C-pile | 3697.00 | 150.00 | 3.70 |
| 8 | UHSW (Current Applied) | 100.40 | 35.00 | 24.70 |
| 9 | HDG (Current Applied) | 100.40 | 35.00 | 31.90 |

TABLE 7

| Material | Average Factor, Corrosion Rate (mpy) | Ratio, UHSW/HDG Averaged Factors (unitless) |
|---|---|---|
| UHSW Stake | 28.20 | 0.82 |
| HDG Stake | 34.20 | |
| UHSW C-pile | 3.65 | 0.99 |
| HDG C-Pile | 3.70 | |
| UHSW (Current Applied) | 24.70 | 0.77 |
| HDG | 31.90 | |

The above comparative testing and structural capacity calculations illustrate steel piles produced from a thin cast steel strip outperformed hot-dip galvanized ("HDG") steel piles as well as prior steel piles. The UHSW steel pile of the present disclosure provides greater resistance to corrosion and at much thinner material thicknesses. These improvements are maintained while also maintaining desirable strength and elongation properties that allow the UHSW steel piles to resist deformation while being driven into the ground. As also illustrated by the material thicknesses, the UHSW steel piles are produced at much lower weights than the prior steel piles. Specifically, in comparison to a steel pile constructed from a W6×7 I-beam, weighting 7 pounds (lbs) per foot, or from a W6×9 I-beam, weighing 9 pounds (lbs) per foot, the UHSW hemmed C-channel, or NXW pile, of a comparative overall cross-section weighs 5 pounds (lbs) per foot and the UHSW corrugated C-channel, or NCW pile, of comparative cross-section weighs 3.5 pounds (lbs) per foot. The UHSW steel piles of the present disclosure are also provided without a hot-dip galvanized coating or zinc coating. The UHSW steel piles of the present disclosure, thereby, eliminate any undesirable interaction between the soil or groundwater and a zinc coating that is otherwise present with a HDG steel pile. Other alternatives to a steel pile not having a separately applied coating, such as the other ungalvanized steel piles tested herein, were significantly outperformed by the UHSW steel pile of the present disclosure.

Even with a galvanized coating, the HDG steel pile structural capacity and service life fails to outperform the structural capacity and service life of a thinner UHSW steel pile. The galvanic layer's time to completely corrode is estimated by using the thickness divided by the corrosion rate. Then the remaining time is multiplied by the steel corrosion rate to determine the final material thickness. For example, consider a 0.124" thick G235 sheet metal component: if the standard ratio of corrosion rate between the Zinc layer and base metal in corrosive soil condition is applied, and a G235 (2.1 mils/side) galvanized steel zinc coating corrosion rate is estimated to be 0.0003"/y, then a base steel corrosion rate should be around 0.0021"/y, with a service life of 30 years, the total reduction, per side, is calculated as follows:

$$\frac{0.0021''/\text{side}}{0.0003''/\text{yr/side}} = 7\text{ years}$$

$$0.0021''/\text{yr/side} \times 23\text{ years} \times 2\text{ sides} = 0.0966''$$

The total metal loss will be around 0.1008" and this would leave a 0.0232" thick component at the end of the service life.

Assuming the UHSW material with 0.062" thickness corrodes at the same rate as zinc, the final thickness is more simply calculated as follows after the first two years:

$$0.3\text{ mils/year/side} \times 30\text{ years} \times 2\text{ sides} = 18\text{ mils}$$

resulting in a material thickness of 0.0440" at the end of 30 years. This mild corrosivity case demonstrates how the material can outperform zinc+carbon steel structures for longevity, and the greatly increased strength compared to carbon steel allows for significantly larger capacities in virtually any loading scenario.

In addition to the material property testing as illustrated above, three-point bend tests were also performed to evaluate the strength of the respective cross-sections for piles disclosed herein. Specifically, the three-point bend tests illustrate a sustained and a comparatively improved bending resistance resulting from particular features of the pile shapes, or cross-sections thereof. The comparatively improved bending resistance may be attributed to the particular features of the pile shapes, or cross-sections thereof, in view of forming each tested pile from the same thin cast steel strip material having a thickness of less than or equal to 1.6 mm. The bend test performed was performed by the University of Nebraska-Lincoln.

In the tests, the lengths of the tested piles were secured by three collars at each end (left and right) and a center. The piles were secured on the ends by five bolts. Two bolts were placed on the top and bottom flanges, each, and one bolt attached to the web of the pile to the collar. The center collar was attached to the pile using a single bolt at the web of the pile. The end collars were each further attached to independent steel plates positioned below the pile and in a way that allowed rotation to occur and the pile to deflect downwardly. Specifically, the plates rested on two steel pipes acting as rollers for the plates to move upon. Loading was applied to the pile using a ram and measured with a load cell placed between the ram and the center collar. Four string potentiometers were also used to measure the deflection at various points throughout the test. Two string potentiometers were placed so as to measure the deflection of the mid-height of the web. These potentiometers were placed on the bottom of the bottom flanges at points beside the end collars. The remaining two potentiometers measured deflection near the center of the pile. One was attached to the center collar at mid-height of the pile's flange. The other was attached directly to the pile at the same location.

As a baseline for a sustained bending resistance, a pile 300 having the cross-section of FIG. 13 underwent the above bend test. Although the pile 300 of FIG. 13 produced a measured bending resistance, improvements have been made and additional shapes have been developed with an increased bending resistance, the cross-sections for which are illustrated by piles 600, 700, and 800 of FIGS. 22, 24, and 26, respectively, and are further described below.

Figure 20:
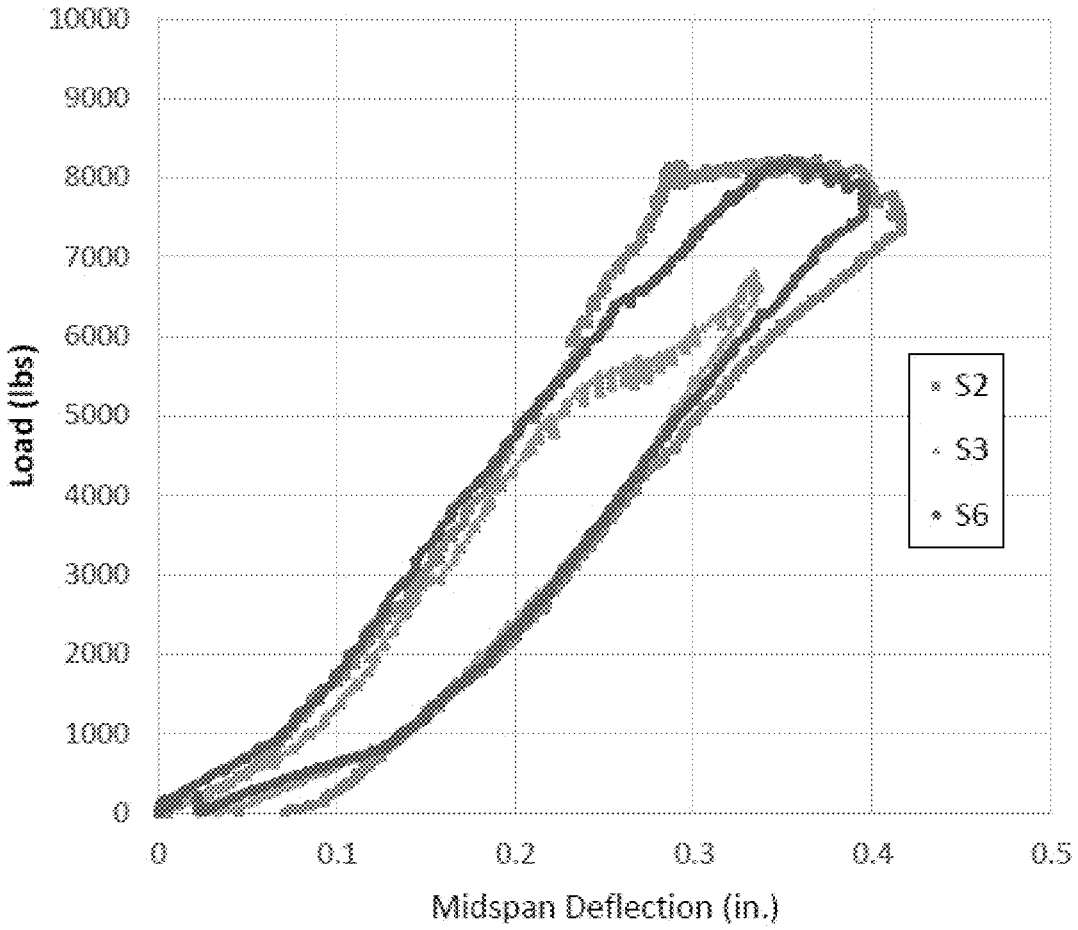
FIG. 20 is a graphical representation illustrating test results for a light-gauge, ultra-high strength weathering steel pile material of the present disclosure.
Figure 21:
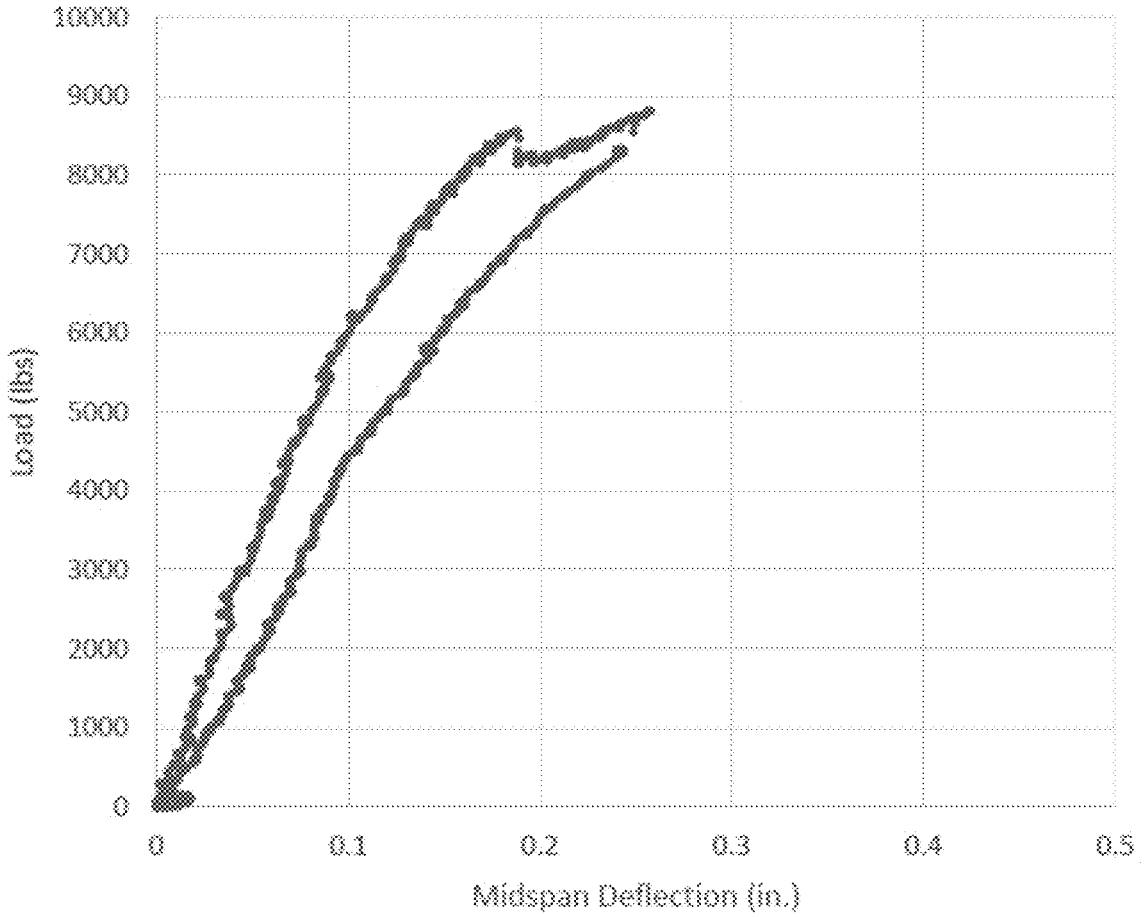
FIG. 21 is a graphical representation illustrating test results for a light-gauge, ultra-high strength weathering steel pile material of the present disclosure.

In the bend test, the tested pile 300 of FIG. 13 has a height $H_{300}$ of 8 inches, a width $W_{300}$ of 6 inches, and a material thickness T of 0.062 inches (") (0.1575 mm). FIG. 20 illustrates a load deflection curve for the pile 300 of FIG. 13 with results from tests designated S2, S3, and S6. FIG. 21 illustrates a load deflection curve for the pile 300 of FIG. 13 with results from a test designated S7. In test S7, all string potentiometer attachments were moved and attached to the bottom flange for deflection readings. Four inclinometers were also utilized for each of the tests. The inclinometers were placed on each collar with the additional inclinometer placed on a web of the pile 300 adjacent the center collar. The inclinometers measured the rotation of the collars and member and were used to ensure the piles were being loaded near the web. The loading location was initiated until the pile achieved failure without exceeding a rotation greater than 3.5 degrees at any of the inclinometer locations. The slope of the curves of each of the FIGS. 20-21 correspond to a modulus of rupture of approximately 15 $in^4$ for an elastic modulus of the steel (E) of 26,000 ksi-29,000 ksi (179 GPa-200 GPa).

Table 8, below, illustrates the maximum load and load at onset of non-linearity for the specimens corresponding to pile 300 of FIG. 13.

TABLE 8

| Pile 300 (NCW) 8 × 6 | Load at Onset of Non-Linearity (lbs) | Deflection at Onset of Non-Linearity (in.) | Maximum Load (lbs) | Deflection at Maximum Load (in.) |
|---|---|---|---|---|
| S2 | 7900 | 0.289 | 8237 | 0.369 |
| S3 | 5184 | 0.238 | 6814 | 0.334 |
| S6 | 6430 | 0.264 | 8202 | 0.35 |

TABLE 8-continued

| Pile 300 (NCW) 8 × 6 | Load at Onset of Non-Linearity (lbs) | Deflection at Onset of Non-Linearity (in.) | Maximum Load (lbs) | Deflection at Maximum Load (in.) |
|---|---|---|---|---|
| S7 | 5640 | 0.091 | 8819 | 0.257 |
| Average | 6289 | 0.221 | 8018 | 0 |

Table 9, below, illustrates the elastic stiffness observed during testing for the specimens corresponding to pile 300 of FIG. 13. Because deflection sensors were located on the web for S2-S6 much high deformations were reported (likely due to the rotation of the asymmetric pile and local deformations near the center collar).

TABLE 9

| Pile 300 (NCW) 8 × 6 | Stiffness (k/in) | Estimated I ($in^4$) | Moment at Onset of Non-Linearity (kip * in) | Moment at Maximum Load (kip * in) |
|---|---|---|---|---|
| S2 | 22.9 | 6.8 | 142 | 148 |
| S3 | 20.2 | 6.0 | 93 | 123 |
| S6 | 23.0 | 6.9 | 116 | 148 |
| S7 | 62.0 | 18.5 | 102 | 159 |
| Average | 32.0 | 9.55 | 113 | 144 |

Table 10, below, illustrates deflection at 50% load for the specimens corresponding to pile 300 of FIG. 13.

TABLE 10

| Pile 300 (NCW) 8 × 6 | Deflection at 50% Load |
|---|---|
| S2 | 0.18 |
| S3 | 0.169 |
| S6 | 0.178 |
| S7 | 0.068 |
| Average | 0.149 |

Additional shapes were developed to further improve the above properties with respect to their cross-sectional characteristics. The cross-sections for these additional shapes are illustrated by the piles 600, 700, and 800 of FIGS. 22, 24, and 26, respectively, with comparative test results illustrated by FIGS. 23, 25, and 27-28 and Tables 11-13, 14-16, and 17-22, respectively.

Figure 22:
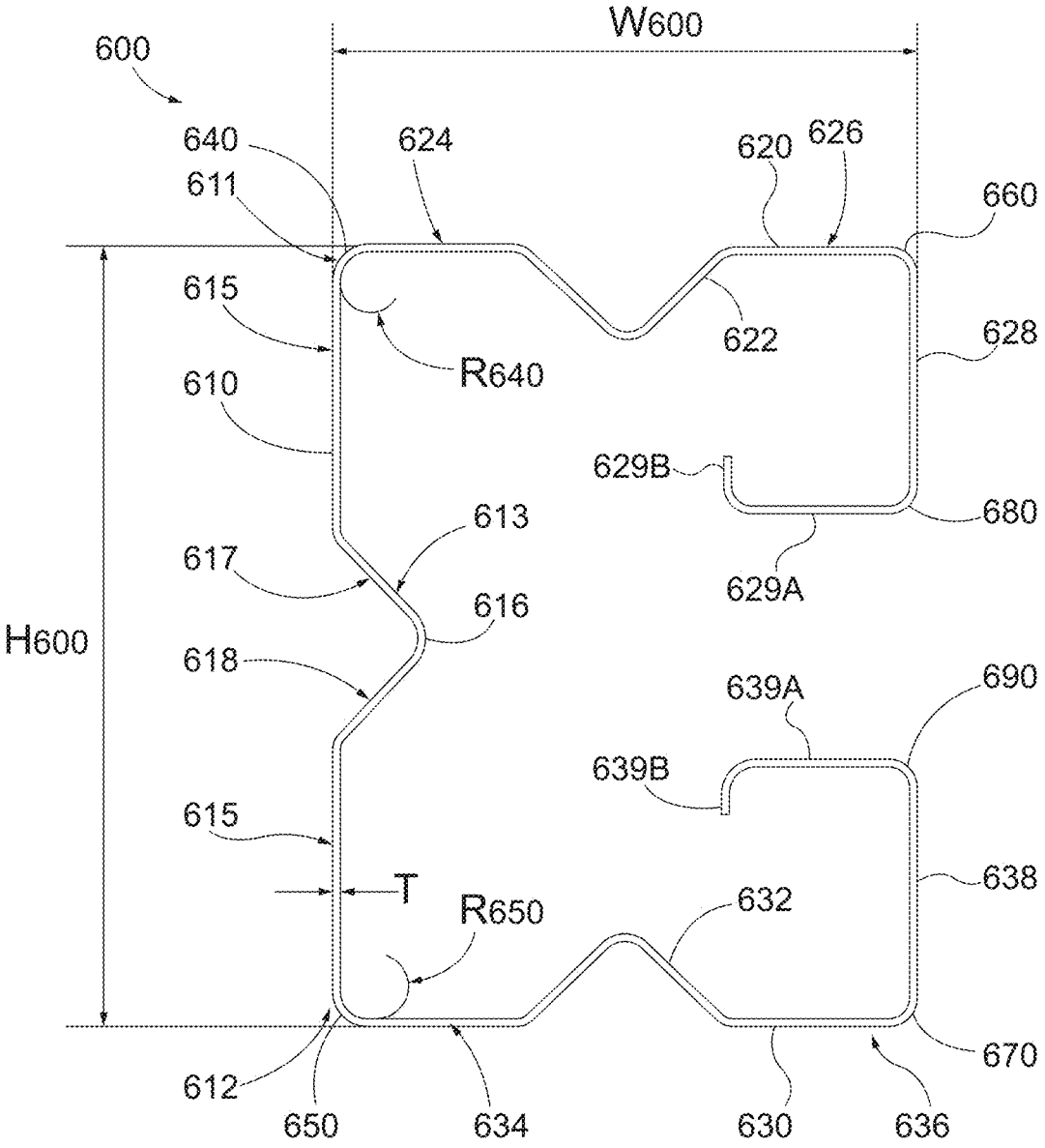
FIG. 22 is a cross-section of a M-channel shape of a pile or steel foundation cold roll formed from a thin cast steel strip according to one or more aspects of the present disclosure.

Turning now to FIG. 22, a UHSW steel pile 600 that is a variation of a C-channel comprising a web 610, a first flange 620, and a second flange 630 is illustrated. More specifically, the present example is a variation of the corrugated C-channel, or NCW pile, of FIG. 13. The UHSW steel pile 600 of the present example is referred to as a M-channel (e.g., M8×6, or the like). Like the steel pile of FIG. 13, the web 610 of the steel pile 600 of FIG. 22 extends a height $H_{600}$ of the steel pile 600 and transitions at a curved transition 640 into the first flange 620 at a first end 611. The web 610 also transitions at a curved transition 650 into the second flange 630 at a second end 612. Each curved transition 640, 650 has a radius $R_{640}$, $R_{650}$, respectively. Each curved transition 640, 650 extends from a respective first flange 620 or second flange 630 along the arc formed by the radii $R_{640}$, $R_{650}$, respectively. The arc of the curved transition 640, 650 of FIG. 22 extend 90 degrees.

In FIG. 22, the web 610 comprises a discontinuity that is a V-shaped transition 613. The V-shaped transition 613 extends the same direction as each flange 620, 630 relative the web 610. This is in contrast to, and in comparison, to the single web corrugation 313 of the pile 300 of FIG. 13. The V-shaped transition 613 is centrally positioned relative the steel pile height $H_{600}$. The apex 616 of the V-shaped transition 613 is offset from an outside surface 615 of the web 610, in the same direction the flanges extend the steel pile width $W_{600}$. The apex 616 may additionally, or alternatively, be referred to as being recessed relative the web 610 or recessed relative the outside surface 615 of the web 610. Opposing sides 617, 618 of the V-shaped transition are at oblique angles relative to the web 610. In one example, the opposing sides 617, 618 are at a right angle relative to one another.

Still referring to FIG. 22, the first flange 620 may also comprise one or more discontinuities where the discontinuities are V-shaped transitions. In the example of FIG. 22, the first flange 620 comprises one V-shaped transition 622 formed centrally along the steel pile width $W_{600}$. In some examples, corrugations, arcs, and/or V-shaped transitions may be interchanged and/or combined on or between the flanges and webs of a single pile. In FIG. 22, the V-shaped transition 622 extends inwardly from a first outside surface 624 and a second outside surface 626 of the flange 620. Opposite the web 610, a first lip 628 extends from the first flange 620 at a curved transition 660. The first lip extends in a direction of the steel pile height $H_{600}$ and is parallel to the outside surface 615 of the web 610. The first lip 628 may further comprise a curved transition 680 into a first return 629A. The first return 629A extends inwardly from the first lip 628 toward the web 610. The first return 629A is parallel to the first outside surface 624 and the second outside surface 626 of the flange 620. A second return 629B may also be provided returning in a direction of the web 620. It is appreciated herein that the second return 629B may return in the opposite direction (e.g. toward the opposite flange). It is also appreciated herein that the second return 629B may return at an oblique angle relative the first return 629A. In the present example, the second return 629B is at a 90-degree angle relative the first return 629A. A pile having a second return may more generally be described as having a triple edge.

Like the first flange 620, the second flange 630 may also comprise one or more discontinuities where the discontinuities are V-shaped transitions. In the example of FIG. 22, the second flange 630 comprises one V-shaped transition 632 formed centrally along the steel pile width $W_{600}$. In some examples, corrugations, arcs, and/or V-shaped transitions may be interchanged and/or combined on or between the flanges and webs of a single pile. In FIG. 22, the V-shaped transition 632 extends inwardly from a first outside surface 634 and a second outside surface 636 of the flange 630. Opposite the web 610, a first lip 638 extends from the second flange 630 at a curved transition 670. The first lip extends in a direction of the steel pile height $H_{600}$ and is parallel to the outside surface 615 of the web 610. The first lip 638 may further comprise a curved transition 690 into a first return 639A. The first return 639A extends inwardly from the first lip 638 toward the web 610. The first return 639A is parallel to the first outside surface 634 and the second outside surface 636 of the flange 630. A second return 639B may also be provided returning in a direction of the web 630.

In the example of FIG. 22, the thickness T of the steel sheet forming the steel pile 600 is 0.062 inches (") (1.575 mm). In some examples, the thickness of the steel sheet forming the steel pile 600 may be 2 mm or less. In other examples, the thickness of the steel sheet forming the steel pile 600 may be 2.5 mm or less. The first flange 620 and/or the second flange 630 of the UHSW steel pile 600 of FIG. 22 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 610.

In the UHSW steel pile 600 example of FIG. 22 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the M-channel of FIG. 22 is produced from the width of the steel sheet and, thereby, has a total cross-sectional material length of 50" or less. More specifically, the total cross-sectional material length may be half or a third of the width of the steel sheet. At the V-shaped transitions, the material thickness T is maintained at each layer and transition. In the example of FIG. 22, the height $H_{600}$ of the steel pile is greater than the width $W_{600}$ of the steel pile. In the example of FIG. 22, the steel pile 600 is symmetrical about an axis bisecting the height $H_{600}$ of the steel pile 600. A typical UHSW steel pile of FIG. 22 may be, for example, a M6×4, M8×4.5, M8×5, M8×6, M10×8, M12×8 M12×10, M14×10, M14×12 (in inches), or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 23:
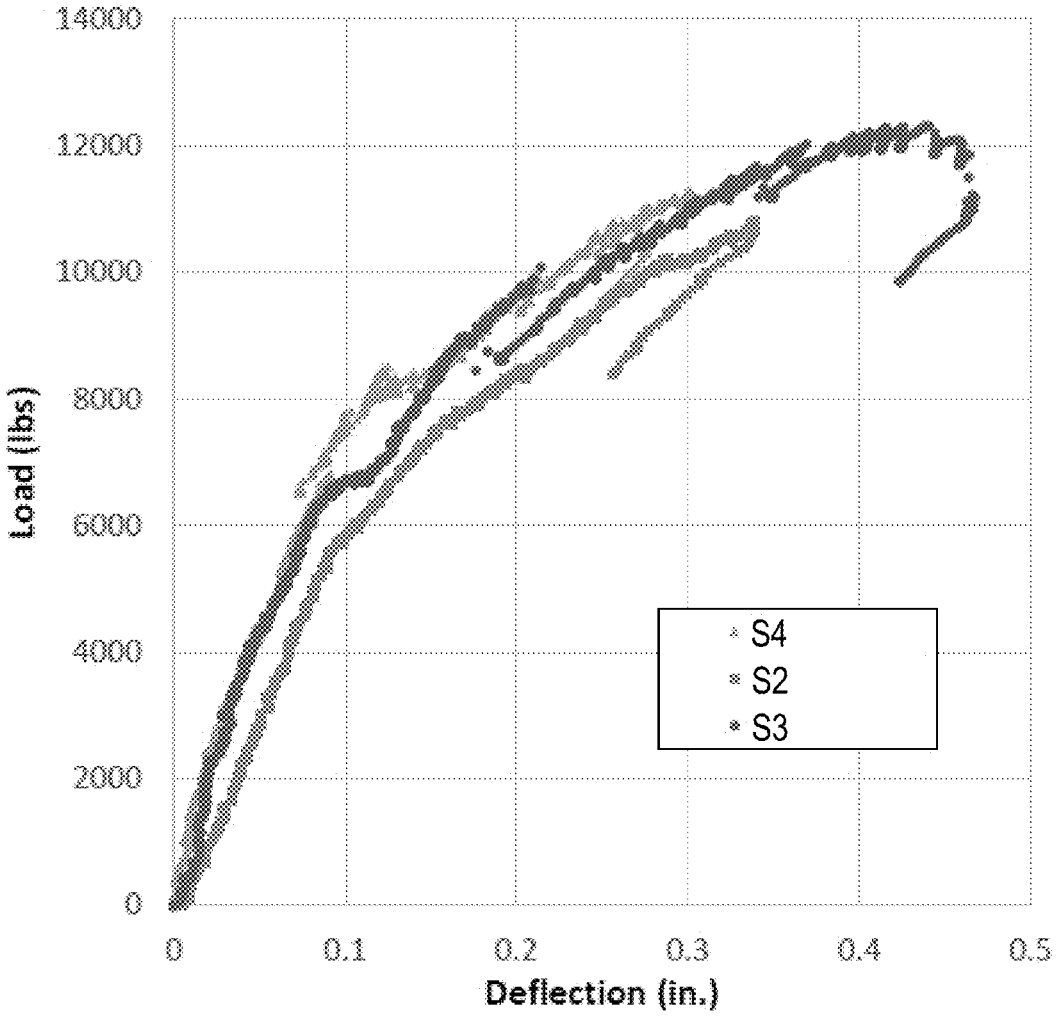
FIG. 23 is a graphical representation illustrating test results for a light-gauge, ultra-high strength weathering steel pile material of the present disclosure.

To illustrate bending resistance, a pile 600 of FIG. 22 underwent the same bend test as described, above, with respect to FIG. 13. In the bend tests, the tested pile 600 of FIG. 22 has a height $H_{600}$ of 8 inches, a width $W_{600}$ of 6 inches, and a material thickness T of 0.062 inches (") (0.1575 mm). FIG. 23 illustrates a load deflection curve for the pile 600 of FIG. 22 with results from tests designated S2, S3, and S4. Sensors were located on the web for tests S2-S4. It does not appear the material yielded in the test results. Instead, local bearing failure occurred before the material yielded. Also, true local buckling of the flange or any other buckling were not observed. The slope of the curves of each of FIG. 23 corresponds to a moment of inertia of 20.8 $in^4$ to 18.6 $in^4$ for an elastic modulus of the steel (E) of 26,000 ksi to 29,000 ksi (179 GPa-200 GPa).

Table 11, below, illustrates the maximum load and load at onset of non-linearity for the specimens corresponding to pile 600 of FIG. 22.

TABLE 11

| Pile 600 M8 × 6 | Load at Onset of Non-Linearity (lbs) | Deflection at Onset of Non-Linearity (in.) | Maximum Load (lbs) | Deflection at Maximum Load (in.) |
|---|---|---|---|---|
| S2 | 5684 | 0.0946 | 10815 | 0.339 |
| S3 | 6518 | 0.0922 | 12309 | 0.441 |
| S4 | 7769 | 0.1 | 11300 | 0.301 |
| Average | 6657 | 0.0956 | 11475 | 0.360 |

Table 12, below, illustrates the elastic stiffness observed during testing.

TABLE 12

| Pile 600 M8 × 6 | Stiffness (k/in) | Estimated I ($in^4$) | Moment at Onset of Non-Linearity (kip * in) | Moment at Maximum Load (kip * in) |
|---|---|---|---|---|
| S2 | 60.1 | 18.0 | 102 | 195 |
| S3 | 70.7 | 21.1 | 117 | 222 |
| S4 | 77.7 | 23.2 | 140 | 203 |
| Average | 69.5 | 20.8 | 120 | 207 |

Table 13, below, illustrates deflection at 50% load for the specimens corresponding to pile 600 of FIG. 22.

TABLE 13

| Pile 600 M8 × 6 | Deflection at 50% Load |
|---|---|
| S2 | 0.090 |
| S3 | 0.081 |
| S4 | 0.069 |
| Average | 0.080 |

Figure 24:
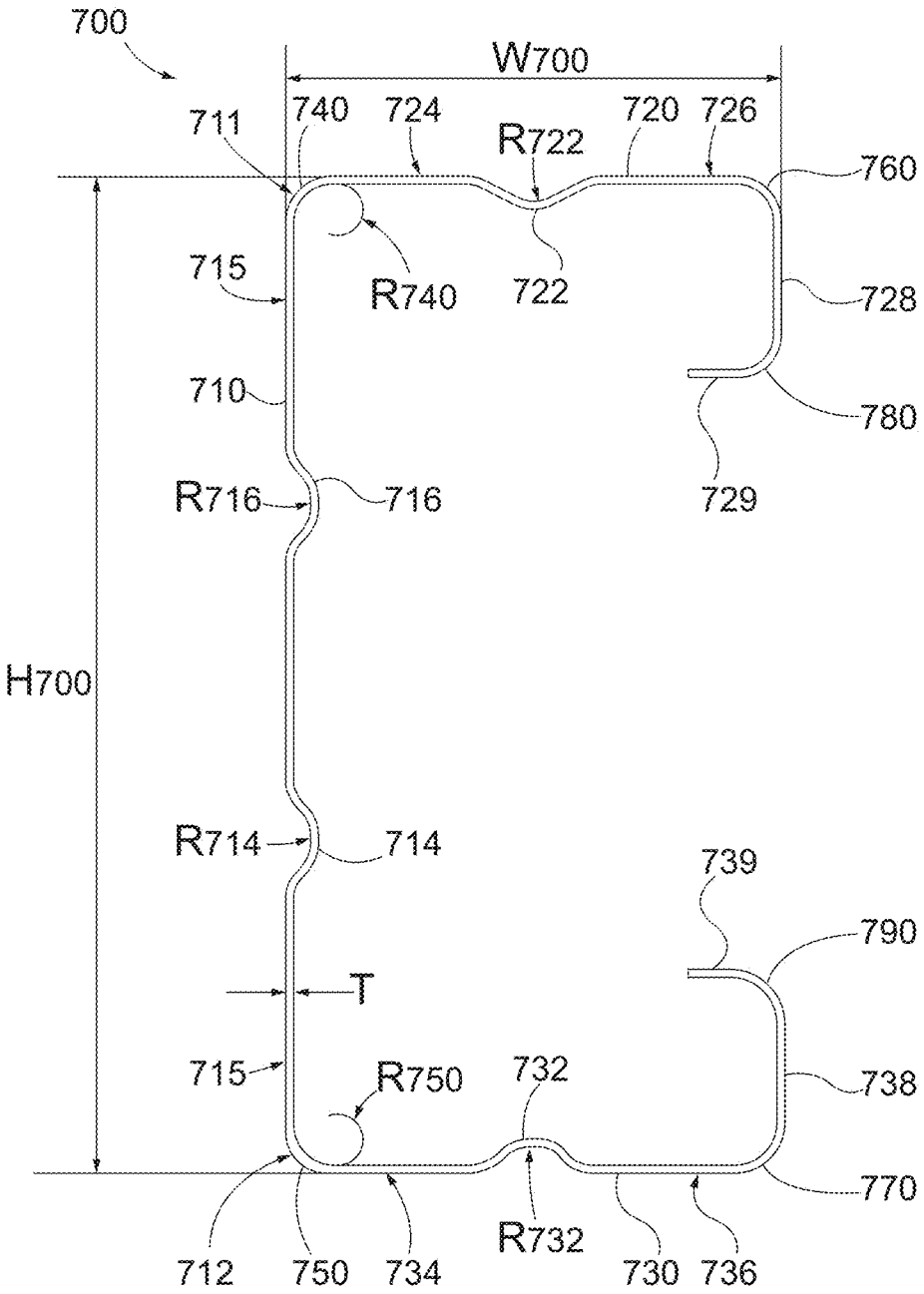
FIG. 24 is a cross-section of a C-channel shape of a pile or steel foundation cold roll formed from a thin cast steel strip according to one or more aspects of the present disclosure.

Turning now to FIG. 24, a UHSW steel pile 700 that is a C-channel comprising a web 710, a first flange 720, and a second flange 730 is illustrated and is variation of the corrugated C-channel, or NCW pile. Like the steel pile of FIG. 13, the web 710 of the steel pile 700 of FIG. 24 extends a height $H_{700}$ of the steel pile 700 and transitions at a curved transition 740 into the first flange 720 at a first end 711. The web 710 also transitions at a curved transition 750 into the second flange 730 at a second end 712. Each curved transition 740, 750 has a radius $R_{740}$, $R_{750}$, respectively. Each curved transition 740, 750 extends from a respective first flange 720 or second flange 730 along the arc formed by the radii $R_{740}$, $R_{750}$, respectively. The arc of the curved transition 740, 750 of FIG. 24 extend 90 degrees.

In FIG. 24, the web 710 comprises one or more discontinuities that may be characterized as corrugations that are arcs having a radius. Specifically, the first flange 720 comprises a first arc 714 formed by a radius $R_{714}$ and a second arc 716 formed by a radius $R_{716}$. In the example of FIG. 24, the first arc 714 and the second arc 716 are evenly spaced along the steel pile width $W_{700}$. The radius $R_{714,716}$ extending inwardly from an outside surface 715 of the web 710.

The first flange 720 may also comprise one or more discontinuities that may be characterized as corrugations. In the example of FIG. 24, the first flange 720 comprises one flange corrugation 722 formed centrally along the steel pile width $W_{700}$. The flange corrugation 722 is an arc formed by a radius $R_{722}$ extending inwardly from between a first outside surface 724 and a second outside surface 726 of the flange 720. Opposite the web 710, a first lip 728 extends from the first flange 720 at a curved transition 760. The first lip extends in a direction of the steel pile height $H_{700}$ and is parallel to the inside surface 716 and outside surface 715 of the web 710. The first lip 728 may further comprise a curved transition 780 into a return section 729. The return section 729 extends inwardly from the first lip 728 toward the web 710. The return section 729 is parallel to the first outside surface 724 and the second outside surface 726 of the flange 720.

Like the first flange 720, the second flange 730 may also comprise one or more discontinuities that may be characterized as corrugations. In the example of FIG. 24, the second flange 730 comprises one flange corrugation 732 formed centrally along the steel pile width $W_{700}$. The flange corrugation 732 is an arc formed by a radius $R_{732}$ extending inwardly from between first outside surface 734 and a second outside surface 736 of the flange 730. Opposite the web 710, a second lip 738 extends from the second flange 730 at a curved transition 770. The second lip extends in a direction of the steel pile height $H_{700}$ and is parallel to the inside surface 716 and outside surface 715 of the web 710. The second lip 728 may further comprise a curved transition 790 into a return section 739. The return section 739 extends inwardly from the lip 728 toward the web 710. The return section 739 is parallel to the first outside surface 734 and the second outside surface 736 of the second flange 730.

In the example of FIG. 24, the thickness T of the steel sheet forming the steel pile 700 is 0.062 inches (") (1.575 mm). In some examples, the thickness of the steel sheet forming the steel pile 700 may be 2 mm or less. In other examples, the thickness of the steel sheet forming the steel pile 700 may be 2.5 mm or less. The first flange 720 and/or the second flange 730 of the UHSW steel pile 700 of FIG. 24 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 710.

In the UHSW steel pile 700 example of FIG. 24 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the C-channel of FIG. 24 is produced from the width of the steel sheet and, thereby, has a total cross-sectional material length of 50" or less. More specifically, the total cross-sectional material length may be half or a third of the width of the steel sheet. In the example of FIG. 24, the height $H_{700}$ of the steel pile is greater than the width $W_{700}$ of the steel pile. In the example of FIG. 24, the steel pile 700 is symmetrical about an axis bisecting the height $H_{700}$ of the steel pile 700. A typical UHSW steel pile of FIG. 24 may be, for example, a C6×4, C8×4, C8×4.5, C8×5, C8×6, C10×8, C12×8 C12×10, C14×10, C14×12 (in inches), or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 25:
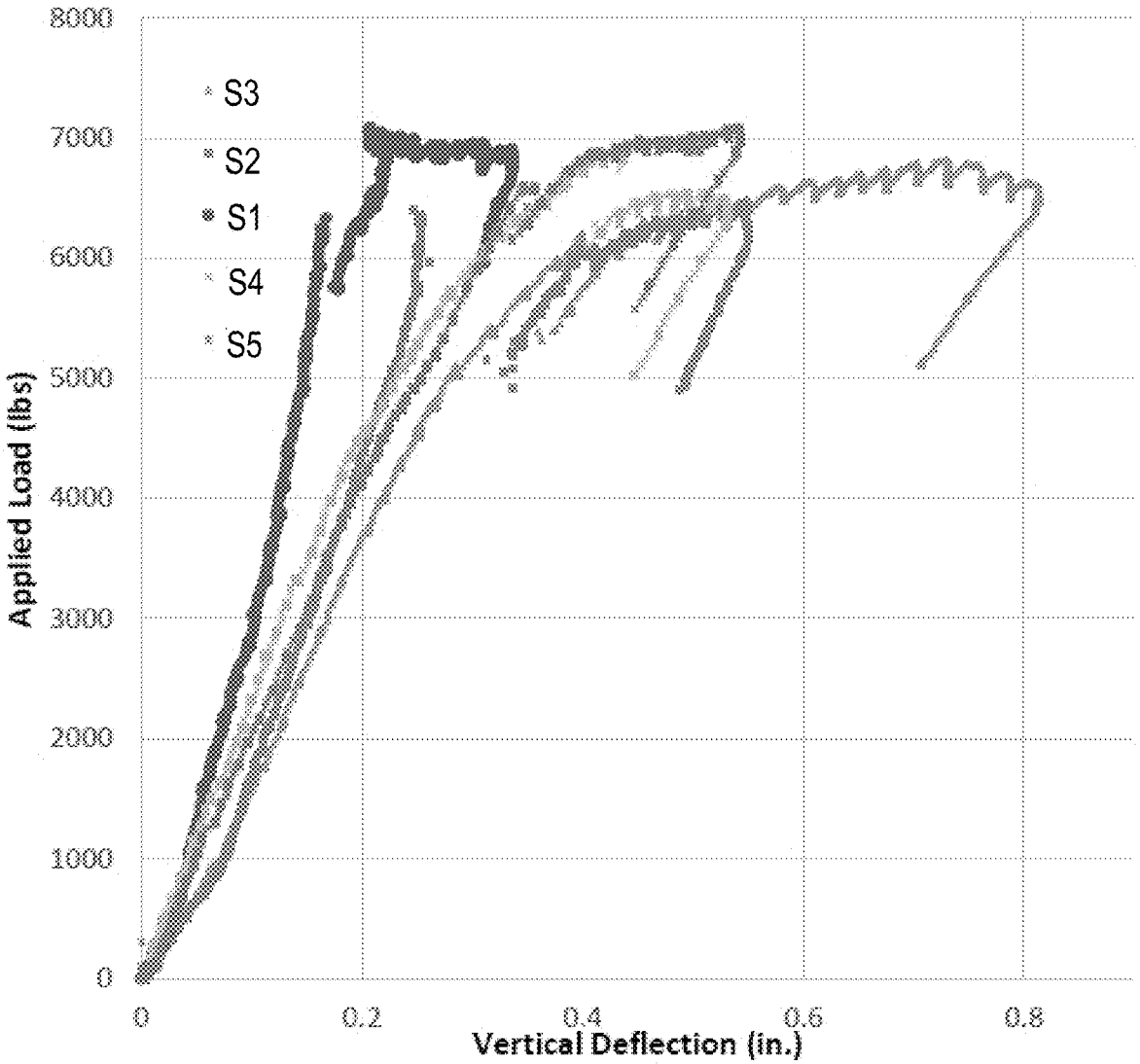
FIG. 25 is a graphical representation illustrating test results for a light-gauge, ultra-high strength weathering steel pile material of the present disclosure.

To illustrate bending resistance, multiple piles 700 having the cross-section of FIG. 24 underwent the same bend test as described, above, with respect to FIGS. 13 and 22. In a first bend test, the tested pile 700 of FIG. 24 has a height $H_{700}$ of 8 inches, a width $W_{700}$ of 4 inches, and a material thickness T of 0.062 inches (") (0.1575 mm) and is referred to as C8×4. FIG. 25 illustrates a load deflection curve for the C8×4 pile 700 of FIG. 24 with results from tests designated S1, S2, S3, S4, and S5. Sensors were located on the web for tests S1-S5. No local bucking was observed until failure. The slope of the curves of each of FIG. 25 corresponds to a moment of inertia of 6.2 $in^4$ to 5.6 $in^4$ for an elastic modulus of the steel (E) of 26,000 ksi-29,000 ksi (179 GPa-200 GPa), respectively.

Table 14, below, illustrates the maximum load and load at onset of non-linearity for the C8×4 pile 700 of FIG. 24 specimens.

TABLE 14

| Pile 700 C8 × 4 | Load at Onset of Non-Linearity (lbs) | Deflection at Onset of Non-Linearity (in.) | Maximum Load (lbs) | Deflection at Maximum Load (in.) |
|---|---|---|---|---|
| S1 | 6334 | 0.168 | 7083 | 0.25 |
| S2 | 6291 | 0.253 | 6475 | 0.546 |
| S3 | 5045 | 0.287 | 6817 | 0.73 |
| S4 | 4660 | 0.212 | 6916 | 0.439 |
| S5 | 6490 | 0.347 | 7092 | 0.543 |
| Average | 5764 | 0.253 | 6876 | 0.502 |

Table 15, below, illustrates the elastic stiffness observed during testing for the C8×4 pile 700 of FIG. 24 specimens.

TABLE 15

| Pile 700 C8 × 4 | Stiffness (k/in) | Estimated I ($in^4$) | Moment at Onset of Non-Linearity (kip * in) | Moment at Maximum Load (kip * in) |
|---|---|---|---|---|
| S1 | 37.7 | 11.3 | 114 | 127 |
| S2 | 24.9 | 7.4 | 113 | 117 |
| S3 | 17.6 | 5.3 | 91 | 123 |
| S4 | 22.0 | 6.6 | 84 | 124 |
| S5 | 18.7 | 5.6 | 117 | 128 |
| Average | 20.8 | 6.2 | 101 | 123 |

Table 16, below, illustrates deflection at 50% load for the C8×4 pile 700 of FIG. 24 specimens.

TABLE 16

| Pile 700 C8 × 4 | Deflection at 50% Load |
|---|---|
| S1 | 0.118 |
| S2 | 0.160 |
| S3 | 0.186 |
| S4 | 0.150 |
| S5 | 0.170 |
| Average | 0.167 |

Figure 26:
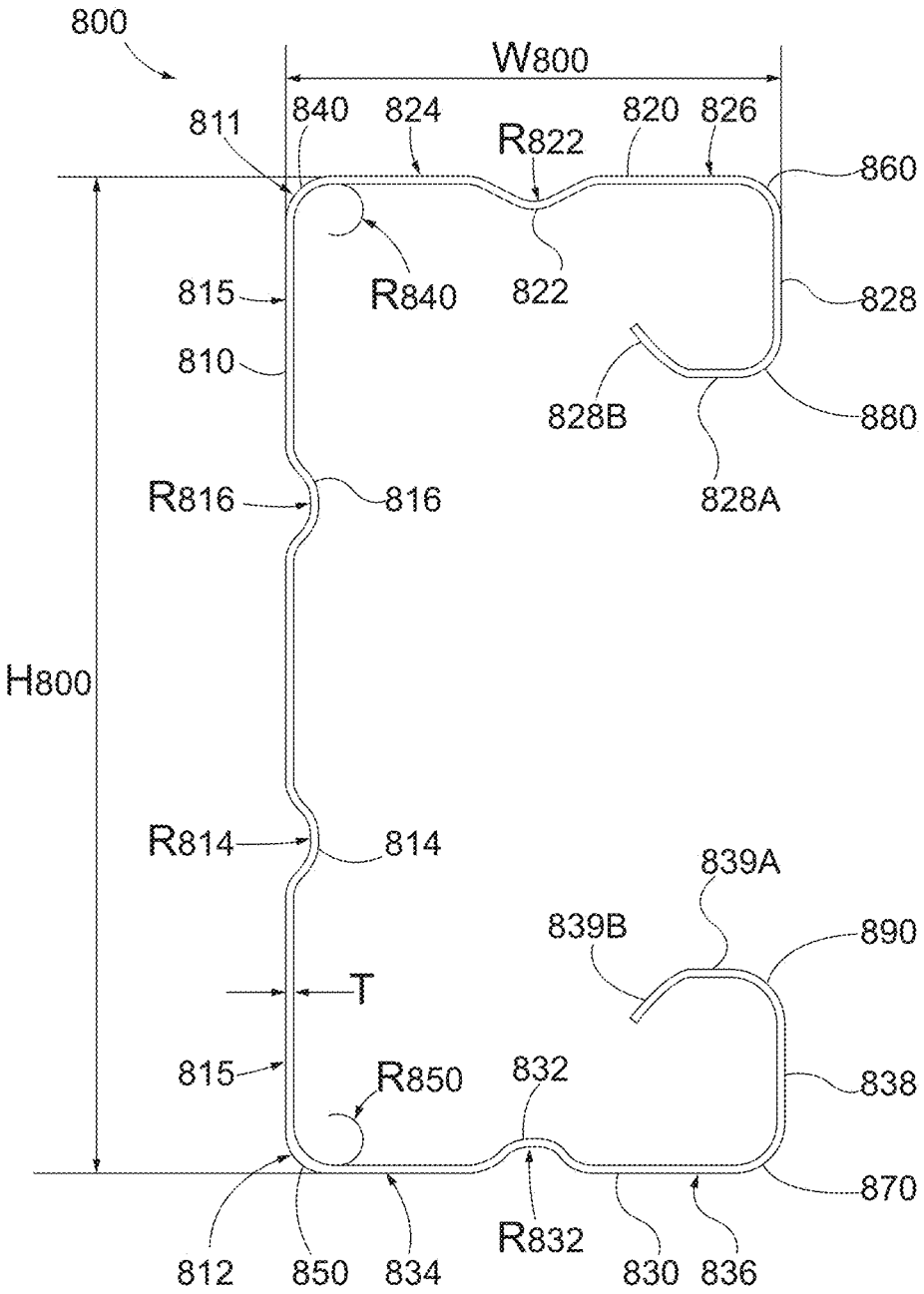
FIG. 26 is a cross-section of a C-channel shape of a pile or steel foundation cold roll formed from a thin cast steel strip according to one or more aspects of the present disclosure.

Turning now to FIG. 26, a UHSW steel pile 800 that is a C-channel comprising a web 810, a first flange 820, and a second flange 830 is illustrated and is variation of the corrugated C-channel, or NCW pile, and the C-channel pile 700 of FIG. 24. The cross-section of the steel pile 800 of FIG. 26 is substantially the same as the cross-section of the steel pile 700 of FIG. 24 with the exception of the addition of the second returns 829B and 839B to pile 800 of FIG. 26. Otherwise, similar to the pile 700 of FIG. 24, pile 800 has a web 810 that extends a height $H_{800}$ of the steel pile 800 and transitions at a curved transition 840 into the first flange 820 at a first end 811. The web 810 also transitions at a curved transition 850 into the second flange 830 at a second end 812. Each curved transition 840, 850 has a radius $R_{840}$, $R_{850}$, respectively. Each curved transition 840, 850 extends from a respective first flange 820 or second flange 830 along the arc formed by the radii $R_{840}$, $R_{850}$, respectively. The arc of the curved transition 840, 850 of FIG. 26 extend 90 degrees.

In FIG. 26, the web 810 comprises one or more discontinuities that may be characterized as corrugations that are arcs having a radius. Specifically, the first flange 820 comprises a first arc 814 formed by a radius $R_{814}$ and a second arc 816 formed by a radius $R_{816}$. In the example of FIG. 26, the first arc 814 and the second arc 816 are evenly spaced along the steel pile width $W_{800}$. The radius $R_{814,\ 816}$ extending inwardly from an outside surface 815 of the web 810.

The first flange 820 may also comprise one or more discontinuities that may be characterized as corrugations. In the example of FIG. 26, the first flange 820 comprises one flange corrugation 822 formed centrally along the steel pile width $W_{800}$. The flange corrugation 822 is an arc formed by a radius $R_{822}$ extending inwardly from between a first outside surface 824 and a second outside surface 826 of the flange 820. Opposite the web 810, a first lip 828 extends from the first flange 820 at a curved transition 860. The first lip extends in a direction of the steel pile height $H_{800}$ and is parallel to the inside surface 816 and outside surface 815 of the web 810. The first lip 828 may further comprise a curved transition 880 into a first return 829A. The first return 829A extends inwardly from the first lip 828 toward the web 810. The first return 829A is parallel to the first outside surface 824 and the second outside surface 826 of the flange 820. A second return 839B may also be provided. Like the second return 629B of pile 600 of FIG. 22, the second return 829B may returning in a direction of the web 820. More specifically, the second return 829B returns at an angle oblique to the first return 829A and toward the second flange 820. It is appreciated herein that the second return 829B may return in the opposite direction (e.g. toward the opposite flange). It is also appreciated herein that the second return 829B may return at a 90 degree angle relative the first return 829A. A pile having a second return may more generally be described as having a triple edge.

Like the first flange 820, the second flange 830 may also comprise one or more discontinuities that may be characterized as corrugations. In the example of FIG. 26, the second flange 830 comprises one flange corrugation 832 formed centrally along the steel pile width $W_{800}$. The flange corrugation 832 is an arc formed by a radius $R_{832}$ extending inwardly from between first outside surface 834 and a second outside surface 836 of the flange 830. Opposite the web 810, a second lip 838 extends from the second flange 830 at a curved transition 870. The second lip extends in a direction of the steel pile height $H_{800}$ and is parallel to the inside surface 816 and outside surface 815 of the web 810. The second lip 828 may further comprise a curved transition 890 into a first return 839A. The first return 839A extends inwardly from the lip 828 toward the web 810. The first return 839A is parallel to the first outside surface 834 and the second outside surface 836 of the second flange 830. A second return 839B may also be provided. Like the second return 639B of pile 600 of FIG. 22, the second return 839B may returning in a direction of the web 830. More specifically, the second return 839B returns at an angle oblique to the first return 839A and toward the second flange 830.

In the example of FIG. 26, the thickness T of the steel sheet forming the steel pile 800 is 0.062 inches (") (1.575 mm). In some examples, the thickness of the steel sheet forming the steel pile 800 may be 2 mm or less. In other examples, the thickness of the steel sheet forming the steel pile 800 may be 2.5 mm or less. The first flange 820 and/or the second flange 830 of the UHSW steel pile 800 of FIG. 26 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 810.

In the UHSW steel pile 800 example of FIG. 26 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the C-channel of FIG. 26 is produced from the width of the steel sheet and, thereby, has a total cross-sectional material length of 50" or less. More specifically, the total cross-sectional material length may be half or a third of the width of the steel sheet. In the example of FIG. 26, the height $H_{800}$ of the steel pile is greater than the width $W_{800}$ of the steel pile. In the example of FIG. 26, the steel pile 800 is symmetrical about an axis bisecting the height $H_{800}$ of the steel pile 800. A typical UHSW steel pile of FIG. 26 may be, for example, a C6×4, C8×4, C8×4.5, C8×5, C8×4.5, C8×5, C8×6, C10×8, C12×8 C12×10, C14×10, C14×12 (in inches), or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 27:
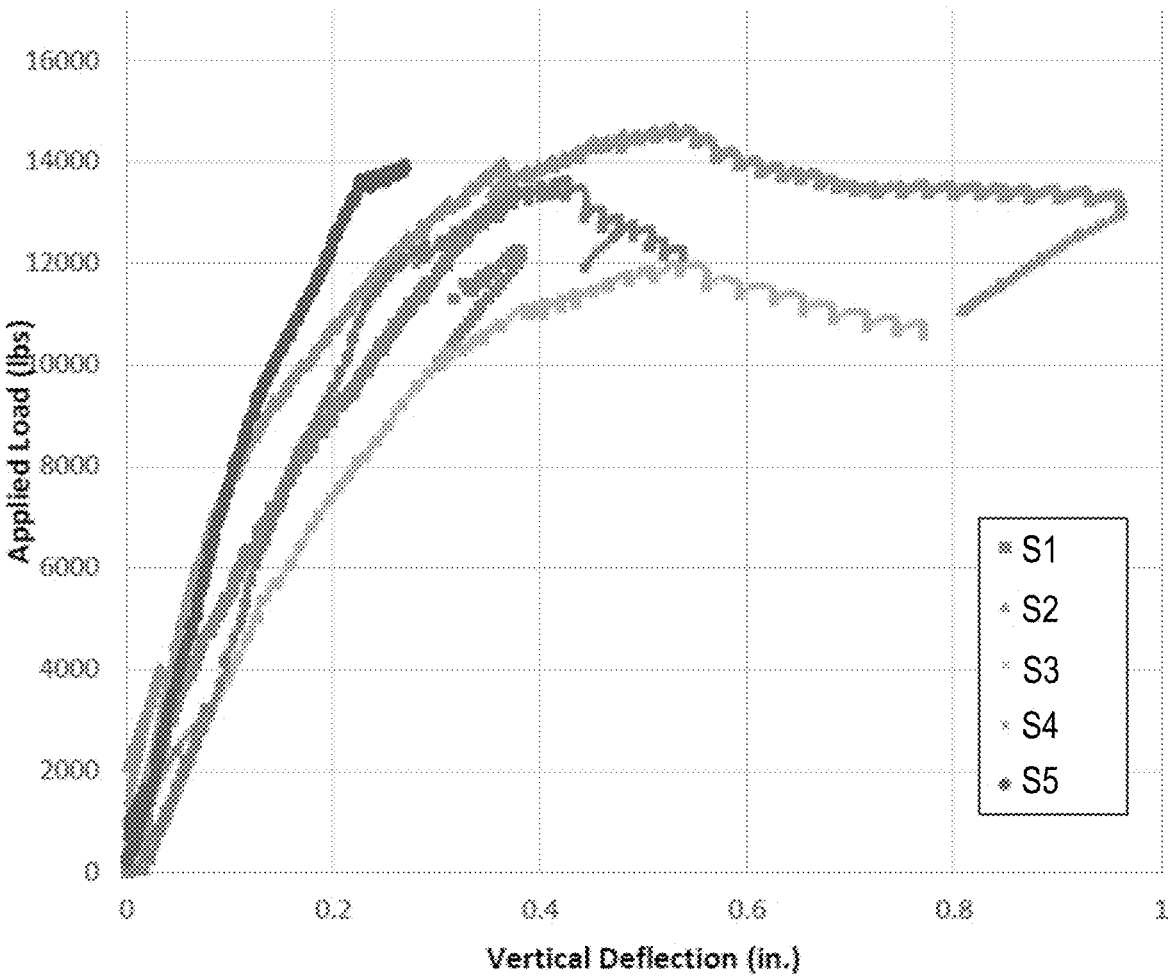
FIG. 27 is a graphical representation illustrating test results for a light-gauge, ultra-high strength weathering steel pile material of the present disclosure.

To illustrate bending resistance, multiple piles 800 of FIG. 26 underwent the same bend test as described, above, with respect to FIGS. 13, 22, and 24. In a first bend test, the tested pile 800 of FIG. 24 has a height $H_{800}$ of 8 inches, a width $W_{800}$ of 5 inches, and a material thickness T of 0.062 inches (") (0.1575 mm) and is referred to as C8×5. FIG. 27 illustrates a load deflection curve for the C8×5 pile 800 of FIG. 26 with results from tests designated S1, S2, S3, S4, and S5. Sensors were located on the web for tests S1-S5. No local bucking was observed until failure. The slope of the curves of each of FIG. 27 correspond to a moment of inertia of 11.8 $in^4$ to 13.2 $in^4$ for an elastic modulus of steel (E) of 26,000 ksi-29,000 ksi (178 GPa-200 GPa), respectively.

Table 17, below, illustrates the maximum load and load at onset of non-linearity for the specimens corresponding to the C8×5 pile 800 of FIG. 26.

TABLE 17

| Pile 800 C8 × 5 | Load at Onset of Non-Linearity (lbs) | Deflection at Onset of Non-Linearity (in.) | Maximum Load (lbs) | Deflection at Maximum Load (in.) |
|---|---|---|---|---|
| S1 | 13552 | 0.374 | 13552 | 0.374 |
| S2 | 13443 | 0.351 | 14624 | 0.548 |
| S3 | 10200 | 0.322 | 11876 | 0.52 |
| S4 | 11283 | 0.232 | 13642 | 0.42 |
| S5 | 13511 | 0.243 | 13840 | 0.284 |
| Average | 12398 | 0.304 | 13507 | 0.429 |

Table 18, below, illustrates the elastic stiffness observed during testing for the specimens corresponding to the C8×5 pile 800 of FIG. 26.

TABLE 18

| Pile 800 C8 × 5 | Stiffness (k/in) | Estimated I ($in^4$) | Moment at Onset of Non-Linearity (kip * in) | Moment at Maximum Load (kip * in) |
|---|---|---|---|---|
| S1 | 61.0 | 18.3 | 244 | 244 |
| S2 | 74.7 | 22.3 | 242 | 263 |
| S3 | 46.8 | 14.0 | 184 | 214 |
| S4 | 46.6 | 13.9 | 203 | 246 |
| S5 | 75.9 | 22.7 | 243 | 249 |
| Average | 61 | 18.2 | 218 | 243 |

Table 19, below, illustrates deflection at 50% load for the specimens corresponding to the C8×5 pile 800 of FIG. 26.

TABLE 19

| Pile 800 C8 × 5 | Deflection at 50% Load |
|---|---|
| S1 | 0.111 |
| S2 | 0.090 |
| S3 | 0.109 |
| S4 | 0.121 |
| S5 | 0.089 |
| Average | 0.104 |

Figure 28:
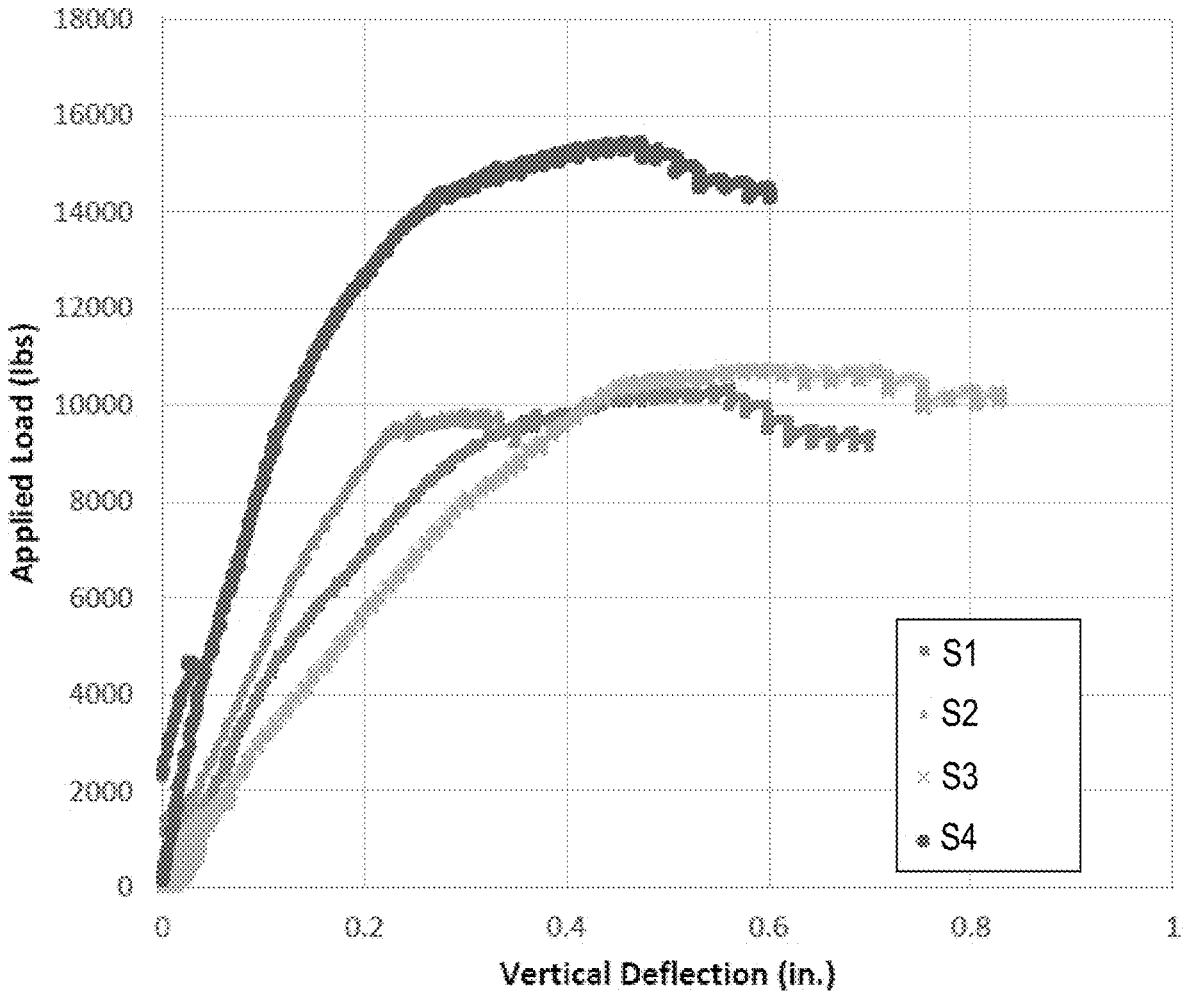
FIG. 28 is a graphical representation illustrating test results for a light-gauge, ultra-high strength weathering steel pile material of the present disclosure.

In a second bend test, the tested pile 800 of FIG. 26 has a height $H_{800}$ of 8 inches, a width $W_{800}$ of 4.5 inches, and a material thickness T of 0.062 inches (") (0.1575 mm) and is referred to as C8×4.5. FIG. 28 illustrates a load deflection curve for the C8×4.5 pile 800 of FIG. 26 with results from tests designated S1, S2, S3, and S4. Sensors were located on the web for tests S1-S4. No local bucking was observed until failure.

Table 20, below, illustrates the maximum load and load at onset of non-linearity for the specimens corresponding to the C8×4.5 pile 800 of FIG. 26.

TABLE 20

| Pile 800 C8 × 4.5 | Load at Onset of Non-Linearity (lbs) | Deflection at Onset of Non-Linearity (in.) | Maximum Load (lbs) | Deflection at Maximum Load (in.) |
|---|---|---|---|---|
| S1 | 8112 | 0.294 | 10183 | 0.589 |
| S2 | 9405 | 0.226 | 9852 | 0.3 |
| S3 | 10000 | 0.422 | 10723 | 0.61 |
| S4 | 9822 | 0.123 | 15459 | 0.456 |
| Average | 9703 | 0.324 | 11554 | 0.489 |

Table 21, below, illustrates the elastic stiffness observed during testing for the specimens corresponding to the C8×4.5 pile 800 of FIG. 26.

TABLE 21

| Pile 800 C8 × 4.5 | Stiffness (k/in) | Estimated I ($in^4$) | Moment at Onset of Non-Linearity (kip * in) | Moment at Maximum Load (kip * in) |
|---|---|---|---|---|
| S1 | 44.1 | 13.2 | 146 | 183 |
| S2 | 45.7 | 13.7 | 169 | 177 |
| S3 | 32.9 | 9.8 | 180 | 193 |
| S4 | 54.6 | 16.3 | 177 | 278 |
| Average | 44 | 13.2 | 168 | 208 |

Table 22, below, illustrates deflection at 50% load for the specimens corresponding to the C8×4.5 pile 800 of FIG. 26.

TABLE 22

| Pile 800 C8 × 4.5 | Deflection at 50% Load |
|---|---|
| S1 | 0.092 |
| S2 | 0.103 |
| S3 | 0.152 |
| S4 | 0.09 |
| Average | 0.109 |

As illustrated by the examples above, the bending resistance is greatly impacted by the details of the shapes for a steel pile made from a thin cast steel strip. Specifically, the V-shape transition 613 of pile 600 of FIG. 22 significantly increased the bending resistance in comparison to the corrugation 313 of pile 300 of FIG. 13. Moreover, multiple corrugated arcs 714, 716 of the pile 700 of FIG. 24 also increased the bending resistance in comparison to the corrugation 313 of pile 300 of FIG. 13. Lastly, adding second returns, such as the second returns 838B, 839B of pile 800 of FIG. 26, increased the bending resistance in comparison to a comparable pile 700 of FIG. 24. Thereby, these features as disclosed herein have been found to further increase the capabilities of a steel pile made from a UHSW steel pile as disclosed herein.

Figure 29:
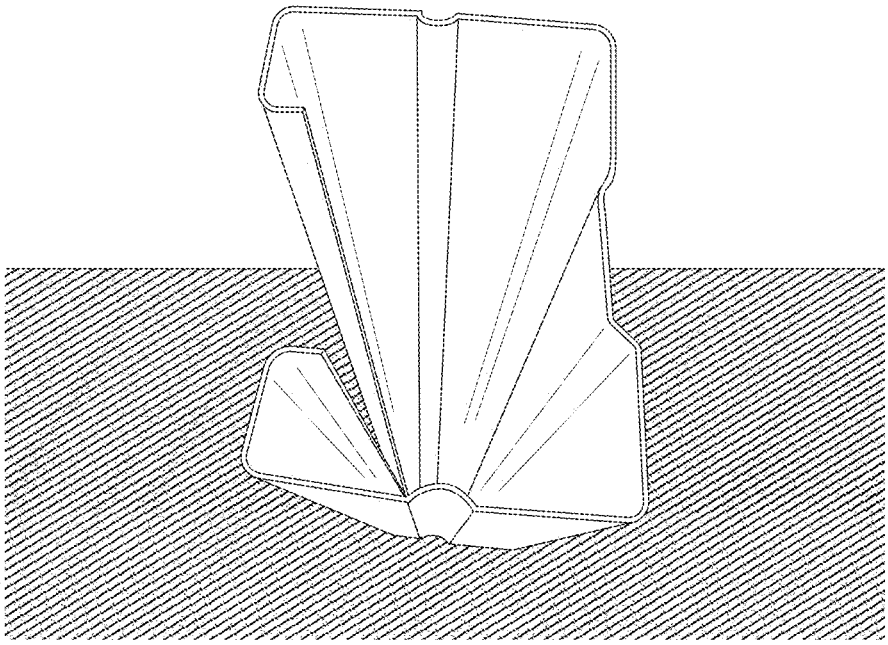
FIG. 29 is a reproduction of a top side of a UHSW steel pile of the present disclosure driven into the ground.
Figure 30:
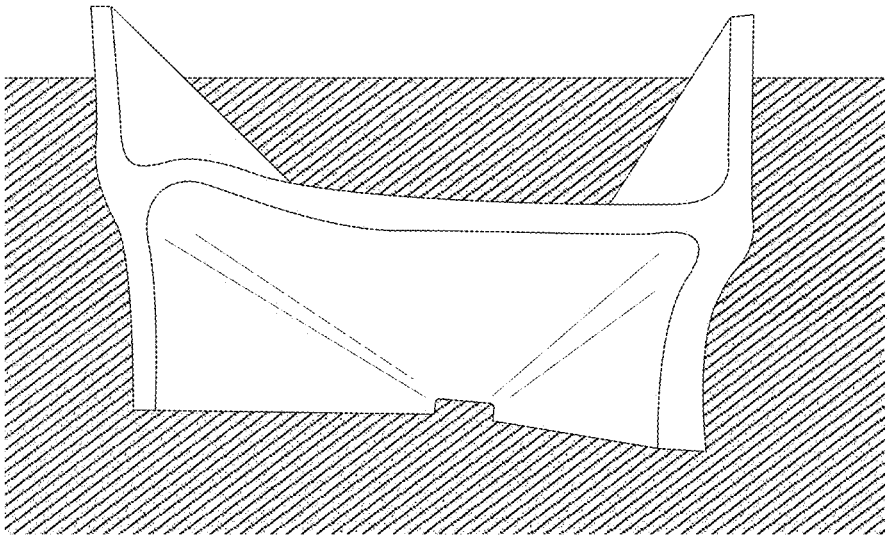
FIG. 30 (PRIOR ART)
FIG. 30 is a reproduction of a top side of a prior art wide flange beam driven into the ground.

The above bend tests, in addition to property characteristics, illustrates steel piles, and the corresponding shapes, that produce a combined hardness and toughness which can undergo the abuse of being driven into the ground while maintaining a thickness of less than or equal to 2.5 mm, less than or equal to 2.0 mm, or even less than or equal to 1.6 mm. Such a reduced thickness further provides a steel pile that is easier to be driven into the ground with significantly less resistance than piles made from much thicker material. In other words, the present UHSW steel pile, and shapes thereof, provide a product that is not only exhibits hardness but also exhibits toughness at a reduced material thickness. In contrast, prior art piles exhibit increased brittleness when hardness is increased. This dynamic is best illustrated by the comparative examples of FIGS. 29-30. FIG. 29 is a reproduction of a photo image of an UHSW steel pile 300 of the present disclosure having been driven into bedrock. The steel pile 300 of FIG. 29 has the cross-section of the steel pile 300 of FIG. 13. In contrast, FIG. 30 is a reproduction of a photo image of a steel pile 301 produced from a Grade 50 wide flange beam driven into the same bedrock. As the reproductions illustrate, the UHSW steel pile did not undergo any deformation at a top side of the pile, where the force was applied for driving the pile into the ground. In contrast, the Grade 50 wide flange beam exhibited significant deformation or damage to the top side of the pile, where the force was applied for driving the pile into the ground. This illustrates the deficiencies found in the prior art piles that is not exhibited by the presently disclosed UHSW steel pile having a reduced thickness.

Figure 31:
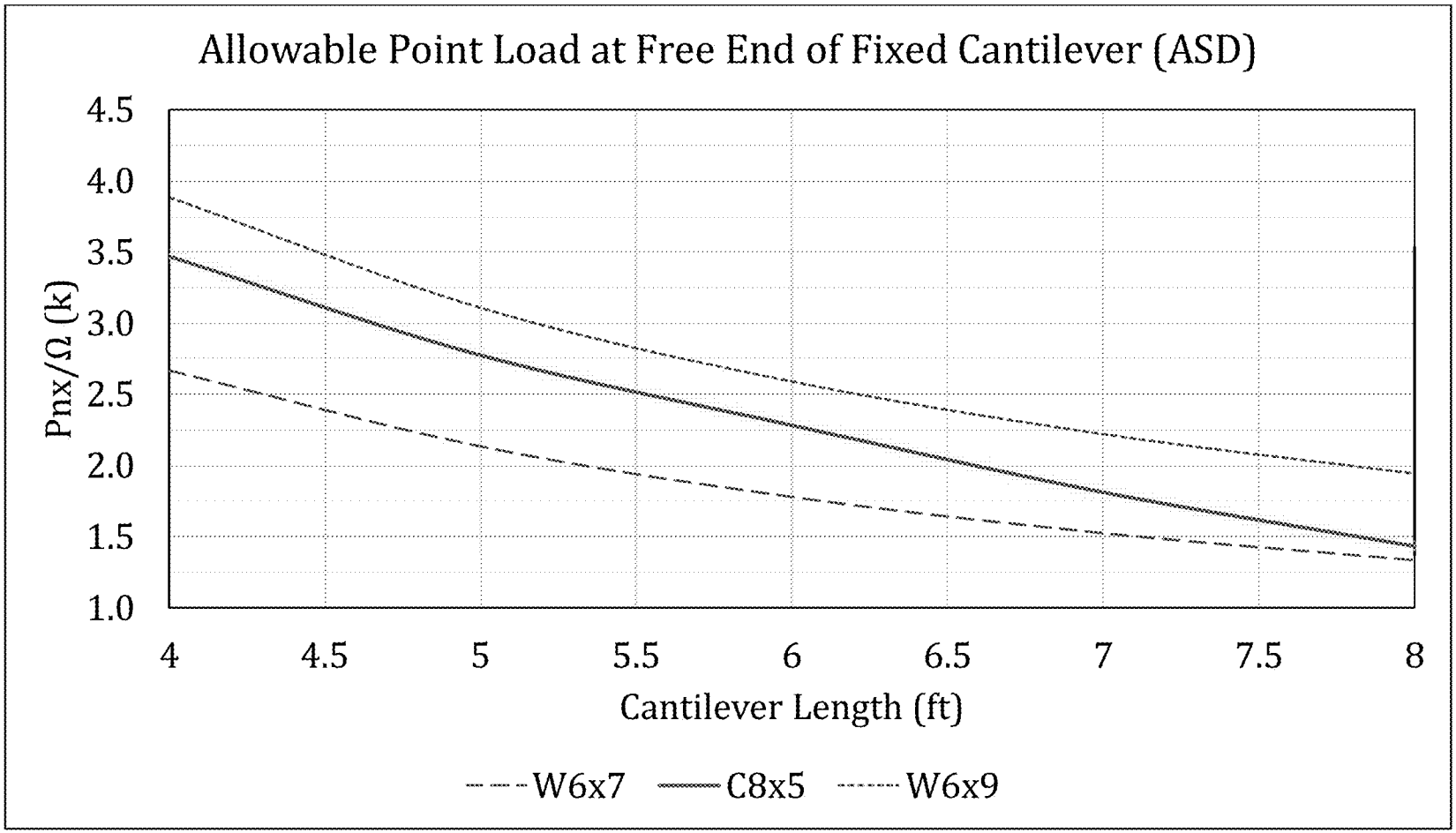
FIG. 31 is a graphical representation illustrating the allowable point load at the free end of a fixed cantilever for pile or structural foundation examples.
Figure 32:
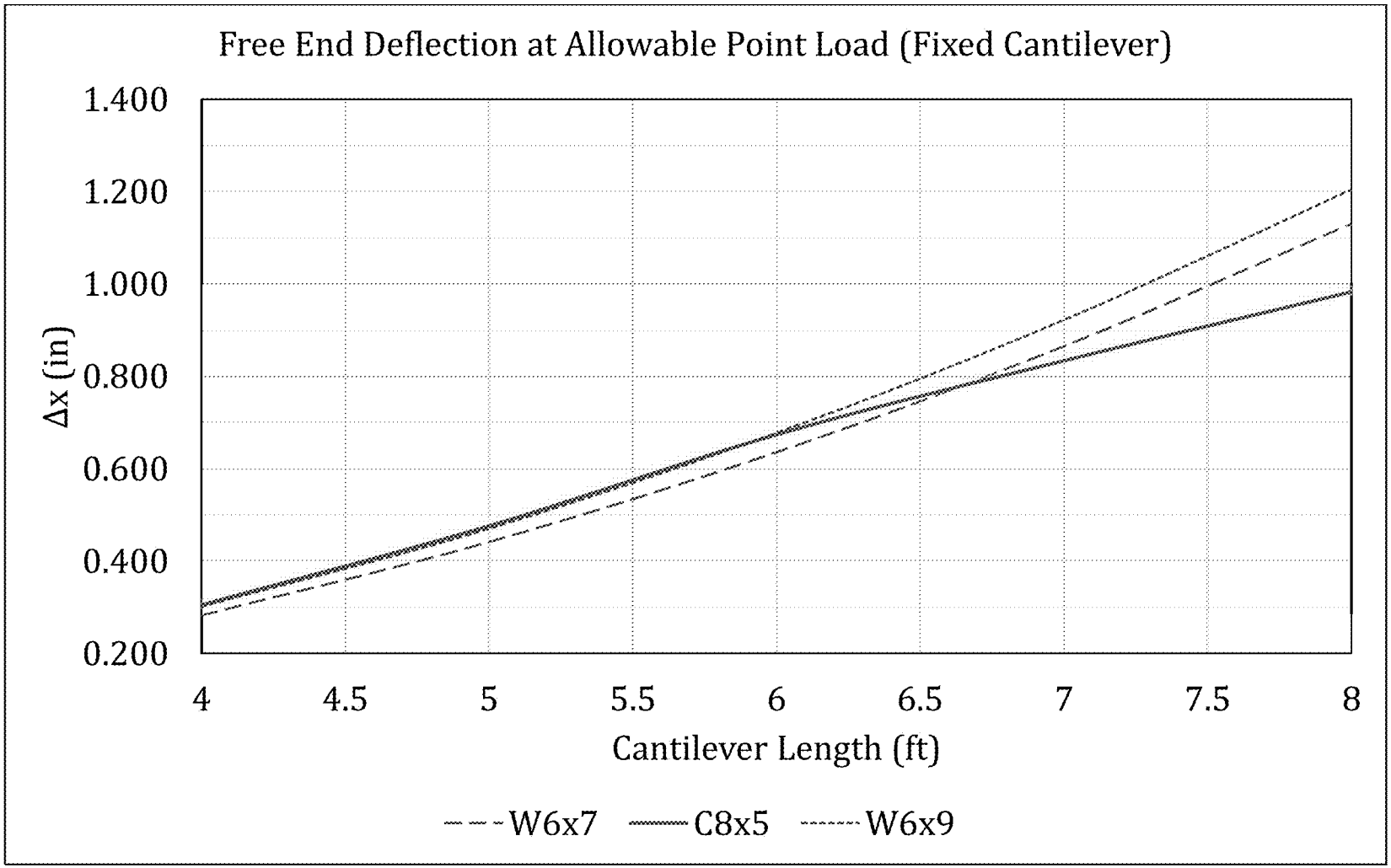
FIG. 32 is a graphical representation illustrating the free end deflection at the noted allowable point load for pile or structural foundation examples.

To further illustrate the characteristics of the UHSW steel pile of the present disclosure, the free end point load and the free end deflection at the allowable point load of an UHSW steel pile (C8×5 as noted above) are illustrated. Further, these properties for the UHSW steel pile are comparatively illustrated with prior art wide flange beam piles (Grade 50 W6×7 and Grade 50 W6.9) in FIGS. 31-32, respectively. The graph of FIG. 31 illustrates the allowable point load at the free end of a fixed cantilever for each pile. The graph of FIG. 32 illustrates the free end deflection at the noted allowable point load for each pile. This data represents the impact of a potential wind load, or force, applied to a free end of a steel pile extending from the ground. FIGS. 31-32 illustrate, in addition to the properties noted above, the UHSW steel pile of the present disclosure comparatively met, and even exceeded, the performance of the prior art piles at a reduced material thickness.

The properties of FIGS. 31-32 are reproduced below in Table 23 and Table 24. In addition, Tables 23 and 24 illustrate the same respective properties for additional prior art wide flange beams and additional UHSW steel piles, as identified throughout the present disclosures.

TABLE 23

| Allowable Point Load | | | | | | | | |
|---|---|---|---|---|---|---|---|---|
| Span Length (ft) | W6 × 9 (k) | W6 × 8.5 (k) | W6 × 7 (k) | W8 × 10 (k) | NCW-1000 (k) | C8 × 5 (k) | C8 × 4 (k) | M8 × 6 (k) |
| 4 | 3.9 | 3.5 | 2.7 | 5.5 | 1.7 | 3.469 | 3.5 | 4.1 |
| 5 | 3.1 | 2.8 | 2.1 | 4.4 | 1.3 | 2.775 | 2.8 | 3.3 |
| 6 | 2.6 | 2.3 | 1.8 | 3.6 | 0.8 | 2.282 | 2.3 | 2.8 |
| 7 | 2.2 | 2.0 | 1.5 | 3.1 | 0.5 | 1.811 | 1.8 | 2.4 |
| 8 | 1.9 | 1.7 | 1.3 | 2.7 | 0.3 | 1.431 | 1.4 | 2.0 |

TABLE 24

| Deflection at Allowable Point Load | | | | | |
|---|---|---|---|---|---|
| Span Length (ft) | W6 × 9 (in) | W6 × 8.5 (in) | W6 × 7 (in) | W8 × 10 (in) | C8 × 5 (in) |
| 4 | 0.301 | 0.298 | 0.283 | 0.226 | 0.305 |
| 5 | 0.471 | 0.465 | 0.442 | 0.353 | 0.476 |
| 6 | 0.678 | 0.669 | 0.636 | 0.508 | 0.674 |
| 7 | 0.922 | 0.911 | 0.865 | 0.691 | 0.834 |
| 8 | 1.205 | 1.190 | 1.130 | 0.903 | 0.983 |

As illustrated by the many examples above, the various features of the steel pile shapes provide improve properties. It is appreciated herein that the respective features of each steel pile shape are interchangeable and/or combinable between each of the steel pile examples herein. Specifically, the bend tests, above, illustrate several features increased the resistance of the steel pile when undergoing the bend tests. Examples of features found to increase the bend resistance of the steel pile include the V-shaped transition found on either the web and/or the flanges and/or the second returns. It has also been found the bend resistance attributed to each of these features must additionally be balanced across the cross-section of the steel pile, otherwise, the steel pile of the present disclosure may twist, warp, or fail due to localized bearing failure (as illustrated by the examples above where true local bucking failure or other buckling was not exhibited or reached before reaching localized bearing failure) without reaching its full potential. In view of this, additional pile examples 900 and 1000 have been provided below to illustrate the many additional variations to the steel pile shapes that may be undertaken by interchanging and/or combining the features across the many pile shapes disclosed above.

Figure 33:
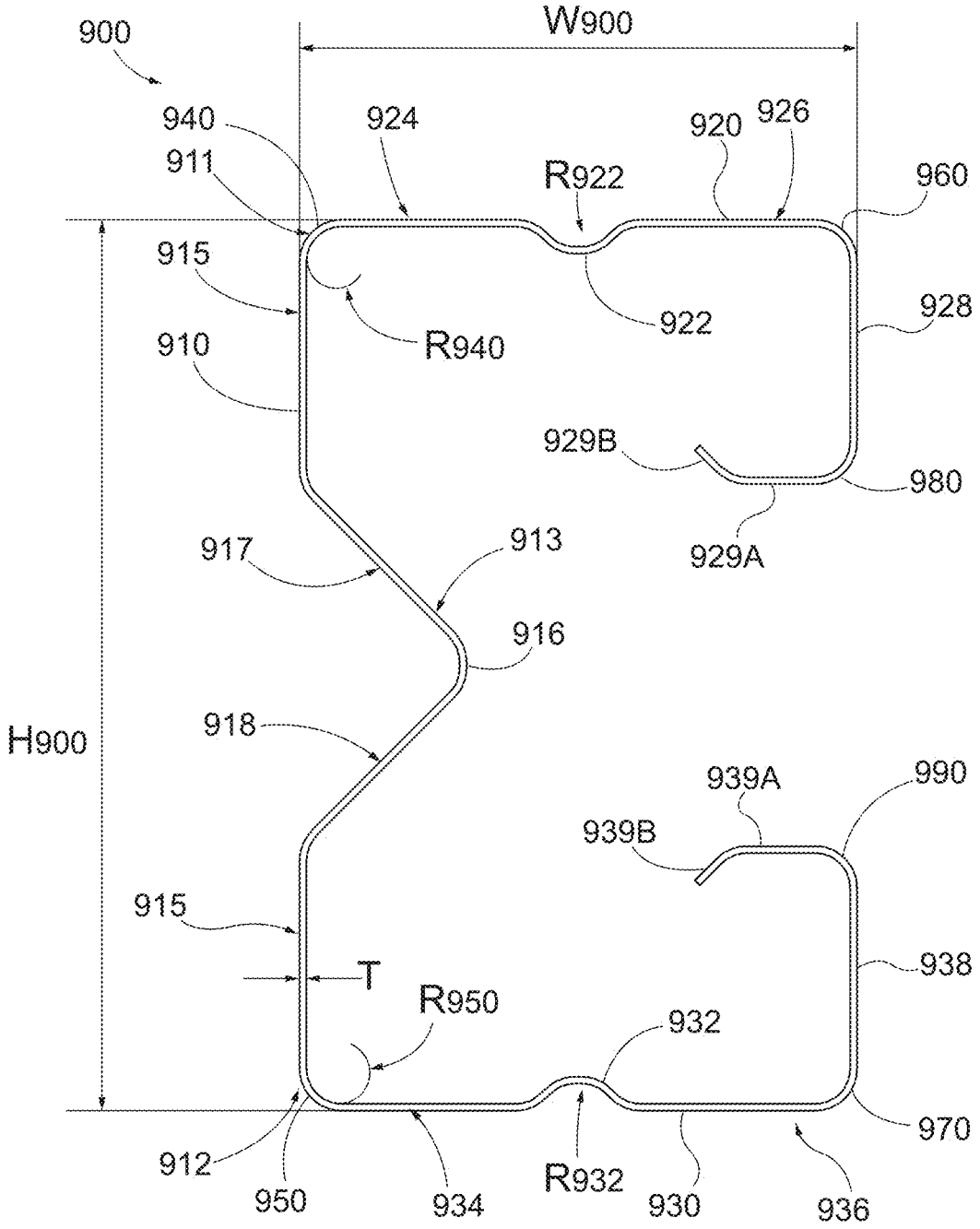
FIG. 33 is a cross-section of a shape of a pile or steel foundation cold rolled formed from a thin cast steel strip according to one or more aspects of the present disclosure.

FIG. 33 illustrates an UHSW steel pile 900 that is a variation of the M-channel of FIG. 22. The steel pile 900 of FIG. 33 comprises a web 910, a first flange 920, and a second flange 930. The web 910 of the steel pile 900 of FIG.

33 extends a height $H_{900}$ of the steel pile 900 and transitions at a curved transition 940 into the first flange 920 at a first end 911. The web 910 also transitions at a curved transition 950 into the second flange 930 at a second end 912. Each curved transition 940, 950 has a radius $R_{940}$, $R_{950}$, respectively. Each curved transition 940, 950 extends from a respective first flange 920 or second flange 930 along the arc formed by the radii $R_{940}$, $R_{650}$, respectively. The arc of the curved transition 940, 950 of FIG. 33 extend at a 90-degree angle.

In FIG. 33, the web 910 comprises a discontinuity that is a V-shaped transition 913. The V-shaped transition 913 extends the same direction as each flange 920, 930 relative the web 910. The V-shaped transition 913 is centrally positioned relative the steel pile height $H_{900}$. The apex 916 of the V-shaped transition 913 is offset from an outside surface 915 of the web 910, in the same direction the flanges extend the steel pile width $W_{900}$. The apex 916 may additionally, or alternatively, be referred to as being recessed relative the web 910 or recessed relative the outside surface 915 of the web 910. Opposing sides 917, 918 of the V-shaped transition are at oblique angles relative to the web 910. In one example, the opposing sides 917, 918 are at a right angle relative to one another.

Still referring to FIG. 33, the first flange 920 and the second flange 930 may also comprise one or more discontinuities. Unlike the example of FIG. 22, where the discontinuities of the flanges are V-shaped transitions, the discontinuities of the pile 900 of FIG. 33 are may be characterized as corrugations that are arcs. In the example of FIG. 33, the first flange 920 comprises one flange corrugation 922 formed centrally along the steel pile width $W_{900}$. The flange corrugation 922 is an arc formed by a radius $R_{922}$ extending inwardly from between a first outside surface 924 and a second outside surface 926 of the flange 920. Opposite the web 910, a first lip 928 extends from the first flange 920 at a curved transition 960. The first lip extends in a direction of the steel pile height $H_{900}$ and is parallel to the inside surface 916 and outside surface 915 of the web 910. The first lip 928 may further comprise a curved transition 980 into a first return 929A. The first return 929A extends inwardly from the first lip 928 toward the web 910. The first return 929A is parallel to the first outside surface 924 and the second outside surface 926 of the flange 920. A second return 939B may also be provided. The second return 929B may returning in a direction of the web 920. More specifically, the second return 929B returns at an angle oblique to the first return 929A and toward the second flange 920. It is appreciated herein that the second return 929B may return in the opposite direction (e.g. toward the opposite flange). It is also appreciated herein that the second return 929B may return at a 90 degree angle relative the first return 929A. A pile having a second return may more generally be described as having a triple edge.

Like the first flange 920, the second flange 930 may also comprise one or more discontinuities that may be characterized as corrugations. In the example of FIG. 33, the second flange 930 comprises one flange corrugation 932 formed centrally along the steel pile width $W_{900}$. The flange corrugation 932 is an arc formed by a radius $R_{932}$ extending inwardly from between first outside surface 934 and a second outside surface 936 of the flange 930. Opposite the web 910, a second lip 938 extends from the second flange 930 at a curved transition 970. The second lip extends in a direction of the steel pile height $H_{900}$ and is parallel to the inside surface 916 and outside surface 915 of the web 910. The second lip 928 may further comprise a curved transition 990 into a first return 939A. The first return 939A extends inwardly from the lip 928 toward the web 910. The first return 939A is parallel to the first outside surface 934 and the second outside surface 936 of the second flange 930. A second return 939B may also be provided. The second return 939B may returning in a direction of the web 930. More specifically, the second return 939B returns at an angle oblique to the first return 939A and toward the second flange 930.

In the example of FIG. 33, the thickness T of the steel sheet forming the steel pile 900 is 0.062 inches (") (1.575 mm). In some examples, the thickness of the steel sheet forming the steel pile 900 may be 2 mm or less. In other examples, the thickness of the steel sheet forming the steel pile 900 may be 2.5 mm or less. The first flange 920 and/or the second flange 930 of the UHSW steel pile 900 of FIG. 33 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 910.

In the UHSW steel pile 900 example of FIG. 33 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the steel pile 900 of FIG. 33 is produced from the width of the steel sheet and, thereby, has a total cross-sectional material length of 50" or less. More specifically, the total cross-sectional material length may be half or a third of the width of the steel sheet. At the V-shaped transition and corrugations, the material thickness T is maintained at each layer and transition. In the example of FIG. 33, the height $H_{700}$ of the steel pile is greater than the width $W_{700}$ of the steel pile. In the example of FIG. 33, the steel pile 900 is symmetrical about an axis bisecting the height $H_{900}$ of the steel pile 900. A typical UHSW steel pile of FIG. 33 may be, for example, a 6×4, 8×4.5, 8×5, 8×6, 10×8, 12×8 12×10, 14×10, 14×12 (in inches), or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

Figure 34:
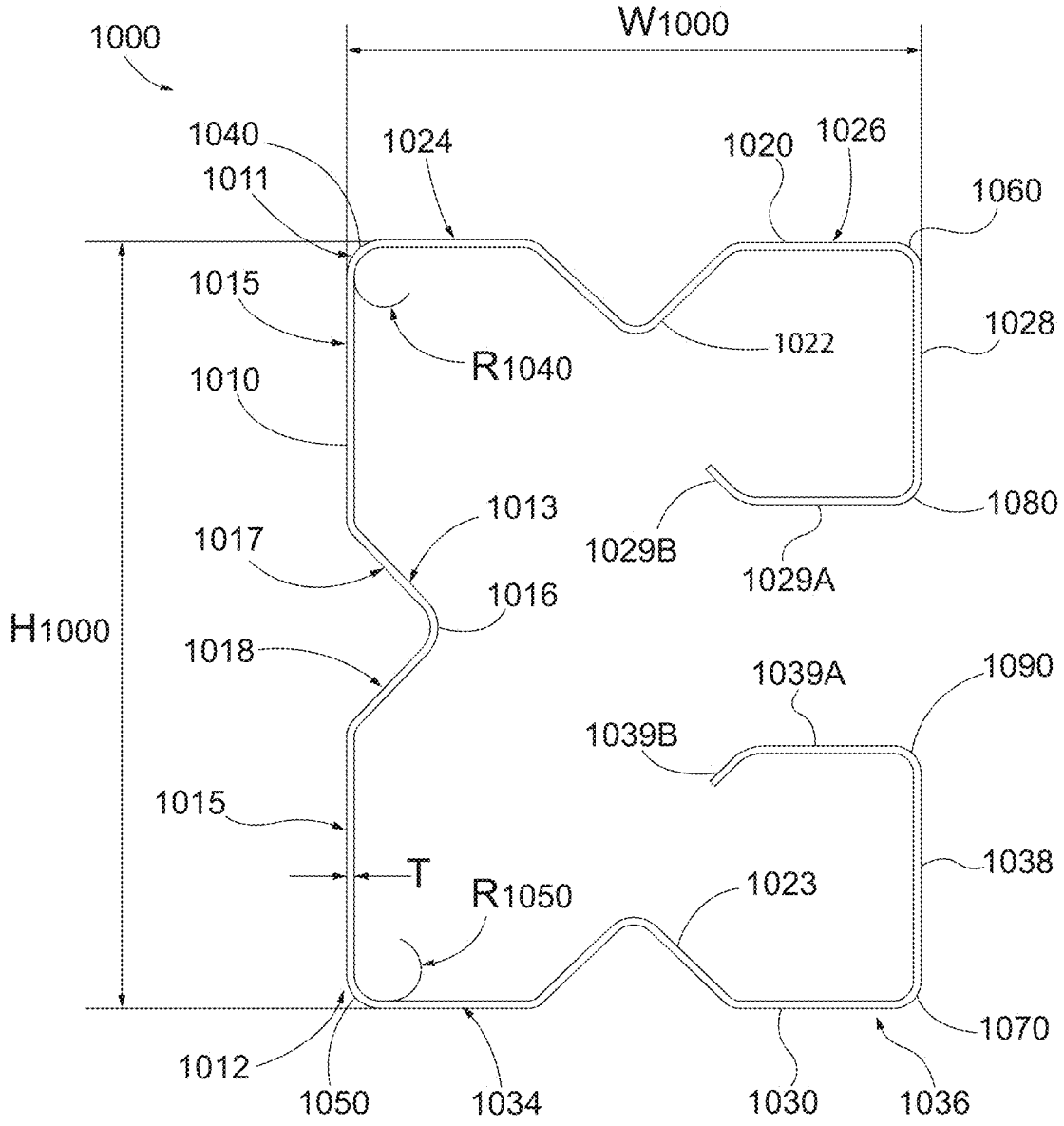
FIG. 34 is a cross-section of a shape of a pile or steel foundation cold rolled formed from a thin cast steel strip according to one or more aspects of the present disclosure.

Turning now to FIG. 34, a UHSW steel pile 1000 comprises a web 1010, a first flange 1020, and a second flange 1030 and, more specifically, is a variation of the corrugated M-channel of FIG. 22. Like the steel pile of FIG. 22, the web 1010 of the steel pile 1000 of FIG. 34 extends a height $H_{1000}$ of the steel pile 1000 and transitions at a curved transition 1040 into the first flange 1020 at a first end 1011. The web 1010 also transitions at a curved transition 1050 into the second flange 1030 at a second end 1012. Each curved transition 1040, 1050 has a radius $R_{1040}$, $R_{1050}$, respectively. Each curved transition 1040, 1050 extends from a respective first flange 1020 or second flange 1030 along the arc formed by the radii $R_{1040}$, $R_{1050}$, respectively. The arc of the curved transition 1040, 1050 of FIG. 34 extend 90 degrees.

In FIG. 34, the web 1010 comprises a discontinuity that is a V-shaped transition 1013. The V-shaped transition 1013 extends the same direction as each flange 1020, 1030 relative the web 1010. The V-shaped transition 1013 is centrally positioned relative the steel pile height $H_{1000}$. The apex 1016 of the V-shaped transition 1013 is offset from an outside surface 1015 of the web 1010, in the same direction the flanges extend the steel pile width $W_{1000}$. The apex 1016 may additionally, or alternatively, be referred to as being recessed relative the web 1010 or recessed relative the outside surface 1015 of the web 1010. Opposing sides 1017, 1018 of the V-shaped transition are at oblique angles relative to the web 1010. In one example, the opposing sides 1017, 1018 are at a right angle relative to one another.

Still referring to FIG. 34, the first flange 1020 may also comprise one or more discontinuities where the discontinuities are V-shaped transitions. In the example of FIG. 34, the first flange 1020 comprises one V-shaped transition 1022 formed centrally along the steel pile width $W_{1000}$. In some examples, corrugations, arcs, and/or V-shaped transitions may be interchanged and/or combined on or between the flanges and webs of a single pile. In FIG. 34, the V-shaped transition 1022 extends inwardly from a first outside surface 1024 and a second outside surface 1026 of the flange 1020. Opposite the web 1010, a first lip 1028 extends from the first flange 1020 at a curved transition 1060. The first lip extends in a direction of the steel pile height $H_{1000}$ and is parallel to the outside surface 1015 of the web 1010. The first lip 1028 may further comprise a curved transition 1080 into a first return 1029A. The first return 1029A extends inwardly from the first lip 1028 toward the web 1010. The first return 1029A is parallel to the first outside surface 1024 and the second outside surface 1026 of the flange 1020. A second return 1039B may also be provided. The second return 1029B may returning in a direction of the web 1020. More specifically, the second return 1029B returns at an angle oblique to the first return 1029A and toward the second flange 1020. It is appreciated herein that the second return 1029B may return in the opposite direction (e.g. toward the opposite flange). It is also appreciated herein that the second return 1029B may return at a 90-degree angle relative the first return 1029A. A pile having a second return may more generally be described as having a triple edge.

Like the first flange 1020, the second flange 1030 may also comprise one or more discontinuities where the discontinuities are V-shaped transitions. In the example of FIG. 34, the second flange 1030 comprises one V-shaped transition 1032 formed centrally along the steel pile width $W_{1000}$. In some examples, corrugations, arcs, and/or V-shaped transitions may be interchanged and/or combined on or between the flanges and webs of a single pile. In FIG. 34, the V-shaped transition 1032 extends inwardly from a first outside surface 1034 and a second outside surface 1036 of the flange 1030. Opposite the web 1010, a first lip 1038 extends from the second flange 1030 at a curved transition 1070. The first lip extends in a direction of the steel pile height $H_{1000}$ and is parallel to the outside surface 1015 of the web 1010. The first lip 1038 may further comprise a curved transition 1090 into a first return 1039A. The first return 1039A extends inwardly from the lip 1028 toward the web 1010. The first return 1039A is parallel to the first outside surface 1034 and the second outside surface 1036 of the second flange 1030. A second return 1039B may also be provided. The second return 1039B may returning in a direction of the web 1030. More specifically, the second return 1039B returns at an angle oblique to the first return 1039A and toward the second flange 1030.

In the example of FIG. 34, the thickness T of the steel sheet forming the steel pile 1000 is 0.062 inches (") (1.575 mm). In some examples, the thickness of the steel sheet forming the steel pile 1000 may be 2 mm or less. In other examples, the thickness of the steel sheet forming the steel pile 1000 may be 2.5 mm or less. The first flange 1020 and/or the second flange 1030 of the UHSW steel pile 1000 of FIG. 34 may additionally comprise one or more thru-holes and/or one or more slots. The thru-holes and the slots may be provided for securing items to the steel pile such as, for example, a solar arrangement, highway barriers, or the like. One or more thru-holes and/or one or more slots may additionally, or alternatively, be provided in the web 1010.

In the UHSW steel pile 1000 example of FIG. 34 the UHSW steel pile comprises a constant thickness T. The constant thickness may be less than or equal to 2.5 mm, less than or equal to 2.0 mm, or less than or equal to 1.6 mm. The constant thickness T is maintained through each of the features as described above. More specifically, the constant thickness is a product of cold forming the UHSW steel pile from a steel sheet. In one example, the width of the steel sheet is 50". The profile of the pile 1000 of FIG. 34 is produced from the width of the steel sheet and, thereby, has a total cross-sectional material length of 50" or less. More specifically, the total cross-sectional material length may be half or a third of the width of the steel sheet. At the V-shaped transitions, the material thickness T is maintained at each layer and transition. In the example of FIG. 34, the height $H_{1000}$ of the steel pile is greater than the width $W_{1000}$ of the steel pile. In the example of FIG. 34, the steel pile 1000 is symmetrical about an axis bisecting the height $H_{1000}$ of the steel pile 1000. A typical UHSW steel pile of FIG. 34 may be, for example, a 6×4, 8×4.5, 8×5, 8×6, 10×8, 12×8 12×10, 14×10, 14×12 (in inches), or the like. In examples the web, or the height, may be in a range of 6-12 inches and the flanges, or the width, may be in a range of 2-8 inches. In other examples, the web, or the height, may be in a range of 4-14 inches and the flanges, or the width, may be in the range of 1-10 inches.

As described with respect to each of the shapes above an arc may comprise one or more flat sections or flats at a transition. For example, the web corrugation 313 of FIG. 13 is a flat positioned between several true arcs where the corrugation 313 of FIG. 13 transitions from the web 310. As used herein, it is understood that the term arc may include one or more flats as it transitions. The flats may separate two 45θ arcs separated by a flat to form a 90° arc. Alternatively, each of the arcs as described herein may be a true arc. A true arc is an arc that does not include a flat. In other words, in the present disclosure an arc may be relied on to define a curved transition that may be a combination of arcs and flats and a true arc defines curved transitions that are curvatures, alone. Each of the arcs mentioned above may, alternatively, be a true arc. The flats of an arc, or transition, are often relied on as a practical component of cold roll forming where it is necessary to include a flat in an arc to complete or for the ease of the cold roll forming process. These flats additionally provide stiffening characteristics to the discontinuities. Typically, a flat of 1× the thickness T (e.g., 1 times the thickness, or equal to the thickness) of the material in each of the examples above may be provided at each transition in the arc (e.g., the entry of the arc, at each 45° of the arc, the exit of the arc, etc.). However, in some instances the flats, themselves, may give shape to the discontinuity additionally defined here. Specifically, and as noted above, the web corrugation 313 of FIG. 13 is simply a flat well in excess of 1× the thickness T of the material between multiple arcs. Additionally, the V-shaped discontinuity also comprises flats such as the opposing sides 617, 618 of the V-shaped discontinuity of FIG. 22. An arc may additionally be provided between the flats that are the opposing sides 617, 618 of the V-shaped discontinuity. Therefore, it may be said that each discontinuity (e.g., arc, V-shape transition, curved transition, etc.) may comprise one or more flats that are at least 1× the thickness T of the material with the exception of when a true arc is relied on herein. Therefore, in some examples a discontinuity of a web and/or flange may be a combination of a true arc, a flat, a true arc, a flat, and so on where the flat is at least 1× the thickness. In some examples the flat may be greater than 1× (e.g. at least 2×, at least 3×, at least 4×, at least 5×, etc.) the thickness, thereby, giving additional shape to the discontinuity between the true arcs of the transition. In other examples a discontinuity of a web and/or a flange may be a true arc, alone. In yet other examples a discontinuity of a web and/or flange may be a combination of a true arc and an arc having flats.

Figure 35:
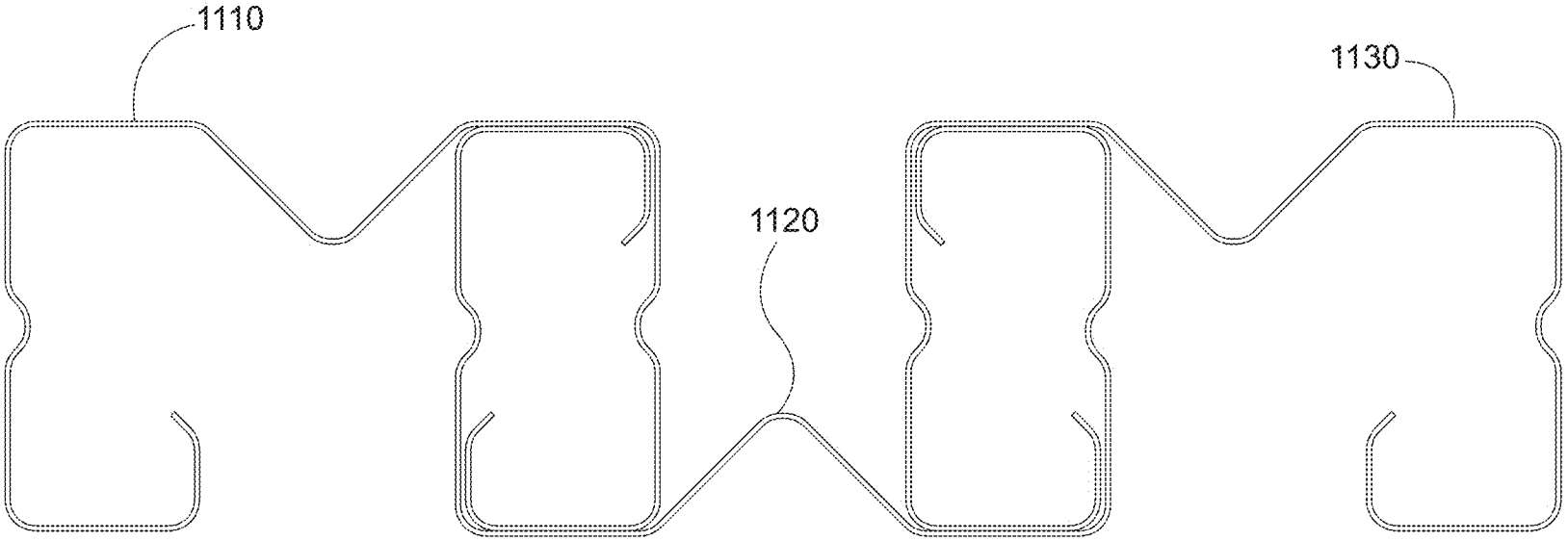
FIG. 35 is an example of a nesting arrangement of steel piles or steel foundations of the present disclosure.

The UHSW steel piles of the present disclosure also provide improvements for packaging and freight. FIG. 35 illustrates a nesting arrangement for a channel shape of an example of the UHSW steel pile of the present disclosure. The shape relied on in this specific example is the shape as described and illustrated with respect to FIG. 33 of the present disclosure. It is appreciated herein that additional shapes disclosed herein may also be relied on in such a nesting arrangement. The nesting arrangement of FIG. 35 includes three piles 1110, 1120, and 1130 arranged in an overlapping and interlocking configuration with one another. The first pile 1110 is positioned with a web in an upright arrangement with the second pile 1120 positioned with a web in an inverted arrangement while a third pile 1130 is positioned with a web in an upright arrangement. One flange of the first pile overlaps a flange of the second pile 1120 while one flange of the third pile 1130 overlaps the other flange of the second pile 1120 in the nesting arrangement. Additional piles may be added to the nesting arrangement for transport and multiple nesting arrangements may be further stacked. The stacked nesting arrangements may be provided on pallets for additional mobility. The ability to provide a nesting arrangement in combination with the reduced material thickness provides increased freight efficiency by reducing the weight and space requirements for transport. Specifically, up to twice as many steel piles of the present disclosure may be provided per transport vehicle in comparison to conventional piles. Moreover, because the nesting arrangement has an interlocking arrangement between the piles the nesting arrangement increases the stability of the load being transported.

In summary, some examples an ultra-high strength weathering steel pile comprise an as cast material having a thickness of less than or equal to 2.5 mm, less than or equal to 2.0 mm, or less than or equal to 1.6 mm. The as cast material thickness is a thin cast steel strip cold roll formed into a steel pile having a web and one or more flanges with a corrosion index of 6.0 or greater. The ultra-high strength weathering steel pile may further comprise a material yield strength of between 700 and 1600 MPa, a material tensile strength of between 1000 and 2100 MPa, and a material elongation of between 1% and 10%. The material composition of the ultra-high strength weathering steel pile may include an amount of nickel sufficient for shifting a peritectic point away from the carbon region and/or increasing a transition temperature of the peritectic point to form a carbon alloy steel strip having a microstructure of at least 75% by volume martensite or martensite plus bainite.

An UHSW steel pile may be a steel pile comprising a web and one or more flanges, or of one of the shapes described above, formed from a carbon alloy steel strip having a composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum where the carbon alloy steel strip has a microstructure having at least 75% by volume martensite or martensite plus bainite, a yield strength of between 700 and 1600 MPa, a tensile strength of between 1000 and 2100 MPa, an elongation of between 1% and 10%, and has a corrosion index of 6.0 or greater. In one example, the steel pile may be cold roll formed from a carbon alloy steel strip cast at a cast thickness less than or equal to 2.5 mm. In another example, the steel pile may be cold roll formed from a steel strip less than or equal to 2.0 mm or less than or equal to 1.6 mm. In still yet, another example, the steel pile may be cold roll formed from a steel sheet that is between 1.4 mm to 1.5 mm or of 1.4 mm or 1.5 mm in thickness. The steel piles may be channels, such as C-channels, M-channels, box channels, double channels, or the like. The steel piles may, additionally or alternatively, be I-shaped members, angles, structural tees, hollow structural sections, double angles, S-shapes, tubes, or the like. Moreover, many of these members may be connected together, e.g. welded together, to form a single steel pile. It is appreciated herein, additional products may be made from a light-gauge, ultra-high strength weathering steel sheet. Additionally, it is appreciated herein, additional products may be made from an ultra-high strength weathering steel that is not produced through a twin roll caster but, instead, an ultra-high strength product may be produced through other methods.

Additional examples of an ultra-high strength weathering steel are provided below:

A light-gauge, ultra-high strength steel sheet comprising: a carbon alloy steel strip cast at a cast thickness less than or equal to 2.5 mm having a composition comprising:

(i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting;

wherein in the composition the nickel shifts a peritectic point away from the carbon region and/or increases a transition temperature of the peritectic point to form the carbon alloy steel strip having a microstructure having at least 75% by volume martensite or martensite plus bainite, a yield strength of between 700 and 1600 MPa, a tensile strength of between 1000 and 2100 MPa and an elongation of between 1% and 10% that is defect free.

In an example of the above, the light-gauge, ultra-high strength steel sheet has a microstructure having at least 75% by volume martensite. In another example of the above, the light-gauge, ultra-high strength steel sheet has a microstructure having at least 90% by volume martensite. In yet another example of the above, the light-gauge, ultra-high strength steel sheet has a microstructure having at least 95% martensite.

In an example of the above, the light-gauge, ultra-high strength steel sheet comprises less than 5 ppm boron.

In an example of the above, the light-gauge, ultra-high strength steel sheet comprises between 0.05% and 0.12% niobium.

In an example of the above, the martensite in the steel sheet comes from an austenite grain size of greater than 100 μm.

In an example of the above, the martensite in the steel sheet comes from an austenite grain size of greater than 150 μm.

In an example of the above, the steel sheet may additionally be hot rolled to between 15% and 50% reduction before rapidly cooling.

In an example of the above, the carbon alloy steel sheet is hot rolled to a hot roll thickness of between a 15% and 35% reduction of the cast thickness before rapidly cooling.

In an example of the above, the steel sheet is a weathering steel having a corrosion index of 6.0 or greater.

A method of making a light-gauge, ultra-high strength weathering steel sheet comprising the steps of:

(a) preparing a molten steel melt comprising:
  (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, silicon killed with less than 0.01% aluminum, and
  (ii) the remainder iron and impurities resulting from melting;
(b) forming the melt into a casting pool supported on casting surfaces of a pair of cooled casting rolls having a nip there between;
(c) counter rotating the casting rolls and solidifying at a heat flux greater than 10.0 MW/m2 the molten melt into a steel sheet to less than 2.5 mm in thickness delivered downwardly from the nip and cooling the sheet in a non-oxidizing atmosphere to below 1100° C. and above the Ar3 temperature at a cooling rate greater than 15° C./s; and
(d) rapidly cooling to form a steel sheet with a microstructure having at least 75% by volume martensite or martensite plus bainite, a yield strength of between 700 and 1600 MPa, a tensile strength of between 1000 and 2100 MPa and an elongation of between 1% and 10% wherein the nickel shifts the peritectic point away from the carbon region and/or increases a transition temperature of the peritectic point for inhibiting crack, or defect, formation in a high strength martensitic steel sheet.

In an example of the above, the microstructure has at least 75% by volume martensite. In another example of the above, the microstructure has at least 90% by volume martensite. In yet another example of the above, the microstructure has at least 95% by volume martensite.

In an example of the above, the carbon alloy steel sheet is formed with less than 5 ppm boron.

In an example of the above, the carbon alloy steel sheet comprises between 0.05% and 0.12% niobium.

In an example of the above, the martensite in the steel sheet comes from an austenite grain size of greater than 100 μm.

In an example of the above, the martensite in the steel sheet comes from an austenite grain size of greater than 150 μm.

In an example of the above, the steel sheet is hot rolled to a hot roll thickness of between a 15% and 50% reduction of the cast thickness before rapidly cooling.

In an example of the above, the steel sheet is hot rolled to a hot roll thickness of between a 15% and 35% reduction of the cast thickness before rapidly cooling.

In an example of the above, the high strength steel sheet is defect free.

Also disclosed is a steel pile comprising a web and one or more flanges cold roll formed from a carbon alloy steel sheet cast at a cast thickness less than or equal to 2.5 mm having a composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum where the carbon alloy steel sheet has a microstructure having at least 75% by volume martensite or martensite plus bainite, a yield strength of between 700 and 1600 MPa, a tensile strength of between 1000 and 2100 MPa, an elongation of between 1% and 10% and is defect free.

In an example of the above, the light-gauge, ultra-high strength steel sheet has a microstructure having at least 75% by volume martensite. In another example of the above, the light-gauge, ultra-high strength steel sheet has a microstructure having at least 90% by volume martensite. In yet another example of the above, the light-gauge, ultra-high strength steel sheet has a microstructure having at least 95% martensite.

In an example of the above, the carbon alloy steel sheet of the steel pile comprises less than 5 ppm boron.

In an example of the above, the carbon alloy steel sheet of the steel pile comprises between 0.05% and 0.12% niobium.

In an example of the above, the martensite in the steel pile comes from an austenite grain size of greater than 100 μm.

In an example of the above, the martensite in the steel pile comes from an austenite grain size of greater than 150 μm.

In an example of the above, the steel sheet may additionally be hot rolled to between 15% and 50% reduction before rapidly cooling.

In an example of the above, the carbon alloy steel sheet is hot rolled to a hot roll thickness of between a 15% and 35% reduction of the cast thickness before rapidly cooling.

In an example of the above, the carbon alloy steel sheet is a weathering steel having a corrosion index of 6.0 or greater.

High Friction Rolled High Strength Weathering Steel

In the following examples, a high friction rolled high strength weathering steel sheet is disclosed. An example of an ultra-high strength weathering steel sheet is made by the steps comprising: (a) preparing a molten steel melt comprising: (i) by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. and above $Ar_3$ temperature at a cooling rate greater than 15° C./s before rapidly cooling; (c) high friction rolling the thin cast steel strip to a hot rolled thickness of between a 15% and 50% reduction of the as cast thickness producing a hot rolled steel strip primarily free, substantially free, or free of prior austenite grain boundary depressions and having a smear pattern; and (d) rapidly cooling to form a steel sheet with a microstructure having by volume at least 75% martensite or at least 75% martensite plus bainite, a yield strength of between 700 and 1600 MPa, a tensile strength of between 1000 and 2100 MPa and an elongation of between 1% and 10%. Here and elsewhere in this disclosure elongation means total elongation. "Rapidly cooling" means to cool at a rate of more than 100° C./s to between 100 and 200° C. Rapidly cooling the present compositions, with an addition of nickel, achieves up to more than 95% martensitic phase steel strip. In one example, rapidly cooling forms a steel sheet with a microstructure having by volume at least 95% martensite or at least 95% martensite plus bainite. The addition of nickel must be sufficient enough to shift the 'peritectic point' away from the carbon region that would otherwise be present in the same composition without the addition of nickel. Specifically, the nickel in the composition is believed to contribute to the shifting of the peritectic point away from the carbon region and/or increases a transition temperature of the peritectic point of the composition, which appears to inhibit defects and results in an ultra-high strength weathering steel sheet that is defect free.

High friction rolling an ultra-high strength weathering steel further improves the formability of the ultra-high strength weathering steel. A measure for formability is set forth by the ASTM A370 bend tests standard. In embodiments, the ultra-high strength weathering steel of the present disclosure will pass a 3T 180-degree bend test and will do so consistently. In particular, the high friction rolling generates smears from the prior austenite grain boundary depressions under shear through plastic deformation. These elongated surface structures, characterized as the smear pattern, are desirous for the properties of an ultra-high strength weathering steel. Specifically, the formability of the ultra-high strength weathering steel is improved by the smear pattern.

The steel strip may further comprise by weight greater than 0.005% niobium or greater than 0.01% or 0.02% niobium. The steel strip may comprise by weight greater than 0.05% molybdenum or greater than 0.1% or 0.2% molybdenum. The steel strip may be silicon killed containing by weight less than 0.008% aluminum or less than 0.006% aluminum. The molten melt may have a free oxygen content between 5 to 70 ppm. The steel strip may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel strip less than 2.5 mm in thickness, and cooled in a non-oxidizing atmosphere to below 1080° C. and above $Ar_3$ temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel strip may come from an austenite grain size of greater than 100 μm. In other embodiments, the martensite in the steel strip may come from an austenite grain size of greater than 150 μm. Rapid solidification at heat fluxes greater than 10 $MW/m^2$ enables the production of an austenite grain size that is responsive to controlled cooling after subsequent hot rolling to enable the production of defect free strip.

As indicated above, the steel strip of the present set of examples may comprise a microstructure having martensite or martensite plus bainite. Martensite is formed in carbon steels by the rapid cooling, or quenching, of austenite. Austenite has a particular crystalline structure known as face-centered cubic (FCC). If allowed to cool naturally, austenite turns into ferrite and cementite. However, when the austenite is rapidly cooled, or quenched, the face-centered cubic austenite transforms to a highly strained body-centered tetragonal (BCT) form of ferrite that is supersaturated with carbon. The shear deformations that result produce large numbers of dislocations, which is a primary strengthening mechanism of steels. The martensitic reaction begins during cooling when the austenite reaches the martensite start temperature and the parent austenite becomes thermodynamically unstable. As the sample is quenched, an increasingly large percentage of the austenite transforms to martensite until the lower transformation temperature is reached, at which time the transformation is completed.

Martensitic steels, however, are susceptible to producing the large prior austenite grain boundary depressions observed on the hot rolled exterior surfaces of cooled thin steel strips formed of low friction condition rolled steel. The step of acid pickling or etching amplifies these imperfections resulting in defects and separations. High friction rolling is now introduced as an alternative to overcome the problems identified for a low friction condition rolled martensitic steel. High friction rolling produces a smeared boundary pattern. Smeared boundary patterns may more generally be referred to herein as smear patterns. Additionally, smeared boundary patterns may alternatively be descriptively referred to as fish scale patterns.

Just as the ultra-high strength weathering steel above is relied on to produce product shapes and configurations such as the piles described above many products may be produced from a high friction rolled high strength weathering steel sheet of the type described herein. Like above, one example of a product that may be produced from a high friction rolled high strength weathering steel sheet includes a steel pile. In one example, a steel pile comprises a web and one or more flanges cold roll formed from the carbon alloy steel strip of the varieties described above. The steel pile may further comprise a length where the web and the one or more flanges extend the length. In use, the length of the steel pile is driven into the earth or soil to provide a structural foundation. The steel pile is driven into the earth or soil using a ram, such as a piston or hammer. The ram may be a part of and is, at least, driven by a pile driver. The ram strikes or impacts the steel pile forcing the steel pile into the earth or soil. Due to the impact, prior steel piles may buckle or become deformed under the impact of the ram. To avoid buckling, or damage, to prior steel piles the RPM or force of the pile driver is maintained below a damaging threshold. The present steel pile has illustrated an ability for an increase in the RPM or force being applied to the steel pile without buckling, or damaging, the steel pile, as reflected by the strength properties of the steel pile, comparatively to prior steel piles. Specifically, as tested, prior steel piles of comparable dimensional characteristics were driven and structurally failed wherein the steel pile of the present disclosure provide an increase of RPM of 25%. Moreover, the prior steel piles were additionally not weathering steel. Thereby, prior steel piles are susceptible to corrosion due to their placement in exterior conditions, including earth and soil conditions. Again, the present steel pile provides the necessary corrosion index for withstanding these conditions. The present strength properties and corrosion properties have not before been seen in combination for such a product.

In one example, the steel pile may be formed from a carbon alloy steel strip cast of the present examples at a cast thickness less than or equal to 2.5 mm. In another example, the steel pile may be formed from a steel strip of the present examples less than or equal to 2.0 mm. In still yet, another example, the steel pile may be formed from a steel sheet of the present examples that is between 1.4 mm to 1.5 mm or of 1.4 mm or 1.5 mm in thickness. The steel piles may be channels, such as C-channels, box channels, double channels, or the like. The steel piles may, additionally or alternatively, be I-shaped members, angles, structural tees, hollow structural sections, double angles, S-shapes, tubes, or the like. Moreover, many of these members may be connected together, e.g. welded together, to form a single steel pile. It is appreciated herein, additional products may be made from a high friction rolled ultra-high strength weathering steel sheet.

High Friction Rolled High Strength Martensitic Steel

In embodiments of the present disclosure, a high strength martensitic steel sheet is also disclosed. The high strength martensitic steel sheet examples that follow may additionally comprise weathering characteristics. Thereby, the high strength martensitic steel sheet examples herein may also be referred to as an ultra-high strength weathering steel sheet for such properties. Martensitic steels are increasingly being used in applications that require high strength, for example, in the automotive industry. Martensitic steel provides the strength necessary by the automotive industry while decreasing energy consumption and improving fuel economy. Martensite is formed in carbon steels by the rapid cooling, or quenching, of austenite. Austenite has a particular crystalline structure known as face-centered cubic (FCC). If allowed to cool naturally, austenite turns into ferrite and cementite. However, when the austenite is rapidly cooled, or quenched, the face-centered cubic austenite transforms to a highly strained body-centered tetragonal (BCT) form of ferrite that is supersaturated with carbon. The shear deformations that result produce large numbers of dislocations, which is a primary strengthening mechanism of steels. The martensitic reaction begins during cooling when the austenite reaches the martensite start temperature and the parent austenite becomes thermodynamically unstable. As the sample is quenched, an increasingly large percentage of the austenite transforms to martensite until the lower transformation temperature is reached, at which time the transformation is completed.

Martensitic steels, however, are susceptible to producing the large prior austenite grain boundary depressions observed on the hot rolled exterior surfaces of cooled thin steel strips formed of low friction condition rolled steel. The step of acid pickling or etching amplifies these imperfections resulting in defects and separations. High friction rolling is now introduced as an alternative to overcome the problems identified for a low friction condition rolled martensitic steel, however, high friction rolling has also been observed to produce an undesirable surface finish. In particular, high friction rolling produces smeared boundary pattern in combination with an uneven surface finish. Smeared boundary patterns may more generally be referred to herein as smear patterns. Additionally, smeared boundary patterns may alternatively be descriptively referred to as fish scale patterns. The uneven surface finish, having the smear patterns, then becomes susceptible to trapping acid and/or causing excessive corrosion, such as when the thin steel strip undergoes subsequent acid etching, thereby, resulting in excessive amounts of pitting. In view of this, for some steel strips or products, such as a martensitic steel sheet for use in an automotive application, additional surface treatment is warranted to provide a surface where the smear patterns and/or uneven surface finishes are removed from the surface.

To reduce or eliminate the smear pattern, and/or the uneven surface finish, the thin steel strip undergoes a surface homogenization process after the hot rolling mill. Examples of a surface homogenization process include abrasive blasting such as, for example, through use of an abrasive wheel, shot blasting, sand blasting, wet abrasive blasting, other pressurized application of an abrasive, or the like. One specific example of a surface homogenization process includes an eco-pickled surface (referred herein as "EPS"). Other examples of a surface homogenization process include the forceful application of an abrasive media onto the surface of the steel strip for homogenizing the surface of the steel strip. A pressurized component may also be relied on for the forceful application. By example, a fluid may propel an abrasive media. A fluid, as used herein, includes liquid and air. Additionally, or alternatively, a mechanical device may provide the forceful application. The surface homogenization process occurs after the thin cast steel strip reaches room temperature. In other words, the surface homogenization process does not occur in an in-line process with the hot rolling mill. The surface homogenization process may occur at a location separate from, or off-line from, the hot rolling mill and/or the twin cast rollers. In some examples, the surface homogenization process may occur after coiling.

Figure 7:
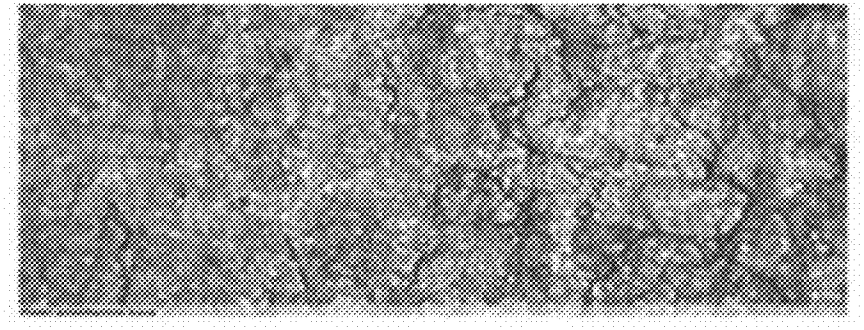
FIG. 7 is an image showing a high friction condition hot rolled steel strip surface having a smear pattern that has not been homogenized.
Figure 6:
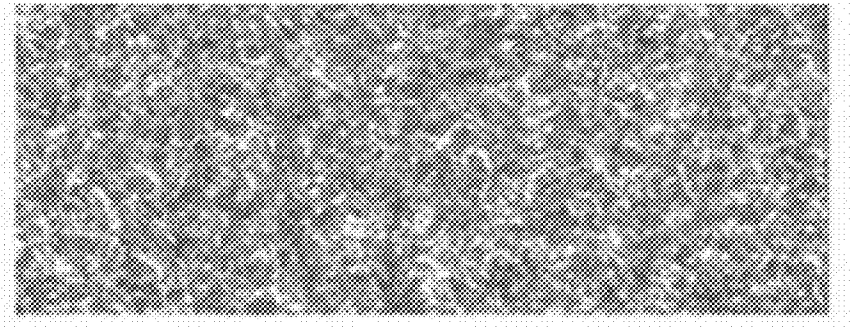
FIG. 6 is an image showing a high friction condition hot rolled steel strip surface following a surface homogenization process.

As used herein, the surface homogenization process alters the surface to be free of a smear pattern or eliminates the smear pattern. A surface of a thin steel strip that is free of a smear pattern or wherein the smear pattern has been eliminated is a surface that passes a 120-hour corrosion test without any surface pitting corrosion. Test samples which did not undergo a surface homogenization process fractured after 24 hours during a 120-hour corrosion test due to surface corrosion. FIG. 6 is an image showing a high friction hot rolled steel strip surface homogenized using EPS. Comparatively, FIG. 7 is an image showing a high friction hot rolled steel strip surface having a smear pattern that has not undergone a surface homogenization process. As indicated above, the smear pattern, unless it is removed by the surface homogenization process, may trap acid upon acid etching and, thereby, be susceptible to excessive pitting and/or corrosion. In summary and as used herein, a surface that has undergone surface homogenization is a surface which is free of the smear pattern previously formed by a high friction rolling condition.

After hot rolling, the hot rolled thin steel strip is cooled. In each of the embodiments, the steel strip undergoes the surface homogenization process after cooling. It is appreciated that cooling may be accomplished by any known manner. In certain instances, when cooling the thin steel strip, the thin steel strip is cooled to a temperature equal to or less than a martensite start transformation temperature $M_S$ to thereby form martensite from prior austenite within the thin steel strip.

An embodiment of a high strength martensitic steel sheet is made by the steps comprising: (a) preparing a molten steel melt comprising: (i) by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. and above $Ar_3$ temperature at a cooling rate greater than 15° C./s before rapidly cooling; (c)

high friction rolling the thin cast steel strip to a hot rolled thickness of between a 15% and 50% reduction of the as cast thickness producing a hot rolled steel strip free of prior-austenite grain boundary depressions; (d) rapidly cooling to form a steel sheet with a microstructure having by volume at least 75% martensite or at least 75% martensite plus bainite, a yield strength of between 700 and 1600 MPa, a tensile strength of between 1000 and 2100 Mpa and an elongation of between 1% and 10%; and I surface homogenizing the high friction hot rolled steel strip producing a high friction hot rolled steel strip having a pair of opposing high friction hot rolled homogenized surfaces free of the smear pattern. Here and elsewhere in this disclosure elongation means total elongation. "Rapidly cooling" means to cool at a rate of more than 100° C./s to between 100 and 200° C. Rapidly cooling the present compositions, with an addition of nickel, achieves up to more than 95% martensitic phase steel strip. In one example, rapidly cooling forms a steel sheet with a microstructure having by volume at least 95% martensite or at least 95% martensite plus bainite. The addition of nickel must be sufficient enough to shift the 'peritectic point' away from the carbon region that would otherwise be present in the same composition without the addition of nickel. Specifically, the nickel in the composition is believed to contribute to the shifting of the peritectic point away from the carbon region and/or increases a transition temperature of the peritectic point of the composition, which appears to inhibit defects and results in a high strength martensitic steel sheet that is defect free.

Additional variations of the examples of a high friction rolled high strength martensitic steel follow. In some examples, the steel strip may comprise a pair of opposing high friction hot rolled homogenized surfaces substantially free of prior austenite grain boundary depressions and smear pattern. In yet another example, the steel strip may further comprise a pair of opposing high friction hot rolled homogenized surfaces primarily free of prior austenite grain boundary depressions and a smear pattern. In each of these examples, the surfaces may have a surface roughness (Ra) that is not more than 2.5 μm.

In some examples the thin steel strip may be further tempered at a temperature between 150° C. and 250° C. for between 2 and 6 hours. Tempering the steel strip provides improved elongation with minimal loss in strength. For example, a steel strip having a yield strength of 1250 MPa, tensile strength of 1600 MPa and an elongation of 2% was improved to a yield strength of 1250 MPa, tensile strength of 1525 MPa and an elongation of 5% following tempering as described herein.

The steel strip may further comprise by weight greater than 0.005% niobium or greater than 0.01% or 0.02% niobium. The steel strip may comprise by weight greater than 0.05% molybdenum or greater than 0.1% or 0.2% molybdenum. The steel strip may be silicon killed containing by weight less than 0.008% aluminum or less than 0.006% aluminum. The molten melt may have a free oxygen content between 5 to 70 ppm. The steel strip may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel strip less than 2.5 mm in thickness, and cooled in a non-oxidizing atmosphere to below 1080° C. and above $Ar_3$ temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel strip may come from an austenite grain size of greater than 100 μm. In other embodiments, the martensite in the steel strip may come from an austenite grain size of greater than 150 μm. Rapid solidification at heat fluxes greater than 10 $MW/m^2$ enables the production of an austenite grain size that is responsive to controlled cooling after subsequent hot rolling to enable the production of a defect free strip.

A high friction rolled steel sheet may be provided for use in hot-stamping applications. Generally, steel sheets relied on for use in hot-stamping applications are of stainless-steel compositions or require an aluminum-silicon corrosion resistant coating. In a hot-stamping application a corrosion resistant protective layer is desired while maintaining high-strength properties and favorable surface structure characteristics. The present high friction rolled compositions have achieved the desired properties without relying on stainless steel compositions or otherwise providing an aluminum-silicon corrosion resistant coating. Instead, the present high friction rolled compositions rely on a mixture of nickel, chromium, and copper, as illustrated in the various examples above, for improved corrosion resistance. In the hot-stamping application the high friction rolled steel sheet undergoes an austenitizing condition at between 900° C. and 930° C. for a period of between 6 minutes and 10 minutes. In one example, the high friction rolled steel sheet undergoes an austenitizing condition at 900° C. for a period of 6 minutes. In another example, the high friction rolled steel sheet undergoes an austenitizing condition at 900° C. for a period of 10 minutes. In yet another example, the high friction rolled steel sheet undergoes an austenitizing condition at 930° C. for a period of 6 minutes. In still yet another example, the high friction rolled steel sheet undergoes an austenitizing condition at 930° C. for a period of 10 minutes. Table 25, below, illustrates the properties of a high friction rolled steel sheet are maintained above a minimum tensile strength of 1500 MPa, a minimum yield strength of 1100 MPa, and a minimum elongation of 3% for a hot-stamping application.

TABLE 25

| Austenitizing Condition | Tensile Strength (MPa) | Yield Strength (MPa) | Elongation (%) |
|---|---|---|---|
| 900° C., 6 minutes | 1546.98 | 1155.06 | 7.3 |
| 900° C., 6 minutes | 1576.65 | 1154.37 | 7.0 |
| 900° C., 10 minutes | 1591.14 | 1168.86 | 6.4 |
| 900° C., 10 minutes | 1578.03 | 1152.30 | 6.6 |
| 930° C., 6 minutes | 1566.30 | 1146.09 | 7.3 |
| 930° C., 6 minutes | 1566.99 | 1178.52 | 6.5 |
| 930° C., 10 minutes | 1509.03 | 1109.52 | 6.6 |
| 930° C., 10 minutes | 1521.45 | 1129.53 | 6.4 |

In these examples, a steel sheet provided for use in a hot-stamping application may comprise a composition of any one of the examples of the steel sheets disclosed above, but, is a steel sheet which may remain unquenched. Specifically, a steel sheet provided for use in a hot-stamping application may be made by the steps comprising: (a) preparing a molten steel melt comprising: (i) by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. and above $Ar_3$ temperature at a cooling rate greater than 15° C./s before rapidly cooling; (c) high friction rolling the thin cast steel strip to a hot rolled thickness of between a 15% and 50% reduction of the as cast thickness producing a hot rolled steel strip primarily free, substantially free, or free of prior austenite grain boundary depressions and having a smear pattern; and (d) cooling at less than 100° C./s to form a steel sheet having a microstructure of primarily bainite. In other words, a steel sheet provided for use in a hot-stamping application may be any one of the examples of the steel sheets disclosed above with the exception that the steel sheet is not rapidly cooled and, thereby, the microstructure having primarily or substantially martensite or martensite plus bainite is not formed. Instead, the steel sheet provide for use in a hot-stamping application is cooled at less than 100° C./s.

Hot Rolling, Including Low Friction Hot Rolling and High Friction Hot Rolling

Hot rolling and, more specifically, low friction rolling and high friction rolling, as relied on in the above examples of the present disclosure, is further described below. The concepts as described below may be applied to the examples provided above as necessary to achieve the properties of each respective example. Generally, in each of the hot rolled examples, the strip is passed through the hot mill to reduce the as-cast thickness before the strip is cooled, such as to a temperature at which austenite in the steel transforms to martensite in particular embodiments. In particular instances, the hot solidified strip (the cast strip) may be passed through the hot mill while at an entry temperature greater than 1050° C., and in certain instances up to 1150° C. After the strip exits the hot mill, the strip is cooled such as, in certain exemplary instances, to a temperature at which the austenite in the steel transforms to martensite by cooling to a temperature equal to or less than the martensite start transformation temperature Ms. In certain instances, this temperature is ≤600° C., where the martensite start transformation temperature $M_S$ is dependent on the particular composition. Cooling may be achieved by any known methods using any known mechanism(s), including those described above. In certain instances, the cooling is sufficiently rapid to avoid the onset of appreciable ferrite, which is also influenced by composition. In such instances, for example, the cooling is configured to reduce the temperature of the strip at the rate of about 100° C. to 200° C. per second.

Hot rolling is performed using one or more pairs of opposing work rolls. Work rolls are commonly employed to reduce the thickness of a substrate, such as a plate or strip. This is achieved by passing the substrate through a gap arranged between the pair of work rolls, the gap being less than the thickness of the substrate. The gap is also referred to as a roll bite. During hot working, a force is applied to the substrate by the work rolls, thereby applying a rolling force on the substrate to thereby achieve a desired reduction in the substrate thickness. In doing so, friction is generated between the substrate and each work roll as the substrate translates through the gap. This friction is referred to as roll bite friction.

Traditionally, the desire is to reduce the bite friction during hot rolling of steel plates and strips. By reducing the bite friction (and therefore the friction coefficient), the rolling load and roll wear are reduced to extend the life of the machine. Various techniques have been employed to reduce roll bite friction and the coefficient of friction. In certain exemplary instances, the thin steel strip is lubricated to reduce the roll bite friction. Lubrication may take the form of oil, which is applied to rolls and/or thin steel strip, or of oxidation scale formed along the exterior of the thin steel strip prior to hot rolling. By employing lubrication, hot rolling may occur in a low friction condition, where the coefficient of friction (μ) for the roll bite is less than 0.20.

Figure 8:
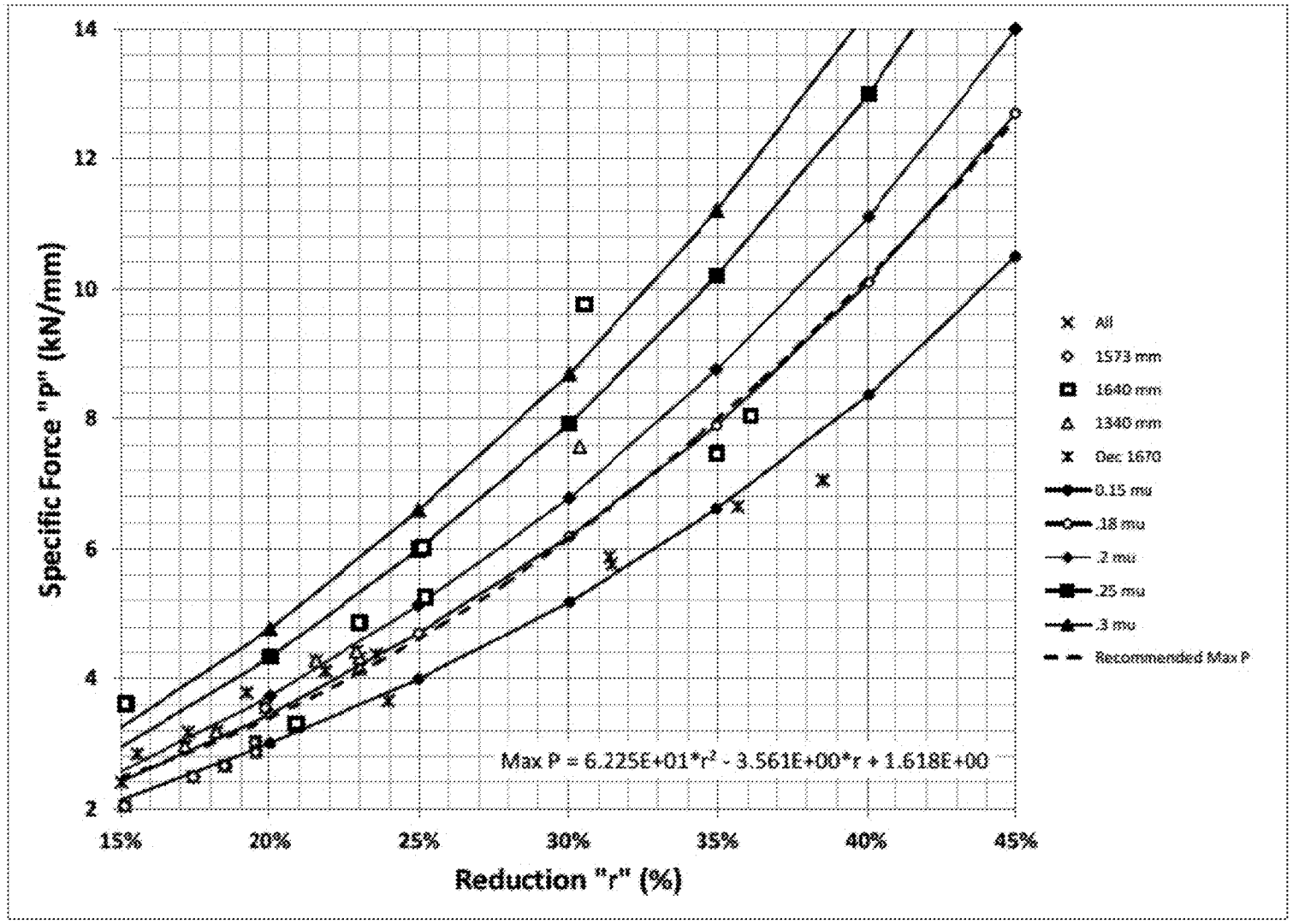
FIG. 8 is a coefficient of friction model chart created to determine the coefficient of friction for a particular pair of work rolls, specific mill force, and corresponding reduction.

In one example, the friction coefficient (μ) is determined based upon a hot rolling model developed by HATCH for a particular set of work rolls. The model is shown in FIG. 8, providing thin steel strip thickness reduction in percent along the X-axis and the specific force "P" in kN/mm along the Y-axis. The specific force P is the normal (vertical) force applied to the substrate by the work rolls. The model includes five (5) curves each representing a coefficient of friction and providing a relationship between reduction and work roll forces. For each coefficient of friction, expected work roll forces are obtained based upon the measured reduction. In operation, during hot rolling, the targeted coefficient of friction is preset by adjustment of work roll lubrication, the target reduction is set by the desired strip thickness required at the mill exit to meet a specific customer order and the actual work roll force will be adjusted to achieve the target reduction. FIG. 8 shows typical forces required to achieve a target reduction for a specific coefficient of friction.

In certain exemplary instances, the coefficient of friction is equal to or greater than 0.20. In other exemplary instances, the coefficient of friction is equal to or greater than 0.25, equal to or greater than 0.268 or equal to or greater than 0.27. It is appreciated that these friction coefficients are sufficient, under certain conditions for austenitic steel (which is the steel alloy employed in the examples shown in the figures), where during hot rolling, the steel is austenitic but after cooling martensite is formed having prior austenite grains and prior austenite grain boundary depressions present, to at least primarily or substantially eliminate prior austenite grain boundary depressions from hot rolled surfaces and to generate elongated surface features plastically formed by shear. As noted previously, various factors or parameters may be altered to attain a desired coefficient of friction under certain conditions. It is noted that for the coefficient of friction values previously described, for substrates having a thickness of 5 mm or less prior to hot rolling the normal force applied to the substrate during hot rolling may be 600 to 2500 tons while the substrate and enters the pair of work rolls and translates, or advances, at a rate of 45 to 75 meters per minute (m/min) where the temperature of the substrate entering the work rolls is greater than 1050° C., and in certain instances, up to 1150° C. For these coefficients of friction, the work rolls have a diameter of 400 to 600 mm. Of course, variations outside each of these parameter ranges may be employed as desired to attain different coefficients of friction as may be desired to achieve the hot rolled surface characteristics described herein.

In one example, hot rolling is performed under a high friction condition with a coefficient of friction of 0.25 at 60 meters per minute (m/min) at a reduction of 22% with a work roll force of approximately 820 tons. In another example, hot rolling is performed under a high friction condition with a coefficient of friction of 0.27 at 60 meters per minute (m/min) at a reduction of 22% with a work roll force of approximately 900 tons.

Figure 9:
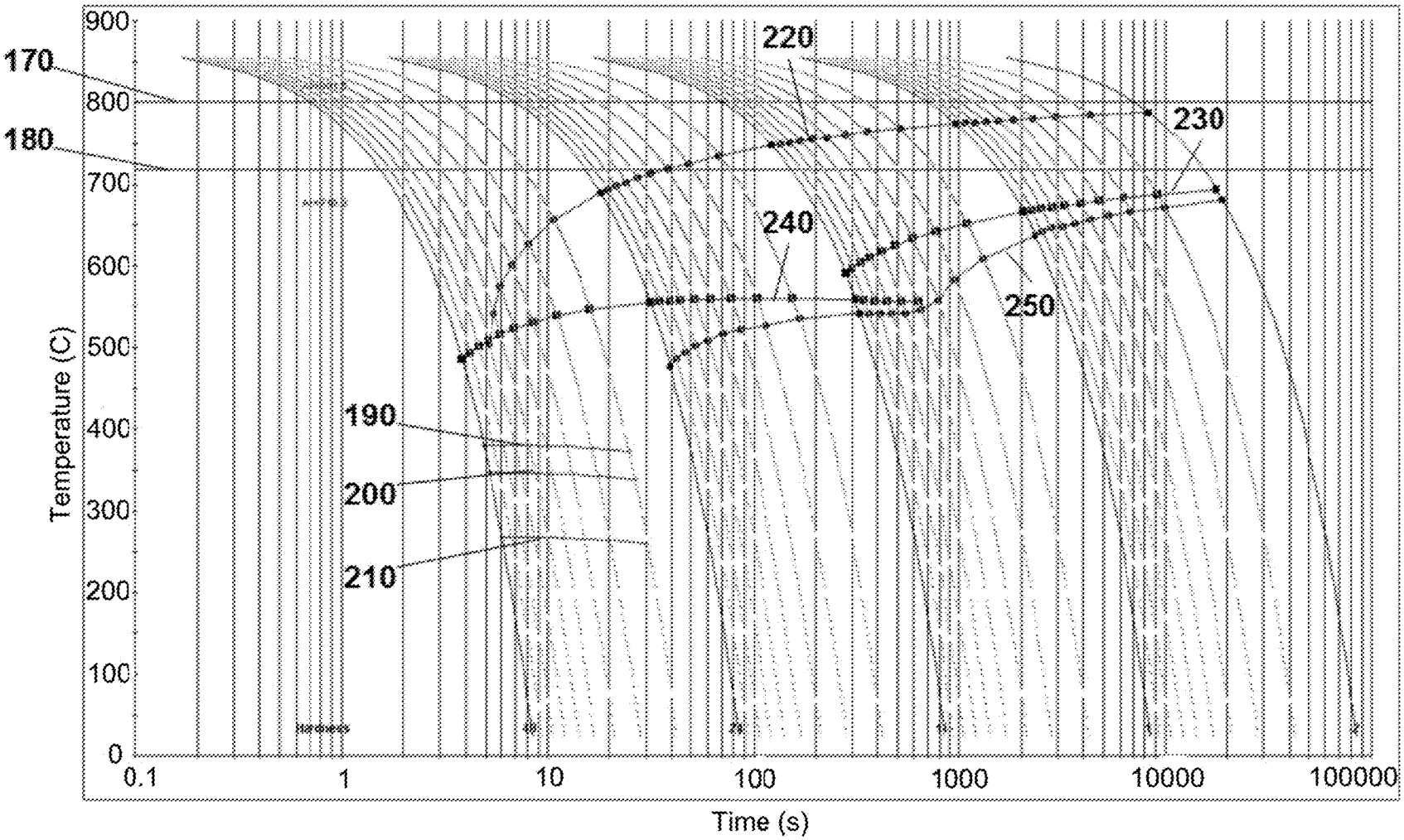
FIG. 9 is a continuous cool transformation (CCT) diagram for steel.

As relied on in the examples of the present disclosure, hot rolling of the thin steel strip is performed while the thin steel strip is at a temperature above the $Ar_3$ temperature. The $Ar_3$ temperature is the temperature at which austenite begins to transform to ferrite during cooling. In other words, the $Ar_3$ temperature is the point of austenite transformation. The $Ar_3$ temperature is located a few degrees below the $A_3$ temperature. Below the $Ar_3$ temperature, alpha ferrite forms. These temperatures are shown in an exemplary CCT diagram in FIG. 9. In FIG. 9, $A_3$ 170 represents the upper temperature for the end of stability for ferrite in equilibrium. $Ar_3$ is the upper limit temperature for the end of stability for ferrite on cooling. More specifically, The $Ar_3$ temperature is the temperature at which austenite begins to transform to ferrite during cooling. In other words, the $Ar_3$ temperature is the point of austenite transformation. Comparatively, $A_1$ 180 represents the lower limit temperature for the end of stability for ferrite in equilibrium.

Still referring to FIG. 9, the ferrite curve 220 represents the transformation temperature producing a microstructure of 1% ferrite, the pearlite curve 230 represents the transformation temperature producing a microstructure of 1% pearlite, the austenite curve 250 represents the transformation temperature producing a microstructure of 1% austenite, and the bainite curve ($B_s$) 240 represents the transformation temperature producing a microstructure of 1% bainite. As previously described in greater detail, a martensite start transformation temperature $M_S$ is represented by the martensite curve 190 where martensite begins forming from prior austenite within the thin steel strip. Further illustrated by FIG. 9 is a 50% martensite curve 200 representing a microstructure having at least 50% martensite. Additionally, FIG. 9 illustrates a 90% martensite curve 210 representing a microstructure having at least 90% martensite.

In the exemplary CCT diagram shown in FIG. 9, the martensite start transformation temperature $M_S$ 190 is shown. In passing through the cooler, the austenite in the strip is transformed to martensite. Specifically, in this instance, cooling the strip to below 600° C. causes a transformation of the coarse austenite wherein a distribution of fine iron carbides are precipitated within the martensite.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A cold-formed ultra-high strength weathering steel pile made from a continuously cast hot rolled steel strip, the cold-formed ultra-high strength weathering steel pile comprising:

a cold-formed web and a pair of cold-formed opposing flanges, each having discontinuities formed therein, an as-cast thickness of about 2.5 mm or less, having martensite formed from prior austenite grain sizes of at least 100 μm, and having a composition comprising, by weight, (i) between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting;

the pile having a microstructure of at least 75% by volume martensite and having a corrosion index of 6.0 or greater, a yield strength of between 700 and 1600 MPa, a tensile strength of between 1000 and 2100 MPa, and an elongation of between 1% and 10%.

2. A solar arrangement comprising:

a cold-formed ultra-high strength weathering steel pile made from a continuously cast hot rolled steel strip, the cold-formed ultra-high strength weathering steel pile comprising:

a cold-formed web and a pair of cold-formed opposing flanges, each having discontinuities formed therein, an as-cast thickness of about 2.5 mm or less, having martensite formed from prior austenite grain sizes of at least 100 μm, and having a composition comprising:

(i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting;

the cold-formed ultra-high strength weathering steel pile having a microstructure of at least 75% by volume martensite and having a corrosion index of 6.0 or greater, a yield strength of between 700 and 1600 MPa, a tensile strength of between 1000 and 2100 MPa, and an elongation of between 1% and 10%; and wherein a partial length of the cold-formed ultra-high strength weathering steel pile is driven into a ground surface and one or more solar cells are supported above the ground surface by the cold-formed ultra-high strength weathering steel pile.

3. A cold-formed ultra-high strength weathering steel pile made from a continuously cast hot rolled steel strip, the cold-formed ultra-high strength weathering steel pile comprising:

a cold-formed web and a pair of cold-formed opposing flanges, each having discontinuities formed therein, an as-cast thickness of about 2.5 mm or less, having a composition comprising:

(i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, silicon killed containing less than 0.01% aluminum, and an amount of nickel sufficient for shifting a peritectic point away from the carbon region and/or increasing a transition temperature of the peritectic point to form a carbon alloy steel strip having the microstructure of at least 75% by volume martensite, and (ii) the remainder iron and impurities resulting from melting, and having martensite formed from prior austenite grain sizes of at least 100 μm, a corrosion index of 6.0 or greater, a yield strength of between 700 and 1600 MPa, a tensile strength of between 1000 and 2100 MPa, and an elongation of between 1% and 10%.

4. The cold-formed ultra-high strength weathering steel pile of claim 1 where the discontinuity of the web is a V-shaped transition.

5. The cold-formed ultra-high strength weathering steel pile of claim 1 where a height of the pile extending the web is between 4 and 12 inches and the width of the pile extending each flange of the pair of opposing flanges is between 2 and 8 inches.

6. The cold-formed ultra-high strength weathering steel pile of claim 1 where the as-cast thickness is 2.0 mm or less.

7. The cold-formed ultra-high strength weathering steel pile of claim 1 where the as-cast thickness is 1.6 mm or less.

8. The cold-formed ultra-high strength weathering steel pile of claim 1 where the discontinuity of the web is one or more corrugations that are arcs.

9. The cold-formed ultra-high strength weathering steel pile of claim 1 where the discontinuity of the web is one or more corrugations that are true arcs.

10. The cold-formed ultra-high strength weathering steel pile of claim 1 where the arcs include one or more flats that are at least 1× the thickness.

11. The cold-formed ultra-high strength weathering steel pile of claim 1 comprising a completed austenite grain transformation.

12. The cold-formed ultra-high strength weathering steel pile of claim 4 where the V-shaped transition is centrally positioned on the web relative a height of the pile and the pile forms a M-Channel.

13. The cold-formed ultra-high strength weathering steel pile of claim 4 where the discontinuity of each flange of the pair of opposing flanges is a corrugation that is an arc.

14. The cold-formed ultra-high strength weathering steel pile of claim 4 where the discontinuity of each flange of the pair of opposing flanges is a corrugation that is a true arc.

15. The cold-formed ultra-high strength weathering steel pile of claim 4 further comprising a triple edge.

16. The cold-formed ultra-high strength weathering steel pile of claim 12 where the discontinuity of each flange of the pair of opposing flanges is a V-shaped transition.

17. The cold-formed ultra-high strength weathering steel pile of claim 16 where the V-shaped transition of each flange of the pair of opposing flanges is centrally positioned on each flange relative the width of the pile.

18. The cold-formed ultra-high strength weathering steel pile of claim 13 where the arc of each flange of the pair of opposing flanges is centrally positioned on each flange relative the width of the pile.

19. The cold-formed ultra-high strength weathering steel pile of claim 13 where the arc of each flange of the pair of opposing flanges include one or more flats that are at least 1× the thickness.

20. The cold-formed ultra-high strength weathering steel pile of claim 10 where the web comprises two corrugations that are arcs that are evenly spaced on the web relative a height of the pile.

21. The cold-formed ultra-high strength weathering steel pile of claim 10 where the discontinuity of each flange is one or more corrugations that are arcs.

22. The cold-formed ultra-high strength weathering steel pile of claim 21 where the one or more corrugations of the flanges are centrally positioned on each flange relative the width of the pile.

23. The cold-formed ultra-high strength weathering steel pile of claim 22 where a height of the pile extending the web is between 4 and 12 inches and the width of the pile extending each flange of the pair of opposing flanges is between 2 and 8 inches.

24. The cold-formed ultra-high strength weathering steel pile of claim 22 where each flange comprises a return lip.

25. The cold-formed ultra-high strength weathering steel pile of claim 24 where each return lip returns at an angle oblique relative to both the web and the corresponding flange.

26. The cold-formed ultra-high strength weathering steel pile of claim 25 where a height of the pile extending the web is between 4 and 12 inches and the width of the pile extending each flange of the pair of opposing flanges is between 2 and 8 inches.

27. The solar arrangement of claim 2 where the cold-formed ultra-high strength weathering steel pile comprises a completed austenite grain transformation.

28. The cold-formed ultra-high strength weathering steel pile of claim 3 comprising a completed austenite grain transformation.

* * * * *